US012291864B2

(12) United States Patent
Chevis

(10) Patent No.: US 12,291,864 B2
(45) **Date of Patent: *May 6, 2025**

(54) CLAMP ASSEMBLY FOR A FORMWORK SYSTEM

(71) Applicant: Apache Industrial Services, Inc., Houston, TX (US)

(72) Inventor: Kenneth M. Chevis, Metairie, LA (US)

(73) Assignee: Apache Industrial Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/988,693

(22) Filed: Nov. 16, 2022

(65) Prior Publication Data

US 2023/0078508 A1 Mar. 16, 2023

Related U.S. Application Data

(63) Continuation of application No. 16/680,368, filed on Nov. 11, 2019, now Pat. No. 12,116,779, which is a (Continued)

(51) Int. Cl.
*E04B 2/86* (2006.01)
*E04G 11/00* (2006.01)
(Continued)

(52) U.S. Cl.
CPC ..... *E04B 2/8629* (2013.01); *E04G 11/00* (2013.01); *E04G 11/062* (2013.01); (Continued)

(58) Field of Classification Search
CPC ..... E04G 17/00; E04G 17/16; E04G 17/002; E04G 17/04; E04G 17/047; E04G 17/02; E04G 21/3276; E04G 11/00; E04G 11/062; E04G 11/085; E04G 11/087; E04G 13/02; E04G 17/001; E04G 17/042; E04G 17/0644; E04G 17/0652; E04G 17/14;
(Continued)

(56) References Cited

U.S. PATENT DOCUMENTS 559,931 A 5/1896 Campbell
1,163,188 A 12/1915 Waite
(Continued)

FOREIGN PATENT DOCUMENTS

BE 1006369 A6 8/1994
CA 2712330 A1 7/2011
(Continued)

OTHER PUBLICATIONS

PCT International Search Report and Written Opinion; PCT/US2021/020113; Aug. 2021.
(Continued)

*Primary Examiner* — Beth A Stephan
(74) *Attorney, Agent, or Firm* — Lerner David LLP

(57) ABSTRACT

Various implementations described herein are directed to a formwork system. In one implementation, the formwork system includes aluminum extrusions and aluminum castings. The aluminum castings and the aluminum extrusions can be assembled by being pressed and riveted together.

20 Claims, 68 Drawing Sheets

Related U.S. Application Data continuation of application No. 15/630,923, filed on Jun. 22, 2017, now Pat. No. 10,472,823.

(60) Provisional application No. 62/471,173, filed on Mar. 14, 2017, provisional application No. 62/354,325, filed on Jun. 24, 2016.

(51) Int. Cl.

| | |
|---|---|
| ***E04G 11/06*** | (2006.01) |
| ***E04G 11/08*** | (2006.01) |
| ***E04G 11/54*** | (2006.01) |
| ***E04G 11/56*** | (2006.01) |
| ***E04G 13/02*** | (2006.01) |
| ***E04G 17/00*** | (2006.01) |
| ***E04G 17/04*** | (2006.01) |
| ***E04G 17/06*** | (2006.01) |
| ***E04G 17/065*** | (2006.01) |
| ***E04G 17/14*** | (2006.01) |
| ***E04G 17/16*** | (2006.01) |
| *E04B 2/14* | (2006.01) |
| *E04G 9/02* | (2006.01) |
| *E04G 21/32* | (2006.01) |

(52) U.S. Cl.

CPC ..... *E04G 11/085* (2013.01); *E04G 11/087* (2013.01); *E04G 11/54* (2013.01); *E04G 11/56* (2013.01); *E04G 13/02* (2013.01); *E04G 17/00* (2013.01); *E04G 17/001* (2013.01); *E04G 17/002* (2013.01); *E04G 17/042* (2013.01); *E04G 17/0644* (2013.01); *E04G 17/0652* (2013.01); *E04G 17/14* (2013.01); *E04G 17/16* (2013.01); *E04B 2/14* (2013.01); *E04G 2009/025* (2013.01); *E04G 2009/028* (2013.01); *E04G 2017/008* (2013.01); *E04G 21/3276* (2013.01)

(58) Field of Classification Search

CPC ..... E04G 2009/025; E04G 2017/008; F16B 2/065; F16B 2/12; E04B 2/14

USPC ..... 249/219.1, 219.2, 192; 248/228.5, 248/231.41, 228.3, 316.4, 229.12, 229.22, 248/230.3

See application file for complete search history.

(56) References Cited

U.S. PATENT DOCUMENTS

| | | | |
|---|---|---|---|
| 1,176,005 | A | 3/1916 | Waite |
| 1,473,504 | A | 11/1923 | Earl |
| 1,575,268 | A | 3/1926 | Howard |
| 1,653,126 | A | 12/1927 | Schwerin |
| RE17,629 | E | 3/1930 | Wehr |
| 1,768,543 | A | 7/1930 | Clausing |
| 1,890,336 | A | 12/1932 | Nodine |
| 1,890,386 | A | 12/1932 | Kingston |
| 1,919,405 | A | 7/1933 | Wilson |
| 1,970,547 | A | 8/1934 | Anderon |
| 1,974,628 | A | 9/1934 | Presley |
| 1,974,752 | A | 9/1934 | Roberg |
| 2,261,907 | A | 11/1941 | Uecker et al. |
| 2,357,819 | A | 9/1944 | Robert |
| 2,382,201 | A | 8/1945 | Burke et al. |
| 2,479,962 | A | 8/1949 | Paulson |
| 2,573,806 | A | 10/1951 | Yoshimoto |
| 2,631,346 | A | 3/1953 | Wengen et al. |
| 2,760,249 | A | 8/1956 | Woodrow |
| 2,804,673 | A | 9/1957 | Fex |
| 2,877,974 | A | 3/1959 | Estes |
| 2,944,120 | A | 7/1960 | Ruben |
| 2,970,677 | A | 2/1961 | Springs, Jr. et al. |
| 2,974,762 | A | 3/1961 | Mauritz |
| 2,976,597 | A | 3/1961 | Bert |
| 3,005,282 | A | 10/1961 | Christiansen |
| 3,018,898 | A | 1/1962 | Frazelle |
| 3,077,653 | A | 2/1963 | Ward |
| 3,124,330 | A | 3/1964 | Robinson |
| 3,168,772 | A | 2/1965 | Williams |
| 3,204,918 | A | 9/1965 | Bonin |
| 3,217,833 | A | 11/1965 | Smith |
| 3,222,829 | A | 12/1965 | Bening |
| 3,247,639 | A | 4/1966 | Dela |
| 3,288,427 | A | 11/1966 | Pluckebaum |
| 3,318,057 | A | 5/1967 | Norsworthy |
| 3,325,957 | A | 6/1967 | Demeules |
| 3,392,801 | A | 7/1968 | Gethmann |
| 3,420,012 | A | 1/1969 | Liskey, Jr. et al. |
| 3,462,110 | A | 8/1969 | Cheslock |
| 3,465,995 | A | 9/1969 | Whitman |
| 3,486,287 | A | 12/1969 | Guillon |
| 3,491,852 | A | 1/1970 | Leist |
| 3,493,208 | A | 2/1970 | Sato |
| 3,533,587 | A | 10/1970 | Smith |
| 3,533,857 | A | 10/1970 | Vecchiarelli |
| 3,550,723 | A | 12/1970 | Gentry et al. |
| 3,559,357 | A | 2/1971 | Lowe |
| 3,578,060 | A | 5/1971 | Spencer |
| 3,601,356 | A | 8/1971 | Yurick |
| 3,684,058 | A | 8/1972 | Brown |
| 3,696,578 | A | 10/1972 | Swensen et al. |
| 3,735,953 | A | 5/1973 | Dashew |
| 3,751,790 | A | 8/1973 | Fraizer |
| 3,776,498 | A | 12/1973 | Peters |
| 3,790,117 | A | 2/1974 | Winkler |
| 3,815,858 | A | 6/1974 | Mocny et al. |
| 3,822,850 | A | 7/1974 | Elias |
| 3,862,737 | A | 1/1975 | Fuston, Jr. |
| 3,876,046 | A | 4/1975 | Lerner |
| 3,885,648 | A | 5/1975 | Beziat |
| 3,890,750 | A | 6/1975 | Berman |
| 3,900,179 | A | 8/1975 | Mocny et al. |
| 3,900,182 | A | 8/1975 | Berman |
| 3,993,282 | A | 11/1976 | Berman |
| 4,003,543 | A | 1/1977 | Doubleday |
| 4,030,266 | A | 6/1977 | Cody |
| 4,030,694 | A | 6/1977 | Schimmel |
| 4,032,100 | A | 6/1977 | Kahn |
| 4,033,081 | A | 7/1977 | Perkins, Jr. |
| 4,036,466 | A | 7/1977 | Van Meter |
| 4,102,096 | A | 7/1978 | Cody |
| 4,106,256 | A | 8/1978 | Cody |
| 4,121,804 | A | 10/1978 | O'Leary |
| 4,123,031 | A | 10/1978 | Hyre |
| 4,133,433 | A | 1/1979 | Wolf |
| 4,158,452 | A | 6/1979 | Gates |
| 4,162,682 | A | 7/1979 | Miller et al. |
| 4,163,537 | A | 8/1979 | Mourgue |
| 4,188,017 | A | 2/1980 | Dingler |
| 4,194,338 | A | 3/1980 | Trafton |
| 4,202,145 | A | 5/1980 | Coulter et al. |
| 4,248,024 | A | 2/1981 | Dahlstrom |
| 4,261,144 | A | 4/1981 | Rizzo |
| 4,342,440 | A | 8/1982 | Eyden |
| 4,348,002 | A | 9/1982 | Eyden |
| 4,349,491 | A | 9/1982 | Eyden |
| 4,371,203 | A | 2/1983 | Munro |
| 4,372,425 | A | 2/1983 | Murphy |
| 4,458,461 | A | 7/1984 | Holley |
| 4,470,574 | A | 9/1984 | Jackson |
| 4,473,209 | A | 9/1984 | Gallis et al. |
| 4,481,748 | A | 11/1984 | D'Alessio |
| 4,493,172 | A | 1/1985 | Jones |
| 4,499,967 | A | 2/1985 | Anderson |
| 4,516,372 | A | 5/1985 | Grutsch |
| 4,529,163 | A | 7/1985 | Dingler |
| 4,558,544 | A | 12/1985 | Albrecht et al. |
| 4,582,001 | A | 4/1986 | Leikarts |
| 4,587,786 | A | 5/1986 | Woods |
| 4,619,433 | A | 10/1986 | Maier |
| 4,685,264 | A | 8/1987 | Landis |

(56) References Cited

U.S. PATENT DOCUMENTS 4,742,985 A 5/1988 Mathis
4,743,202 A 5/1988 Bach
4,761,847 A 8/1988 Savage et al.
4,776,557 A 10/1988 Turner
4,787,183 A 11/1988 Johnston
4,805,365 A 2/1989 Bastian
4,805,735 A 2/1989 Anderson
4,813,196 A 3/1989 Bokelund et al.
4,821,844 A 4/1989 Huffman et al.
4,826,113 A 5/1989 Winters
4,831,791 A 5/1989 Ball
4,880,195 A 11/1989 Lepley
4,881,716 A 11/1989 Dingler
4,919,268 A 4/1990 Young et al.
5,009,050 A 4/1991 Gruber
5,029,670 A 7/1991 Whitner
5,029,803 A 7/1991 Schworer
5,044,601 A 9/1991 Miller
5,048,781 A 9/1991 Breen
5,078,360 A 1/1992 Spera
5,104,079 A 4/1992 Hardtke
5,125,617 A 6/1992 Miller
5,127,342 A 7/1992 Taylor
5,146,816 A 9/1992 Badstieber
5,150,557 A 9/1992 Gregory
5,154,837 A 10/1992 Jones
5,174,909 A 12/1992 Ward
5,192,145 A 3/1993 Rixen et al.
5,219,473 A 6/1993 Sandwith
5,228,258 A 7/1993 Onoda et al.
5,240,089 A 8/1993 Spera
5,263,296 A 11/1993 Spera
5,265,836 A 11/1993 Dale
5,292,098 A 3/1994 Worthington
5,307,601 A 5/1994 Mccracken
5,367,852 A 11/1994 Masuda
5,379,566 A 1/1995 Schwörer
5,385,323 A 1/1995 Garelick
5,447,249 A 9/1995 Vickers
5,509,635 A 4/1996 Jaruzel
5,529,144 A 6/1996 Henderson
5,549,176 A 8/1996 Hawkins
5,560,730 A 10/1996 Gillard
5,570,500 A 11/1996 Merkel
5,575,938 A 11/1996 Ono
5,641,036 A 6/1997 Maxwell
5,655,336 A 8/1997 Azar
5,680,732 A 10/1997 Skouras
5,685,121 A 11/1997 DeFrancesco et al.
5,711,397 A 1/1998 Flora et al.
5,729,948 A 3/1998 Levy et al.
5,729,950 A 3/1998 Hardy
5,735,100 A 4/1998 Campbell
5,746,535 A 5/1998 Kohler
5,791,096 A 8/1998 Chen
5,863,020 A * 1/1999 Olson ..... E04G 21/3242 248/228.3
5,941,486 A 8/1999 Riblet
5,961,240 A 10/1999 Bobrovniczky
5,979,119 A 11/1999 Trafton
5,979,138 A 11/1999 Allen
6,003,631 A 12/1999 Knauth
6,059,258 A 5/2000 Jackson
6,092,623 A 7/2000 Collavino
6,106,186 A 8/2000 Taipale et al.
6,161,359 A 12/2000 Ono
6,173,809 B1 1/2001 Cole et al.
6,186,856 B1 2/2001 Chen
6,298,629 B1 10/2001 Ador
6,318,572 B1 11/2001 Lai
6,321,501 B1 11/2001 Ignash
6,363,685 B1 4/2002 Kugler
6,370,741 B1 4/2002 Lu
6,422,345 B1 7/2002 Schwörer
6,439,344 B1 8/2002 Cole
6,450,291 B1 9/2002 Ono
6,520,471 B2 2/2003 Jones et al.
6,554,235 B1 4/2003 Fortier
6,575,652 B2 6/2003 Krauss
6,591,574 B2 7/2003 Humphrey
6,688,430 B1 2/2004 Wallther
6,712,543 B1 3/2004 Schmalzhofer
6,722,468 B2 4/2004 Albano
6,751,914 B2 6/2004 Zeh et al.
6,752,570 B2 6/2004 Lanka
6,872,117 B1 3/2005 Chen
6,874,741 B2 4/2005 Mirsberger
6,886,662 B2 5/2005 Riley
6,913,422 B2 7/2005 Rogers
6,953,106 B2 10/2005 Weston et al.
6,962,234 B1 11/2005 Reeves
7,032,268 B2 4/2006 Jackson
7,096,641 B2 8/2006 Birnbaum et al.
7,120,664 B2 10/2006 Sawa et al.
7,165,361 B2 1/2007 Vanagan
7,178,765 B2 2/2007 Huang
7,249,624 B2 7/2007 Zeh et al.
7,275,731 B1 10/2007 Shinault
7,404,532 B1 7/2008 Baril
7,530,540 B2 5/2009 Long et al.
7,823,347 B1 11/2010 Blinn
7,918,059 B2 4/2011 Repasky
7,950,199 B2 5/2011 Newhouse et al.
8,061,672 B1 11/2011 Kaufman
8,083,192 B2 12/2011 Wells et al.
8,136,633 B2 3/2012 Rogers
8,181,742 B1 5/2012 Ranese
8,191,840 B2 6/2012 Jenestreet
8,302,356 B2 11/2012 Knight, III et al.
8,403,280 B2 3/2013 Halverson et al.
8,418,425 B1 4/2013 Santini
8,505,864 B1 8/2013 Taylor et al.
8,616,519 B2 12/2013 Bacon
8,635,820 B2 1/2014 Lafferty, III et al.
8,671,635 B2 3/2014 Jones
8,684,412 B2 4/2014 Steins
8,827,587 B2 9/2014 Didehvar
8,850,753 B2 10/2014 Tabibnia
8,869,477 B2 10/2014 Ha et al.
8,898,999 B1 12/2014 Kugler et al.
8,978,176 B1 3/2015 Oh
8,978,822 B2 3/2015 Kreller
9,015,950 B2 4/2015 Husebo
9,056,639 B2 6/2015 Bank
9,074,379 B2 7/2015 Ciuperca
9,153,860 B2 10/2015 Tserodze et al.
9,179,774 B2 11/2015 Kessell
9,206,632 B1 12/2015 Fields
9,232,783 B2 1/2016 Blackwell
9,249,565 B2 2/2016 Merrifield
9,388,561 B2 7/2016 Johnson et al.
9,422,711 B1 8/2016 Hendry
9,546,489 B2 1/2017 Rosati
9,556,624 B1 1/2017 Law
9,587,298 B2 3/2017 Lin et al.
9,637,937 B2 5/2017 Wallther
9,719,267 B2 8/2017 Rogers
9,951,528 B2 4/2018 Kugler et al.
10,018,208 B2 7/2018 Hollis et al.
10,106,991 B2 10/2018 Dombrowski et al.
10,125,505 B2 11/2018 So
10,266,993 B2 4/2019 Szekely
10,415,311 B2 9/2019 Parker
10,422,140 B2 9/2019 Mitchell
10,415,262 B2 11/2019 Chevis
10,465,339 B2 11/2019 Chevis
10,465,399 B2 11/2019 Chevis
10,472,823 B2 11/2019 Chevis
10,570,632 B1 2/2020 Hartman
10,640,968 B2 5/2020 Tefenhart, Jr.
10,641,302 B1 5/2020 Huffman et al.
10,797,372 B2 10/2020 Hemmervall
10,844,613 B2 11/2020 Repasky et al.
10,995,504 B1 5/2021 Cook

(56) References Cited

U.S. PATENT DOCUMENTS

| | | | |
|---|---|---|---|
| 11,199,011 | B2 | 12/2021 | Kreller |
| 11,203,470 | B2 | 12/2021 | Ezra et al. |
| 11,530,541 | B1 | 12/2022 | Switzer |
| 2002/0003061 | A1 | 1/2002 | Philippe |
| 2002/0036118 | A1 | 3/2002 | Ono |
| 2002/0084141 | A1 | 7/2002 | Thomas |
| 2002/0092961 | A1 | 7/2002 | Gallis |
| 2002/0185335 | A1 | 12/2002 | Verdyk |
| 2003/0194265 | A1 | 10/2003 | Krauss |
| 2003/0213152 | A1 | 11/2003 | Kim |
| 2004/0035064 | A1 | 2/2004 | Kugler et al. |
| 2004/0055249 | A1 | 3/2004 | Kennedy |
| 2004/0118065 | A1 | 6/2004 | Jackson et al. |
| 2004/0200172 | A1 | 10/2004 | Beck et al. |
| 2004/0231922 | A1 | 11/2004 | Schwoerer |
| 2004/0237437 | A1 | 12/2004 | Hur |
| 2005/0045785 | A1 | 3/2005 | Cohen |
| 2005/0166483 | A1 | 8/2005 | Mead |
| 2005/0217040 | A1 | 10/2005 | Jackson |
| 2006/0011802 | A1 | 1/2006 | Di Cesare |
| 2006/0027729 | A1 | 2/2006 | Mccracken |
| 2006/0042179 | A1 | 3/2006 | Vanagan |
| 2006/0175130 | A1 | 8/2006 | Riley |
| 2006/0191236 | A1 | 8/2006 | Surowiecki |
| 2006/0207215 | A1 | 9/2006 | Bruno |
| 2006/0239769 | A1 | 10/2006 | Schworer |
| 2006/0272889 | A1 | 12/2006 | Paquette |
| 2007/0021048 | A1 | 1/2007 | Henning |
| 2007/0045048 | A1 | 3/2007 | Wyse |
| 2007/0056799 | A1 | 3/2007 | Leidner |
| 2007/0074480 | A1 | 4/2007 | Kleila |
| 2008/0017783 | A1 | 1/2008 | Vanagan |
| 2008/0105172 | A1 | 5/2008 | Repasky |
| 2008/0141601 | A1 | 6/2008 | Mead |
| 2008/0178641 | A1 | 7/2008 | Himmen |
| 2008/0210725 | A1 | 9/2008 | Birtwisle et al. |
| 2008/0244006 | A1 | 10/2008 | Weisner et al. |
| 2008/0244996 | A1 | 10/2008 | Gillespie et al. |
| 2009/0056258 | A1 | 3/2009 | Currier |
| 2009/0188189 | A1 | 8/2009 | Repasky |
| 2009/0211195 | A1 | 8/2009 | Schwerer |
| 2009/0212195 | A1 | 8/2009 | Arocena Bergareche et al. |
| 2009/0230283 | A1 | 9/2009 | Brewka et al. |
| 2009/0301815 | A1 | 12/2009 | Rogers |
| 2010/0000822 | A1 | 1/2010 | Wall |
| 2010/0005735 | A1 | 1/2010 | Gillespie et al. |
| 2010/0024176 | A1 | 2/2010 | Ubinana |
| 2010/0025563 | A1 | 2/2010 | Seng |
| 2010/0071141 | A1 | 3/2010 | Reiner |
| 2010/0122872 | A1 | 5/2010 | Korevaar |
| 2010/0218452 | A1 | 9/2010 | Wolf |
| 2010/0224447 | A1 | 9/2010 | Rogers |
| 2011/0011018 | A1 | 1/2011 | Johnson et al. |
| 2011/0101587 | A1 | 5/2011 | Quintania et al. |
| 2011/0138723 | A1 | 6/2011 | Repasky |
| 2012/0025058 | A1 | 2/2012 | Floreani et al. |
| 2012/0076605 | A1 | 3/2012 | Crane |
| 2012/0112376 | A1 | 5/2012 | Khoo |
| 2012/0117913 | A1 | 5/2012 | Melic |
| 2013/0015185 | A1 | 1/2013 | Leal et al. |
| 2013/0036688 | A1 | 2/2013 | Gosain |
| 2013/0043095 | A1 | 2/2013 | Thacker |
| 2013/0161462 | A1 | 6/2013 | Haddock |
| 2013/0221175 | A1 | 8/2013 | McGee |
| 2013/0228394 | A1 | 9/2013 | Sousa et al. |
| 2013/0312357 | A1 | 11/2013 | Lin |
| 2013/0333191 | A1 | 12/2013 | Wallther |
| 2014/0020982 | A1 | 1/2014 | Hayman et al. |
| 2014/0021424 | A1 | 1/2014 | Ramskov |
| 2014/0086669 | A1 | 3/2014 | Rogers |
| 2014/0228060 | A1 | 8/2014 | Abhyanker |
| 2014/0250821 | A1 | 9/2014 | Strickland et al. |
| 2014/0339019 | A1 | 11/2014 | Hulett et al. |
| 2014/0361144 | A1 | 12/2014 | Mcgahan |
| 2015/0033661 | A1 | 2/2015 | Chase |
| 2015/0157885 | A1 | 6/2015 | Liu |
| 2015/0211242 | A1 | 7/2015 | Rosati |
| 2015/0337548 | A1 | 11/2015 | Ciuperca |
| 2016/0002936 | A1 | 1/2016 | Cox |
| 2016/0102462 | A1 | 4/2016 | Griffiths et al. |
| 2016/0199750 | A1 | 7/2016 | Yamagishi |
| 2016/0244984 | A1 | 8/2016 | Hollmann |
| 2016/0281376 | A1 | 9/2016 | Ward |
| 2016/0305459 | A1 | 10/2016 | Park et al. |
| 2017/0037631 | A1 | 2/2017 | McManus et al. |
| 2017/0254099 | A1 | 9/2017 | Grumberg et al. |
| 2017/0260758 | A1 | 9/2017 | Siltala et al. |
| 2017/0292280 | A1 | 10/2017 | White |
| 2017/0321413 | A1 | 11/2017 | Pridham |
| 2017/0350141 | A1 | 12/2017 | Kugler et al. |
| 2017/0370099 | A1 | 12/2017 | Chevis |
| 2018/0099233 | A1 | 4/2018 | Peiler |
| 2018/0112423 | A1 | 4/2018 | Hartman |
| 2018/0119435 | A1 | 5/2018 | Jablonski |
| 2018/0187428 | A1 | 7/2018 | Maher |
| 2019/0010717 | A1 | 1/2019 | Baron |
| 2019/0127996 | A1 | 5/2019 | Chevis |
| 2019/0321664 | A1 | 10/2019 | Hsu |
| 2020/0011074 | A1 | 1/2020 | Chevis |
| 2021/0108427 | A1 | 4/2021 | Bacon |
| 2021/0156157 | A1 | 5/2021 | Ubinana |
| 2021/0180344 | A1 | 6/2021 | McCracken |
| 2021/0246673 | A1 | 8/2021 | Haeberle |
| 2022/0010568 | A1 | 1/2022 | Mikic et al. |

FOREIGN PATENT DOCUMENTS

| | | | | |
|---|---|---|---|---|
| CH | 506685 | A | 4/1971 | |
| CN | 1188175 | A | 7/1998 | |
| CN | 201835529 | U | 5/2011 | |
| CN | 103899083 | A | 7/2014 | |
| CN | 203878831 | U | 10/2014 | |
| CN | 204386134 | U | 6/2015 | |
| CN | 107100358 | A | 8/2017 | |
| CN | 207686282 | U | 8/2018 | |
| CN | 110700585 | A | 1/2020 | |
| CN | 210086830 | U | 2/2020 | |
| DE | 9305194 | U1 | 8/1993 | |
| DE | 9309950 | U1 | 9/1993 | |
| DE | 4328105 | C1 | 9/1994 | |
| DE | 19807860 | A1 | 9/1999 | |
| DE | 29912555 | U1 | 10/1999 | |
| DE | 2006912 | U1 | 6/2000 | |
| DE | 10121957 | A1 | 11/2002 | |
| DE | 102008026989 | U1 | 3/2009 | |
| DE | 202009010716 | U1 | 11/2009 | |
| DE | 202010002426 | U1 | 5/2010 | |
| EP | 0062420 | A1 | 10/1982 | |
| EP | 0369108 | A2 | 5/1990 | |
| EP | 0375969 | A1 | 7/1990 | |
| EP | 0408209 | A2 | 1/1991 | |
| EP | 0729536 | A1 | 9/1996 | |
| EP | 0678637 | B1 | 7/1998 | |
| EP | 1498571 | A1 | 1/2005 | |
| EP | 1559851 | A2 | 3/2005 | |
| EP | 1544379 | A2 | 6/2005 | |
| EP | 2141307 | A2 | 1/2010 | |
| EP | 2462296 | A1 | 6/2012 | |
| EP | 2937056 | A1 | 10/2015 | |
| EP | 2982813 | A1 | 2/2016 | |
| EP | 3073028 | A1 | 9/2016 | |
| ES | 2245264 | A1 | 3/2007 | |
| FR | 926917 | A | 10/1947 | |
| FR | 1165329 | A | 10/1958 | |
| FR | 2527254 | A1 | 11/1983 | |
| FR | 2593843 | A1 | 8/1987 | |
| GB | 838828 | A * | 6/1960 | ..... F16B 2/12 |
| GB | 877463 | A | 9/1961 | |
| GB | 1465950 | A | 3/1977 | |
| GB | 2133826 | A | 8/1984 | |
| GB | 2145761 | A | 4/1985 | |
| GB | 2215374 | A | 9/1989 | |
| GB | 2398848 | A | 9/2004 | |
| GB | 2592433 | A | 9/2021 | |

(56) References Cited

FOREIGN PATENT DOCUMENTS

| | | | |
|---|---|---|---|
| JP | H 07-279411 | A | 10/1995 |
| JP | H 10-46806 | A | 2/1998 |
| JP | 2002256700 | A | 9/2002 |
| JP | 2004156416 | A | 6/2004 |
| JP | 2009127315 | A | 6/2009 |
| JP | 2016532026 | A | 10/2016 |
| KR | 920008222 | Y1 | 11/1992 |
| KR | 0134600 | Y1 | 2/1999 |
| KR | 20030095163 | A | 12/2003 |
| KR | 200372312 | Y1 | 1/2005 |
| KR | 200381397 | Y1 | 4/2005 |
| KR | 200410996 | Y1 | 3/2006 |
| KR | 20060078341 | A | 7/2006 |
| KR | 10-0682310 | B1 | 2/2007 |
| KR | 20110077096 | A | 7/2011 |
| KR | 101194682 | B1 | 10/2012 |
| KR | 20-0463949 | Y1 | 12/2012 |
| KR | 200469990 | Y1 | 11/2013 |
| KR | 101335478 | B1 | 12/2013 |
| KR | 20150116373 | A | 10/2015 |
| KR | 20170128688 | A | 11/2017 |
| KR | 20190088168 | A | 7/2019 |
| KR | 20190115612 | A | 10/2019 |
| KR | 102166828 | B1 | 10/2020 |
| KR | 102180857 | B1 | 11/2020 |
| KR | 20210043807 | A | 4/2021 |
| WO | 9109191 | A1 | 6/1991 |
| WO | 1998007935 | A1 | 2/1998 |
| WO | 2002003116 | A1 | 8/2002 |
| WO | 2006135223 | A1 | 12/2006 |
| WO | 2007043897 | A2 | 4/2007 |
| WO | 2010054836 | A2 | 5/2010 |
| WO | 2012096639 | A1 | 7/2012 |
| WO | 2017223504 | A1 | 12/2017 |
| WO | 2018143534 | A1 | 8/2018 |

OTHER PUBLICATIONS

PCT International Search Report and Written Opinion; PCT/US2018/066256; Apr. 11, 2019.

PCT International Search Report and Written Opinion; PCT/US2017/039097; Jun. 23, 2017.

* cited by examiner

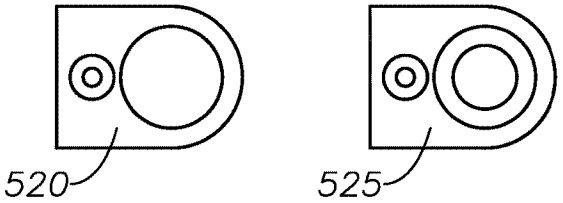
FIG. 5C
FIG. 5B
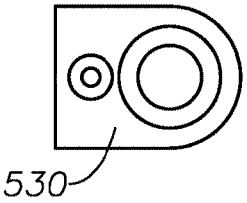
FIG. 5D
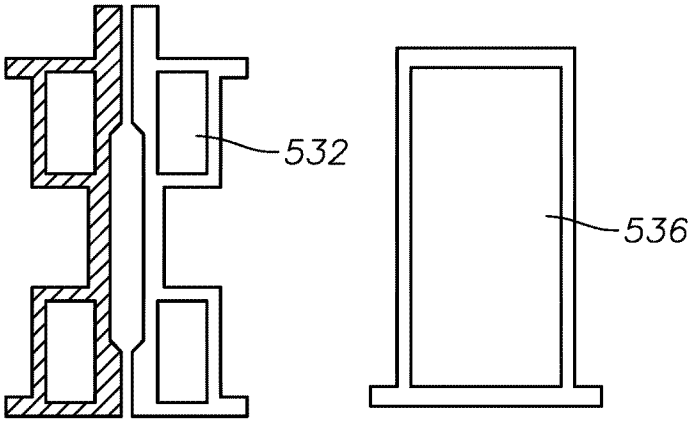
FIG. 6A
FIG. 6B
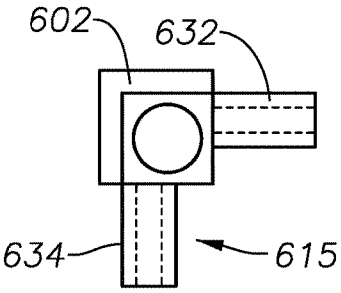
FIG. 6C
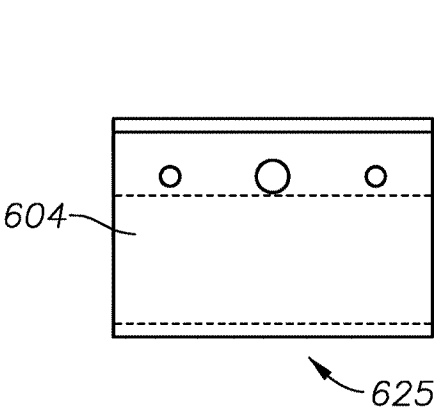
FIG. 6F
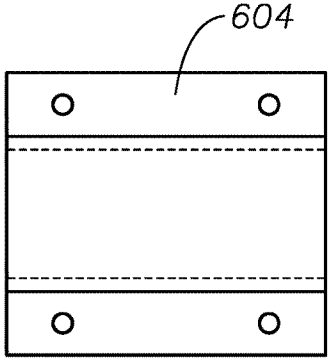
FIG. 6G
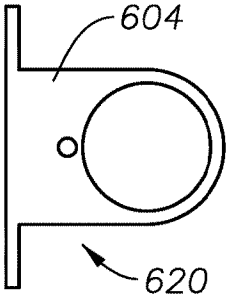
FIG. 6E
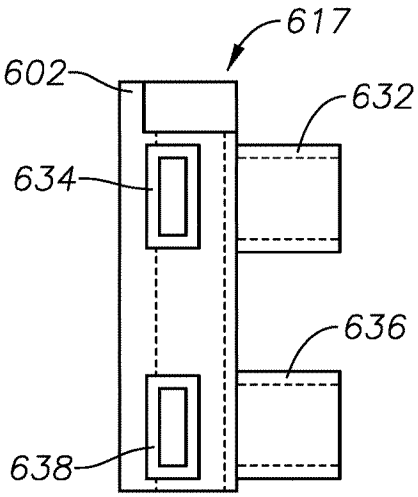
FIG. 6D

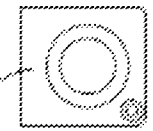
FIG. 33B
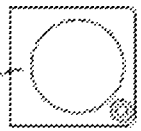
FIG. 33C
FIG. 33D
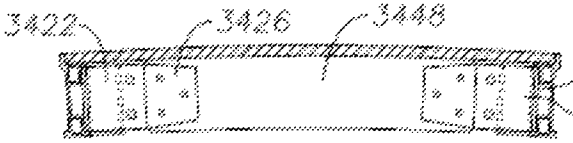
FIG. 34A
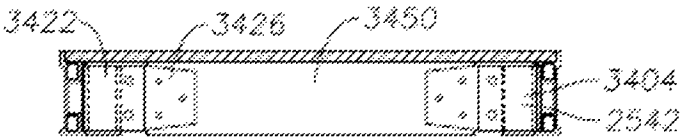
FIG. 34B
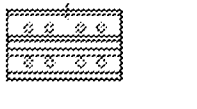
FIG. 34C
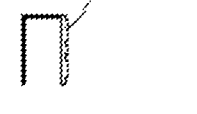
FIG. 34D
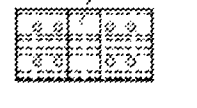
FIG. 34E
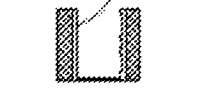
FIG. 34F
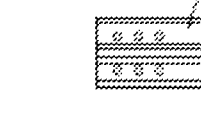
FIG. 34G
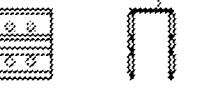
FIG. 34H
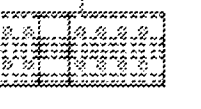
FIG. 34I
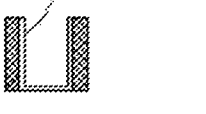
FIG. 34J
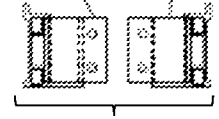
FIG. 34K
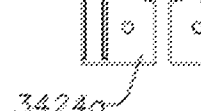
FIG. 34L
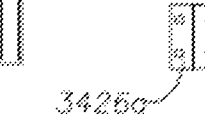
FIG. 34M
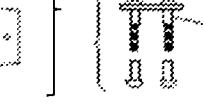
FIG. 34N

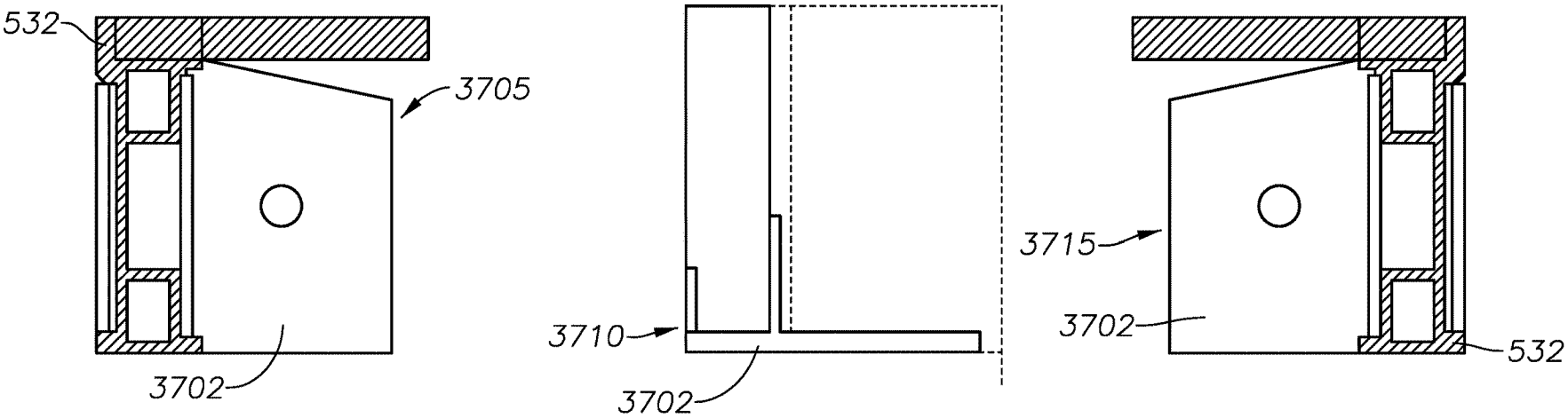
FIG. 37C
FIG. 37B
FIG. 37A
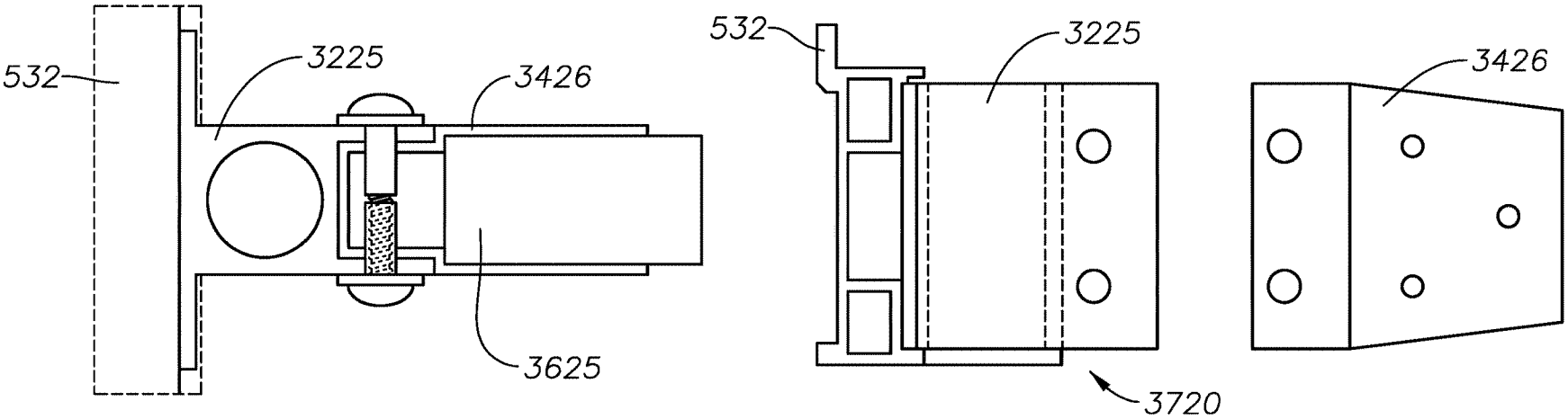
FIG. 37F
FIG. 37E
FIG. 37D

CLAMP ASSEMBLY FOR A FORMWORK SYSTEM

CROSS-REFERENCE TO RELATED APPLICATIONS

This application is a continuation application of U.S. patent application Ser. No. 16/680,368, filed Nov. 11, 2019, which is a continuation application of U.S. patent application Ser. No. 15/630,923, filed Jun. 22, 2017, now U.S. patent Ser. No. 10/472,823, issued on Nov. 12, 2019, which claims the benefit of and priority to U.S. Patent Application Ser. No. 62/471,173, filed Mar. 14, 2017 and 62/354,325, filed Jun. 24, 2016, the disclosures of which are herein incorporated by reference in their entirety.

BACKGROUND

This section is intended to provide background information to facilitate a better understanding of various technologies described herein. As the section's title implies, this is a discussion of related art. That such art is related in no way implies that it is prior art. The related art may or may not be prior art. It should therefore be understood that the statements in this section are to be read in this light, and not as admissions of prior art.

Formwork systems have been used as a tool to help builders construct concrete structures. Many different pre-engineered modern formwork systems have been developed to mold liquid concrete into building systems. These systems have continued to develop in the last several decades to become more efficient, allowing contractors to help reduce overall construction costs, and to reduce schedule completion times.

There are many companies in existence today that have developed specific formwork systems and carry a sizable inventory, which can be both rented and sold to contractors who build concrete structures. The applications of formwork are unlimited given the wide range of project types in both the industrial and commercial construction markets. From high rise buildings to the construction of an industrial facility, formwork is used to help contractors cast foundations, columns, walls, and elevated slabs in an enormous variety of shapes and uses. Chances are that all of the places people live and work have some form of poured concrete that was cast using a formwork system. There is a substantial market for formwork in the construction industry worldwide.

Prior to the 1980's, older generation systems required providers to have a large inventory of parts available to fit any configuration. They consisted of endless amounts of form panels, filler sizes, small bolts, pins, and other connecting hardware, that are used for assembly by a building contractor. The amount of inventoried items was high and the assembly efficiency for contractors was low. Because of the amount of pieces, it was common for many of these items to be lost during the construction process. Starting in the late 1980's, newer modular formwork system designs developed by international companies started hitting the worldwide market, and were subsequently introduced into the U.S.

These modular systems were being produced primarily out of Europe, required many less inventory items, eliminated small bolts and pins, and maintained a high degree of versatility. European systems began to migrate over to the Americas, and started to dominate the market, making the older systems in the U.S. virtually obsolete. Today, we see more and more of these systems hitting the ground in the U.S., but they were designed and built to service an international market, primarily outside the Americas. There is virtually no modern system in use today that is built for specific use in the U.S. These systems are generally manufactured in metric building units, which require additional components to convert to the U.S. Imperial unit of measure. In addition, they require a distinctly different inventory to build both straight and curved wall construction.

SUMMARY

Described herein are various implementations of a formwork system. In one implementation, the formwork system includes aluminum extrusions and aluminum castings. The aluminum castings and the aluminum extrusions can be assembled by being pressed and riveted together.

In one implementation, the aluminum extrusions can be side rail extrusions. In one implementation, the aluminum extrusions can be interior rail extrusions. The aluminum extrusions and the aluminum castings can be made of structural grade aluminum.

In one implementation, the aluminum extrusions and aluminum castings may be integrated into a shoring deck application.

Described herein are various implementations for a formwork system. In one implementation, the formwork system includes a first formwork panel having a first standard panel width. The formwork system also includes a second formwork panel having a second standard panel width different from the first panel width. The formwork system further includes an adjustable filler assembly.

In one implementation, the adjustable filler assembly includes two filler side rails and at least one adjustable inner rail. In another implementation, the adjustable filler assembly includes two filler side rails and radius cut lumber. In another implementation, the adjustable filler assembly includes two filler side rails and straight lumber.

Described herein are various implementations for an aluminum formwork system. The aluminum formwork system includes a clamp having: a first member having a first opening configured to accommodate a first flange; a second member having a second opening configured to accommodate a second flange; and a connector clip attached to the clamp and configured to be coupled to one or more attachments for the aluminum formwork system.

In one implementation, an accessory clip is attached to the connector clip. The accessory clip can be coupled to the one or more attachments.

The one or more attachments may include, but are not limited to, a pipe brace clip, an alignment bar, a lifting bar, and/or a tie-off point.

In one implementation, the first flange and the second flange are part of an inner rail. In another implementation, the first flange is part of a first side rail and the second flange is part of a second side rail. The first side rail and the second side rail may be connected by tightening the clamp.

The clamp can be a standard clamp that couples formwork panels and couples attachments to the formwork panels.

In one implementation, the formwork system includes a plurality of standard formwork panels. Each of the plurality of standard formwork panels has a respective height. The plurality of standard formwork panels has tie holes. The tie holes are configured to be symmetrical for all of the respective heights of the plurality of formwork panels.

In one implementation, the standard formwork panels are constructed of lightweight aluminum extrusions and fittings that are assembled with mechanical fasteners and have no welding.

In one implementation, various adjustable filler components are used to create on-demand filler panels sizes in a wide range of odd dimensional configurations, to meet dimensional requirements. This eliminates the need to carry an inventory of various pre-set sizes of filler panels and small shims.

In one implementation, a windmill overlap outside corner bracket is used to form outside corners of walls or columns.

In one implementation, standard form panels have the optional ability to increase the base design capacity by inserting a high pressure strut in critical locations where design pressures are higher than standard limits.

In one implementation, the formwork system includes aluminum extruded hinged corner extrusions having a first side and a second side. A first formwork panel is coupled to the first side of the hinged corner extrusion. A second formwork panel is coupled to the second side of the hinged corner extrusion. The hinged corner extrusion is configurable to position the first formwork panel and the second formwork panel at a plurality of angles. In one implementation, the aluminum extruded hinged corner extrusion comprises a hinged inside corner extrusion. In one implementation, the hinged corner extrusion comprises a hinged outside corner extrusion.

In one implementation, tie inserts are used with a formwork panel. Tie inserts may include self-sealing ties, tie plugs and tie inserts that install from the outside (or backside) of ganged form panel assemblies. This increases labor efficiency and reduces risk of concrete leakage through the tie port assembly.

In one implementation, Ringlok scaffolding is standardized as the access component of the formwork system. In one implementation, the same components also function as a moveable personal tie-off point accessory.

In one implementation, a dual purpose bracket can be used to both operate as a dry tie bracket and a hold down bracket. As a hold down bracket, the bracket is used to tie forms down to a base slab from vertical uplift loads. As a dry tie bracket, the bracket is used to place a dry tie over the top of the form.

In one implementation, standard clamps are used to connect one form panel to all adjacent panels, fillers or corners. The standard clamp also serves as the attachment point for all other accessories to the form panel, with the addition of the standard accessory clip vs. attaching accessories directly to the panels with various adaptor fixtures.

Described herein are various implementations of a method of assembling a formwork system. Aluminum extrusions are provided. Aluminum castings are provided. The aluminum castings and aluminum extrusions are pressed and riveted.

The aluminum extrusions can be side rail extrusions and/or interior rail extrusions. The aluminum extrusions and the aluminum castings can be made of structural grade aluminum.

In one implementation, the formwork system can be configured such that the aluminum extrusions and aluminum castings are integrated into a shoring deck application.

In one implementation, the aluminum extrusions are adjustable and a width of the aluminum extrusions can be incrementally adjusted using different configurations.

The aluminum extrusions can be assembled to be part of a series or system of formwork panels that are coupled together using a standard clamp. The formwork panels are constructed of lightweight aluminum extrusions and fittings and are assembled with mechanical fasteners and have no welding. The standard clamp may also be used to couple attachments to the formwork panels. In one implementation, a connector clip can be attached to the standard clamp and configured to be coupled to one or more attachments for the formwork system. In one implementation, an accessory clip can be attached to the connector clip. The accessory clip can be coupled to the one or more attachments. The attachments may include, but are not limited to, a pipe brace clip, an alignment bar, a lifting bar, a tie-off point.

In one implementation, formwork panels can be coupled via an aluminum extruded hinged corner extrusion and configured to be positioned relative to each other at a plurality of angles.

In one implementation, the aluminum extruded hinged corner extrusion can be a hinged inside corner extrusion. In one implementation, the hinged corner extrusion can be a hinged outside corner extrusion.

In one implementation, tie inserts are used with a formwork panel. Tie inserts may include self-sealing ties, tie plugs and tie inserts that install from the outside (or backside) of ganged form panel assemblies. This increases labor efficiency and reduces risk of concrete leakage through the tie port assembly. A tie nut and rod assembly can be used to couple a formwork panel to an opposing formwork panel.

The above referenced summary section is provided to introduce a selection of concepts in a simplified form that are further described below in the detailed description section. Additional concepts and various other implementations are also described in the detailed description. The summary is not intended to identify key features or essential features of the claimed subject matter, nor is it intended to be used to limit the scope of the claimed subject matter, nor is it intended to limit the number of inventions described herein. Furthermore, the claimed subject matter is not limited to implementations that solve any or all disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate only the various implementations described herein and are not meant to limit the scope of various techniques described herein.

FIGS. 5A-5D illustrate how a side rail, an interior rail and a tie extrusion fit together in the formwork system in accordance with implementations of various techniques described herein.

FIGS. 6A-6G illustrate views of a side rail extrusion in accordance with implementations of various techniques described herein.

FIGS. 33A-33D illustrate how a side rail, an interior rail and a tie extrusion fit together in the formwork system in accordance with implementations of various techniques described herein.

FIGS. 37A-37F illustrate lumber filler fittings and details in accordance with implementations of various techniques described herein.

DETAILED DESCRIPTION

The formwork system of the present disclosure has been designed to rectify many of the short comings of imported European formwork systems, provides a further reduction in the amount of components needed, and provides a high degree of versatility. In one implementation, the formwork system may be built from non-welded lightweight aluminum components. The present formwork system may also have implementations that include a synthetic form face. Most prior art systems are made from welded rolled steel, and use a wood form face that has to be replaced periodically. The unique design and manufacture of the new formwork system of the present disclosure vastly elevates the inventory service life, improves aspects of inventory maintenance, and offers a significant reduction in the amount of different components needed to achieve an enormous variety of usable configurations. Various unique features of the present formwork system are described in more detail below.

The present formwork system design includes several key unique features that are not found in similar systems currently available in the market. The improvement provided by this new formwork system, which may be composed of non-welded aluminum components, is that this formwork system has significantly less components in its usable inventory, as compared to prior art formwork systems. The present formwork system also has a unique approach to the type of materials used in its construction, as well as the method of assembly and manufacture. The present formwork system may also be configured to be used in shoring deck applications. The combination of minimizing required components and the unique method of manufacture is what separates the present formwork system from prior art formwork systems currently being offered to the construction industry.

The present formwork system reduces the amount of inventoried components by over 75%, as compared to existing systems. The main driver to eliminate many infrequently used items is the use of the fabricated Filler Side Rail in various applications. In combination with the robust nature of the materials of the present formwork system and the method of assembly, the cost to own the present formwork system can vastly be reduced for both a dead asset basis, as well as the physical maintenance cost required to maintain a formwork inventory. In addition, the present formwork system elevates the flexibility to handle field applications, as well as increase the efficiency for the contractors that will use the present formwork system to build concrete structures.

Figures 1A, 1B, 1C, 1D, 1E, 1F, 1G, 1H, 1I, 1J, 1K:
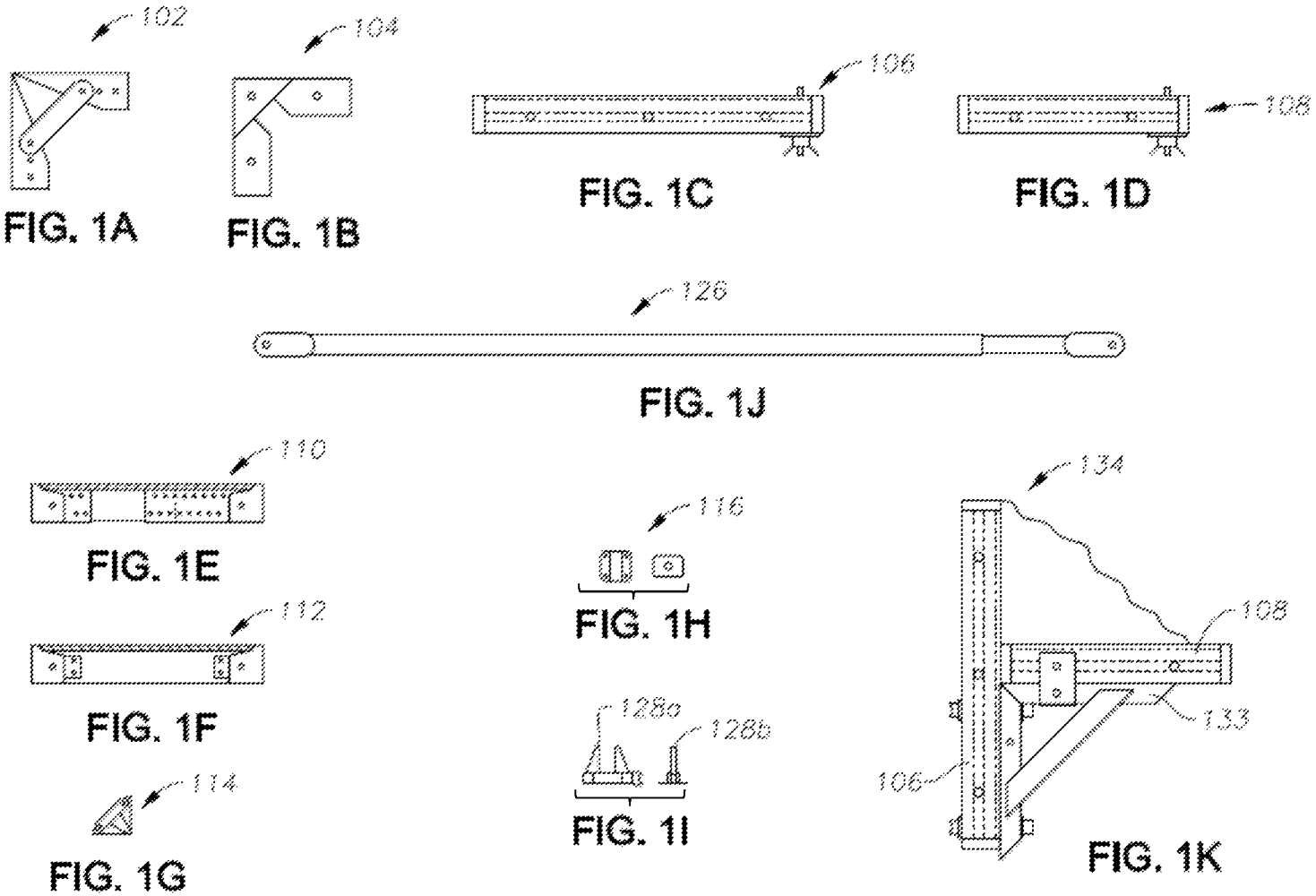
FIGS. 1A-1T illustrate various formwork system component drawings in accordance with implementations of various techniques described herein.
Figure 1Q:
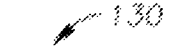
Figure 1R:
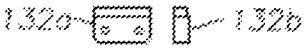
Figure 1S:
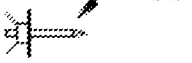
Figure 1T:
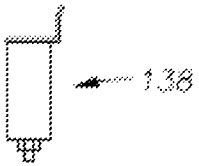

FIGS. 1A-1T include various formwork system component drawings. FIGS. 1A-1T include plan views of the formwork at various widths (adjustable 110, lumber 112, standard 2' panel 108, standard 3' panel 106). FIGS. 1A-1T also include views of clamps, brackets, clips, adapters, supports, assemblies and braces used with the formwork system. Additionally, FIGS. 1A-1T show an implementation that couples the present formwork system with a standard scaffold.

FIG. 1A-1B include corner brackets 102, 104, 114. Element 102 is an inside hinged corner. Element 104 is a hinged stripping corner and element 114 is a hinged outside corner bracket. The hinged and stripping corner brackets may be aluminum components.

As illustrated in FIG. 1I, which depicts a standard clamp 128*a* and a side 128*b* of the standard clamp, is the primary method of attaching all accessories to the standard form panels. Standard clamp 128*a* may also be used to tie formwork panels having different heights and as a lifting device for a series of ganged formwork panels.

As illustrated in FIG. 1K, element 126 is a standard pipe brace with a clip assembly. Pipe brace 126 can be used to provide support for scaffolding.

Figure 1P:
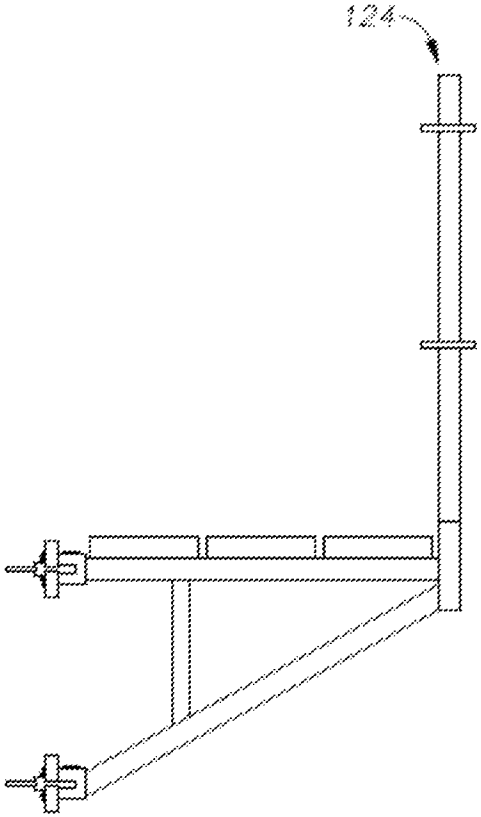
Figure 1M:
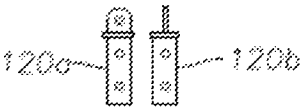
Figure 1O:
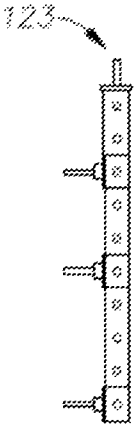
Figure 1L:
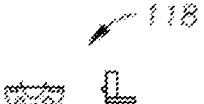
Figure 1N:
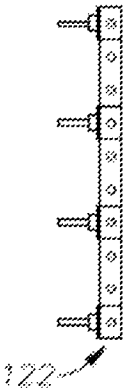
Figure 2A:
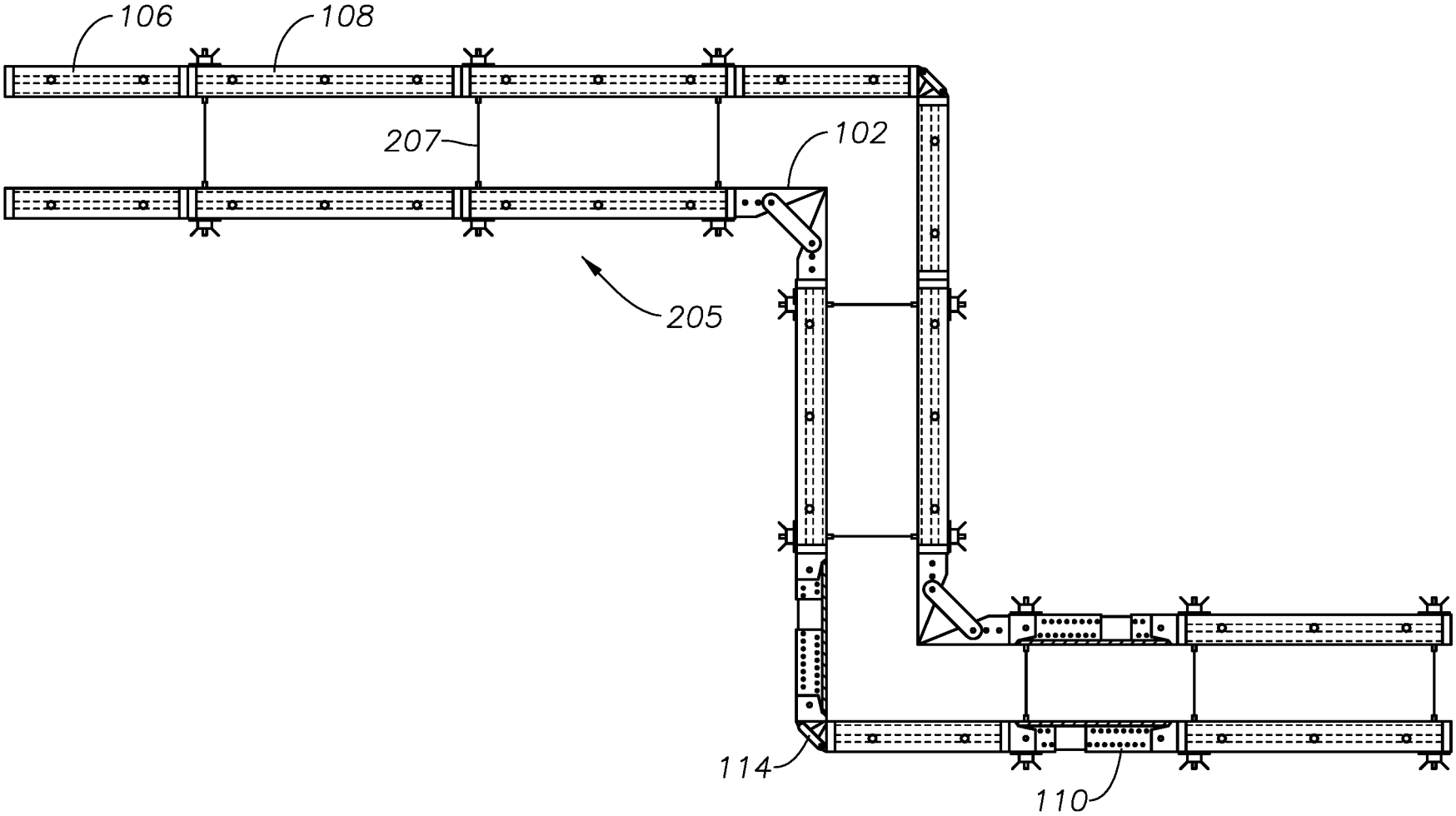
FIGS. 2A-2D illustrate a top view of wall and corner plan details of the present formwork system in accordance with implementations of various techniques described herein.
Figure 2C:
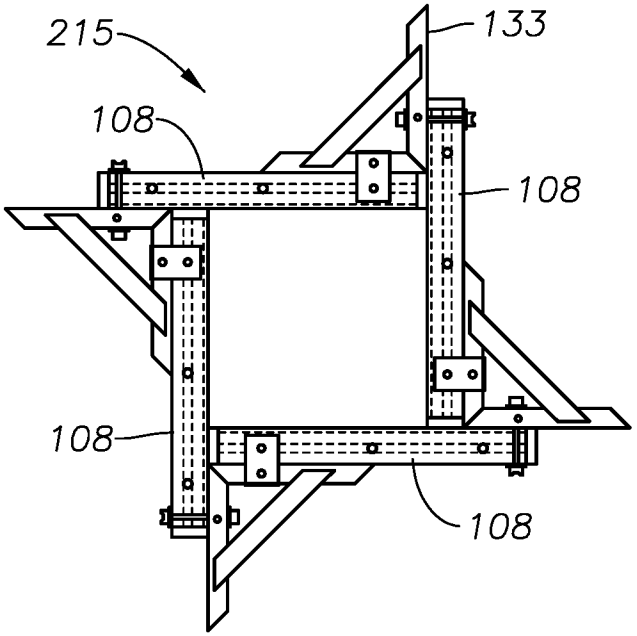
Figure 2B:
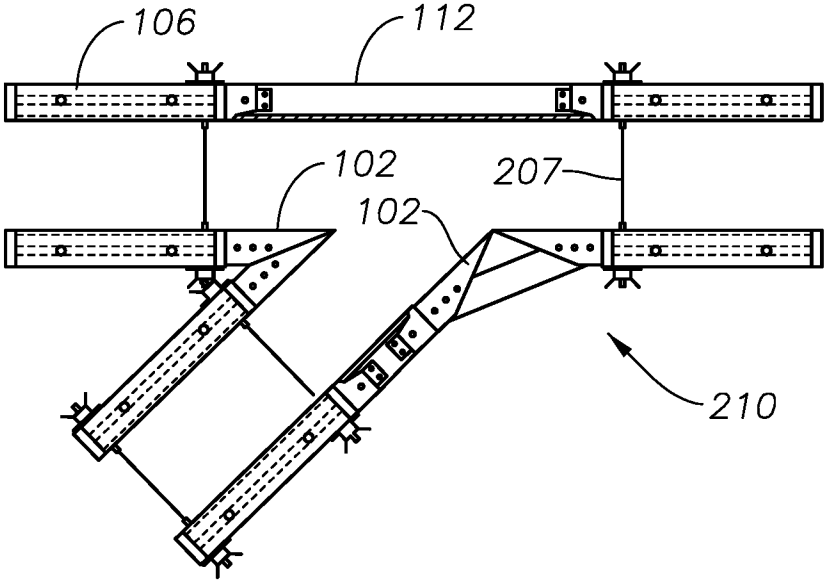
Figure 2D:
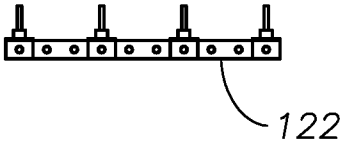

As illustrated in FIG. 1P, standard pin lock scaffolding adaptor is shown at element 124. Scaffold bracket adaptor 118 is used in this configuration.

As illustrated in FIG. 1H, accessory clip 116 attaches to the standard clamp and serves as a standard connection for the alignment bar configuration (using alignment bar 122), pipe brace attachment (using pipe brace 126), and lifting bar configuration (using gang lifting configuration 123 and lifting bracket 120).

A dry tie or hold down bracket 130 and an alignment center support 132 are included in FIG. 1R, which also illustrates a side 132*b* of alignment center support 132*a*. Also included in FIG. 1S is the tie nut and rod assembly 136.

An outside corner bracket configuration 134 is also shown in FIG. 1K. This outside corner bracket 133 is used to attach to formwork panels, e.g., formwork panels 106, 108 in a corner configuration.

FIGS. 2A-2D show a top view of wall and corner plan details of the present formwork system. Also shown is an alignment bar 122 configuration that can be used to provide additional support for the panels. Item 205 shows a wall detail at an inside corner using standard panels 106, 108 and adjustable filler 110. In addition, tie rod assemblies 207, standard clamps (not shown) and corner brackets 102, 114 are included. Item 210 shows wall details for an implementation of a variable angle inside corner using corner bracket 102. The implementation of item 210 uses lumber filler 112 and formwork panel 106; however, other implementations may include adjustable filler, lumber filler and/or other standard panels. Item 215 shows details for a windmill column using standard panels, e.g., formwork panel 108, and a hinged outside corner bracket 133.

Figure 3A:
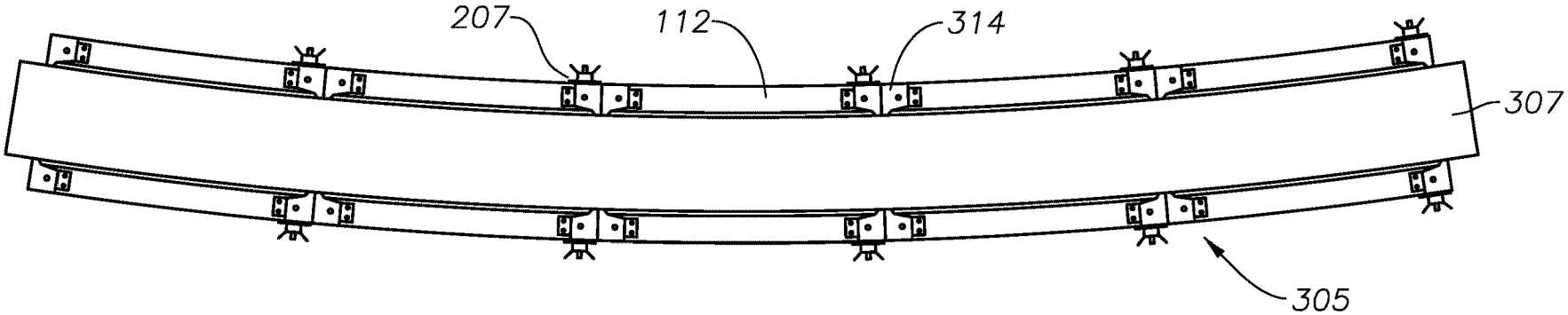
FIGS. 3A-3C illustrate various wall plans in accordance with implementations of various techniques described herein.
Figure 3C:
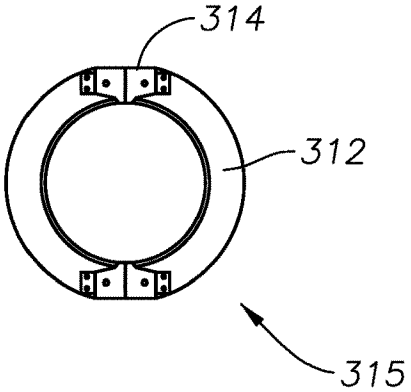
Figure 3B:
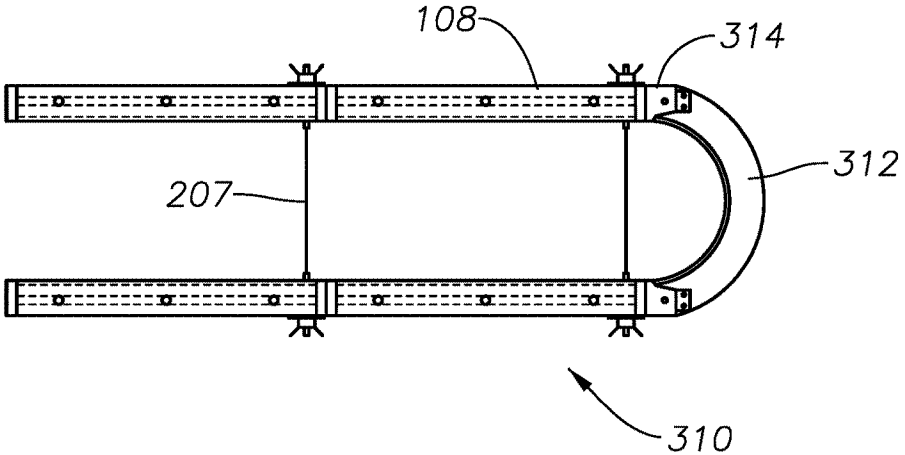

FIGS. 3A-3C show various wall plans that provide arc and circular configurations. Item 305 is illustrated in FIG. 3A as an implementation that provides a large diameter tank or serpentine walls 307 provided using lumber inner rails (not shown), lumber clips 309, filler side rails 112, tie rod assemblies 207 and standard clamps (not shown). Item 310 is shown in FIG. 3B as standard panels with an arc shaped or rounded nose that is provided using standard panels 108, filler side rails (not shown), lumber inner rails 312, lumber clips 314 and tie rod assemblies 207, and standard clamps (not shown). Item 315 is shown in FIG. 3B as a circular column provided using filler side rails (not shown), lumber inner rails 312, lumber clips 314 and standard clamps (not shown).

Figure 4B:
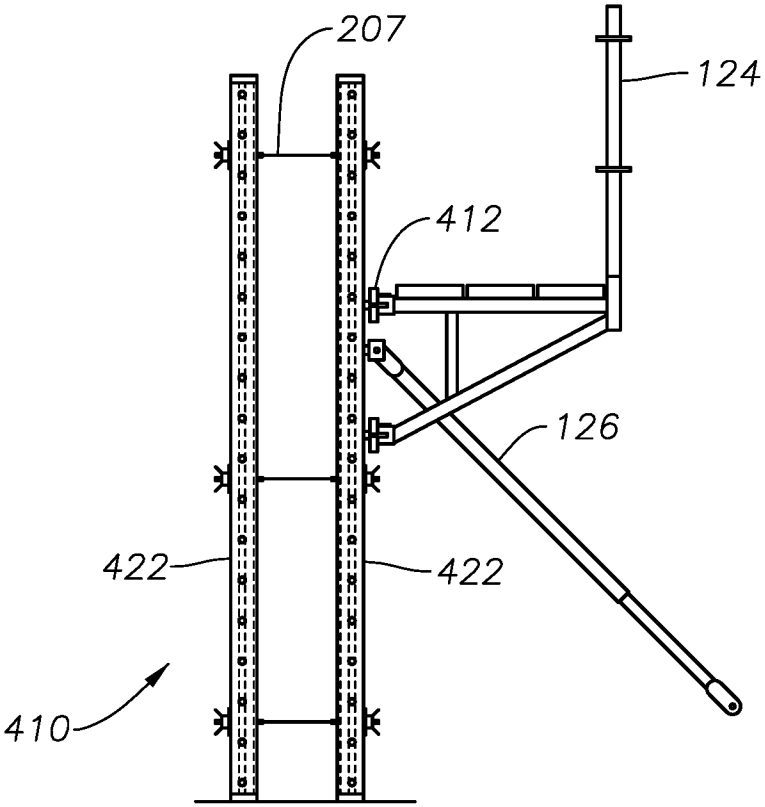
FIGS. 4A-4G illustrate side views of various wall configurations in accordance with implementations of various techniques described herein.
Figure 4A:
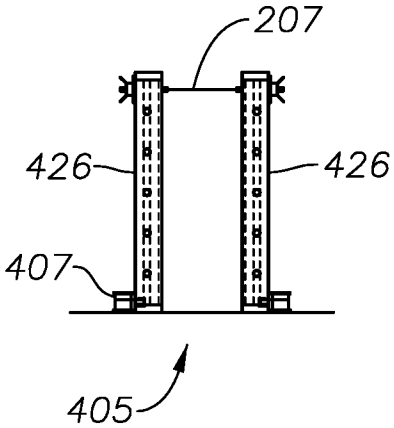
Figure 4F:
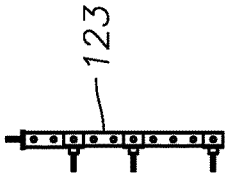
Figure 4G:
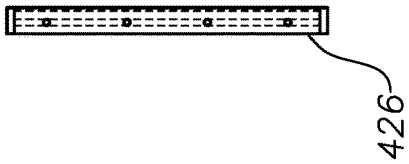
Figure 4E:
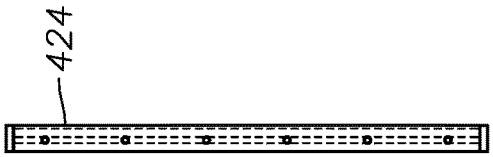
Figure 4D:
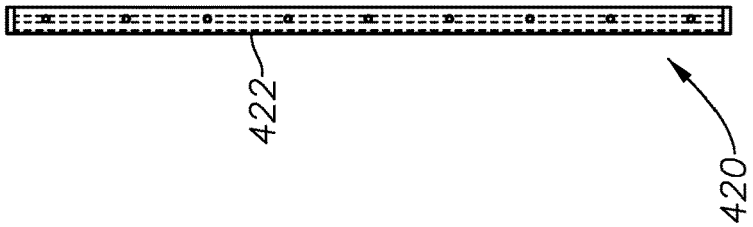
Figure 4C:
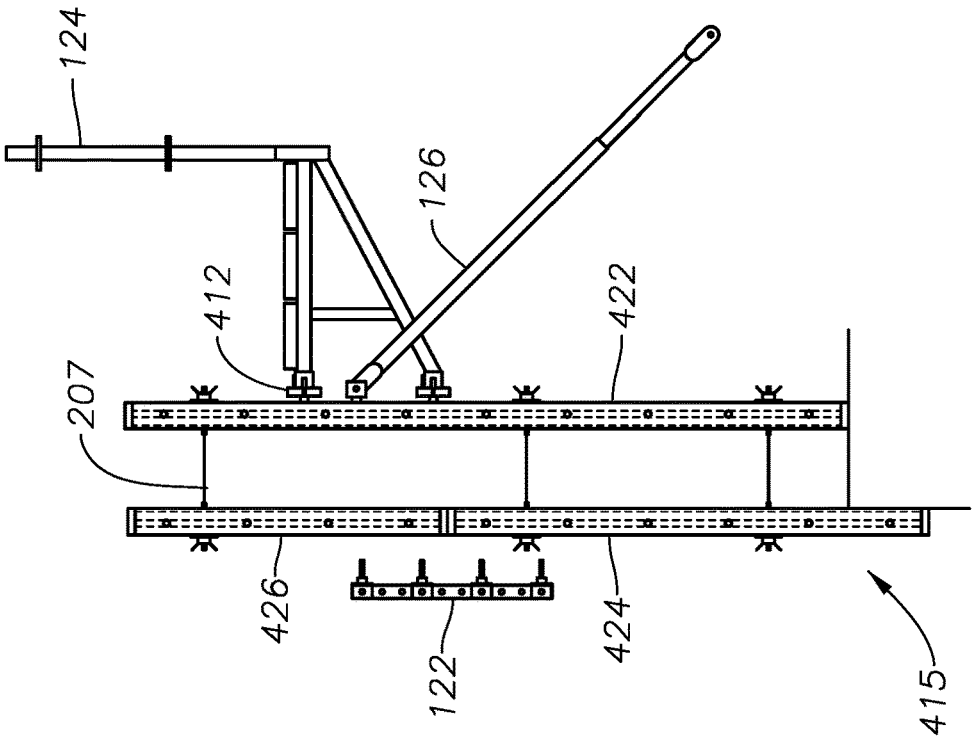

FIGS. 4A-4G show side views of various wall configurations. As stated previously, standard panels can be 2' or 3' in width. Each standard panel 106, 108 of width 2' or 3' can have a panel length of 3', 6', or 9' as shown in panels 426, 424, and 422, respectively. Item 405 is shown in FIG. 4A and illustrates 3' panels 426 supported by a tie assembly 207 or dry tie (as described below) on a top portion and a hold down assembly 407 or tie assembly on a bottom portion. Hold down assemblies and dry tie assemblies are described in further detail in FIGS. 24A-24B and FIG. 55A-55B. Item 410 is shown in FIG. 4B and illustrates 9' panels 422 supported by three tie assemblies 207 or dry ties. Item 410 also shows a standard scaffold 124 attached to a 9' panel 422 using a scaffold bracket adaptor 412 and secured with a pipe brace assembly 126. Item 415 is shown in FIG. 4C and illustrates a vertical panel shear condition where panels 422, 424, 426 having different lengths, e.g., 3', 6' and 9', are used. This type of configuration, i.e., using unequal heights for the formwork, is made possible because the formwork uses standardized tie hole locations for tie assemblies 207. Item 415 also includes the scaffolding 124 described in item 410. Item 420 is illustrated in FIG. 4D and shows typical panel heights (9' (panel 422), 6' (panel 424) and 4' (panel 426)) for the formwork system. In addition, a gang lifting configuration is shown. The gang lifting configuration 123 is used to move one or more panels, for example, with a crane or some other lifting/moving apparatus.

Figure 5A:
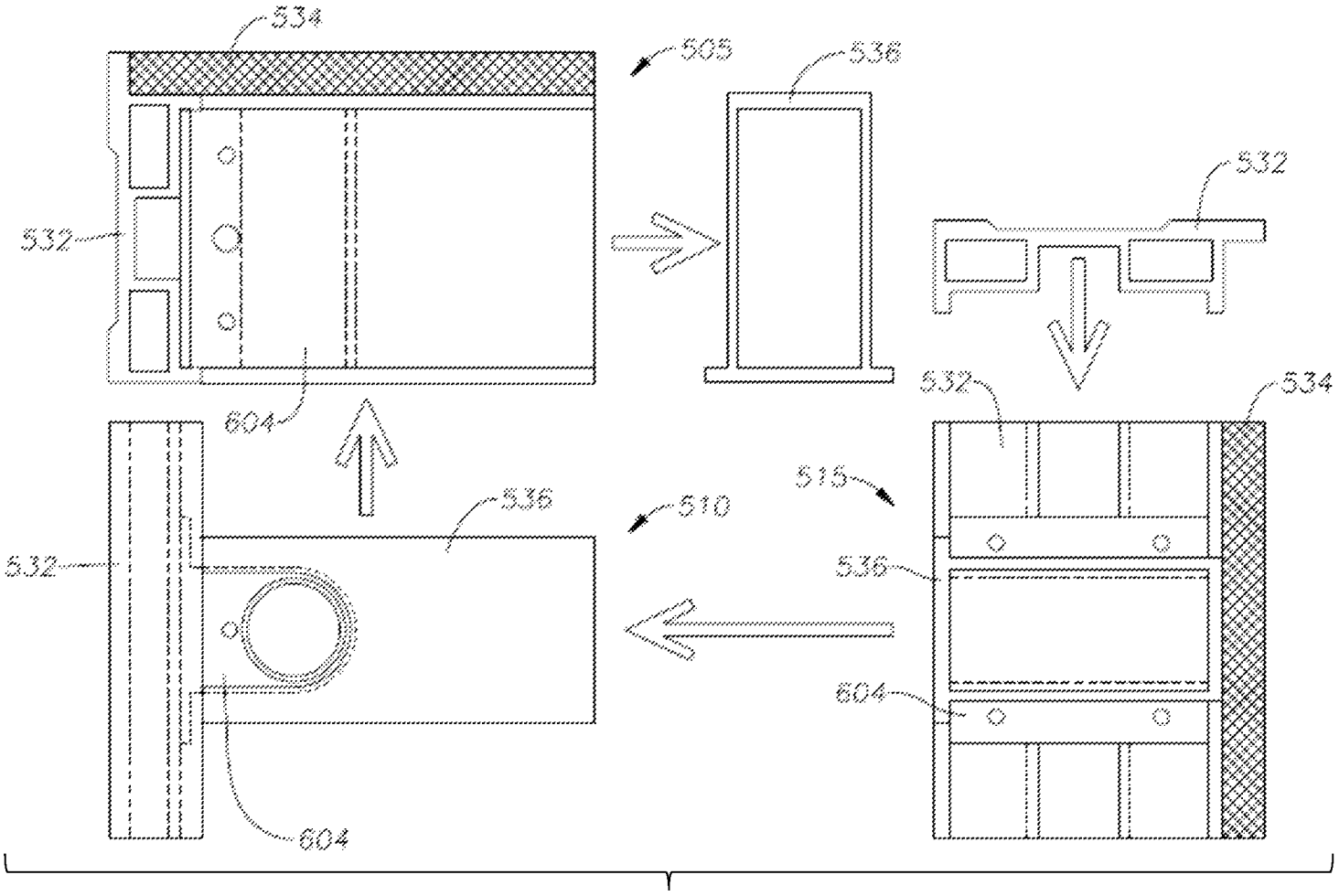

FIG. 5A illustrates how a side rail 532, an interior rail 536 and a tie extrusion 604 fit together in the formwork system. In particular, the views of FIG. 5A show back side views of the formwork system. Item 505 shows a top cutaway view of the formwork system. View 505 shows side rail 532, form face 534 and tie extrusion 604. Item 510 shows a side view of the formwork system. In this view, side rail 532, interior rail 536 and the tie extrusion 604 are clearly shown. Different types of tie port inserts 520, 525, 530, which are illustrated in FIGS. 5B, 5C and 5D, respectively, may be used within tie extrusion 604. These tie port inserts are discussed further in FIGS. 16A-16H. Item 515 shows a vertical cutaway view of a portion of the formwork system. This view shows the interior rail 536 in further detail along with tie extrusion 604 and side rail 532.

FIGS. 6A-6G illustrate views of a side rail extrusion 532, an interior rail extrusion 536, a corner casting 602 and a tie extrusion 604. Items 620, 625, 630 show various views of tie extrusion 604. Item 615 is illustrated in FIG. 6C and shows a top view of corner casting 602. Item 617 is illustrated in FIG. 6D and shows an elevational side view of corner casting 602. Corner casting 602 includes arms 632, 634, 636, 638. The inside rail extrusions 536 can be press fit with the side rail extrusions 532 and/or with arms 632, 634, 636, 638 of the corner casting 602 to together make up part of the assembly for the formwork panels. It should be noted that when two side rails 532 are placed back to back, they form the same basic shape as the inner rail 536. Having the same basic shape makes the connection of a standard clamp identical in both the vertical and horizontal positions. The standard clamp is described further in FIG. 18. The flange design on the inner & side rails help to increase the pull away capacity of the standard clamp, which is useful since the standard clamp is used to attach all of the accessories. The use of the standard clamp to attach all of the accessories is unique to this formwork system.

Figure 7:
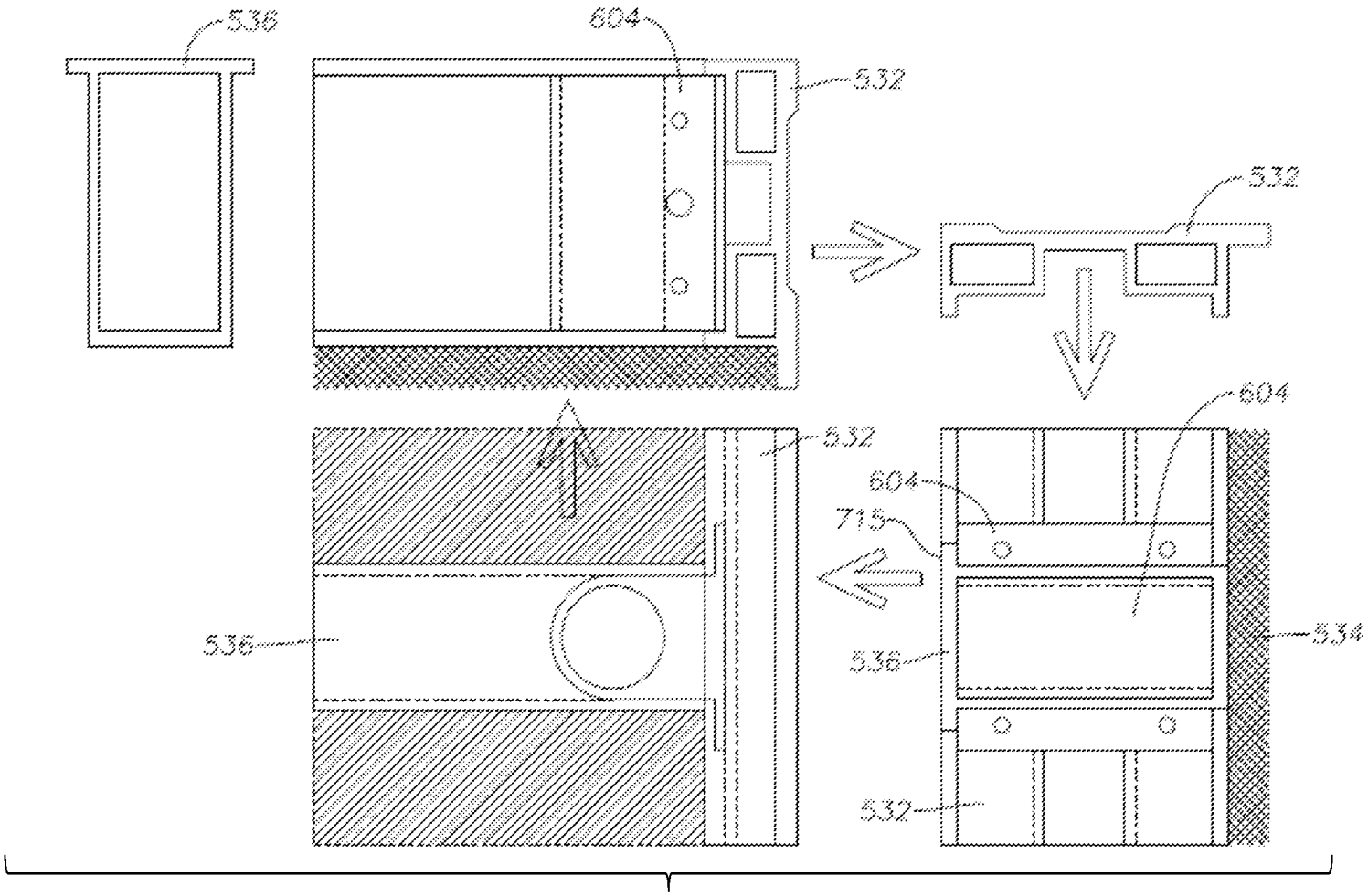
FIG. 7 illustrates how a side rail, an interior rail and a tie extrusion fit together in the formwork system in accordance with implementations of various techniques described herein.
Figure 8A:
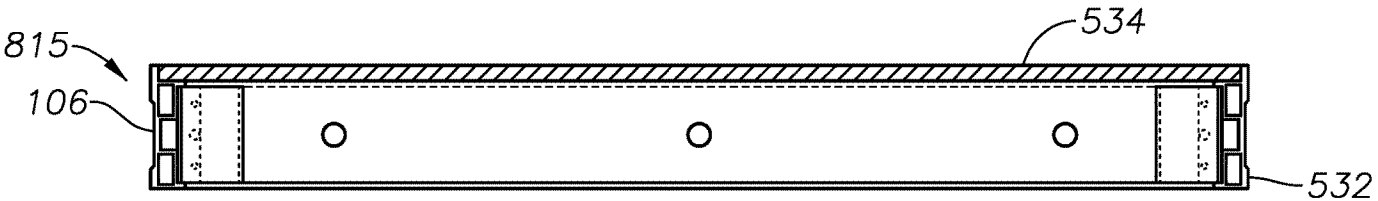
FIGS. 8A-8D illustrate standard panel assembly plan views in accordance with implementations of various techniques described herein.
Figure 8B:
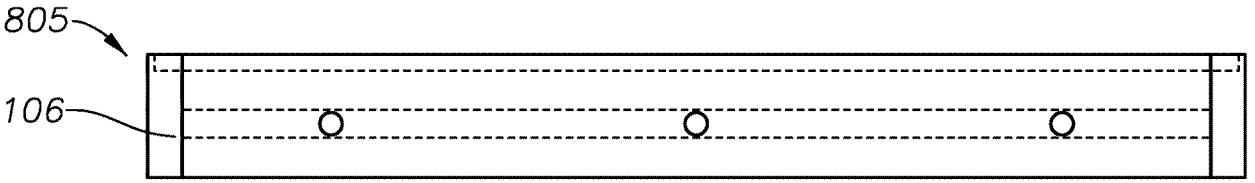
Figure 8C:
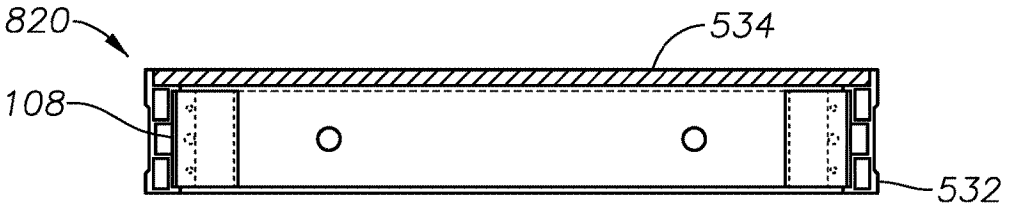
Figure 8D:
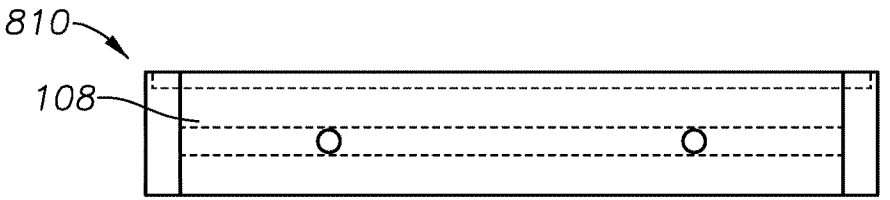

FIG. 7 illustrates how a side rail 532, an interior rail 536 and a tie extrusion 604 fit together in the formwork system. In particular, the views of FIG. 7 show the items of FIG. 5 from a face side of the formwork system.

FIGS. 8A-8D illustrate standard panel assembly plan views. Top/bottom 805, 810 and cutaway elements 815, 820 are shown for both 3 ft (panel 106) and 2 ft (panel 108) panel widths. In addition, elements 815, 820 show side rail 532 and form face 534.

Figure 9A:
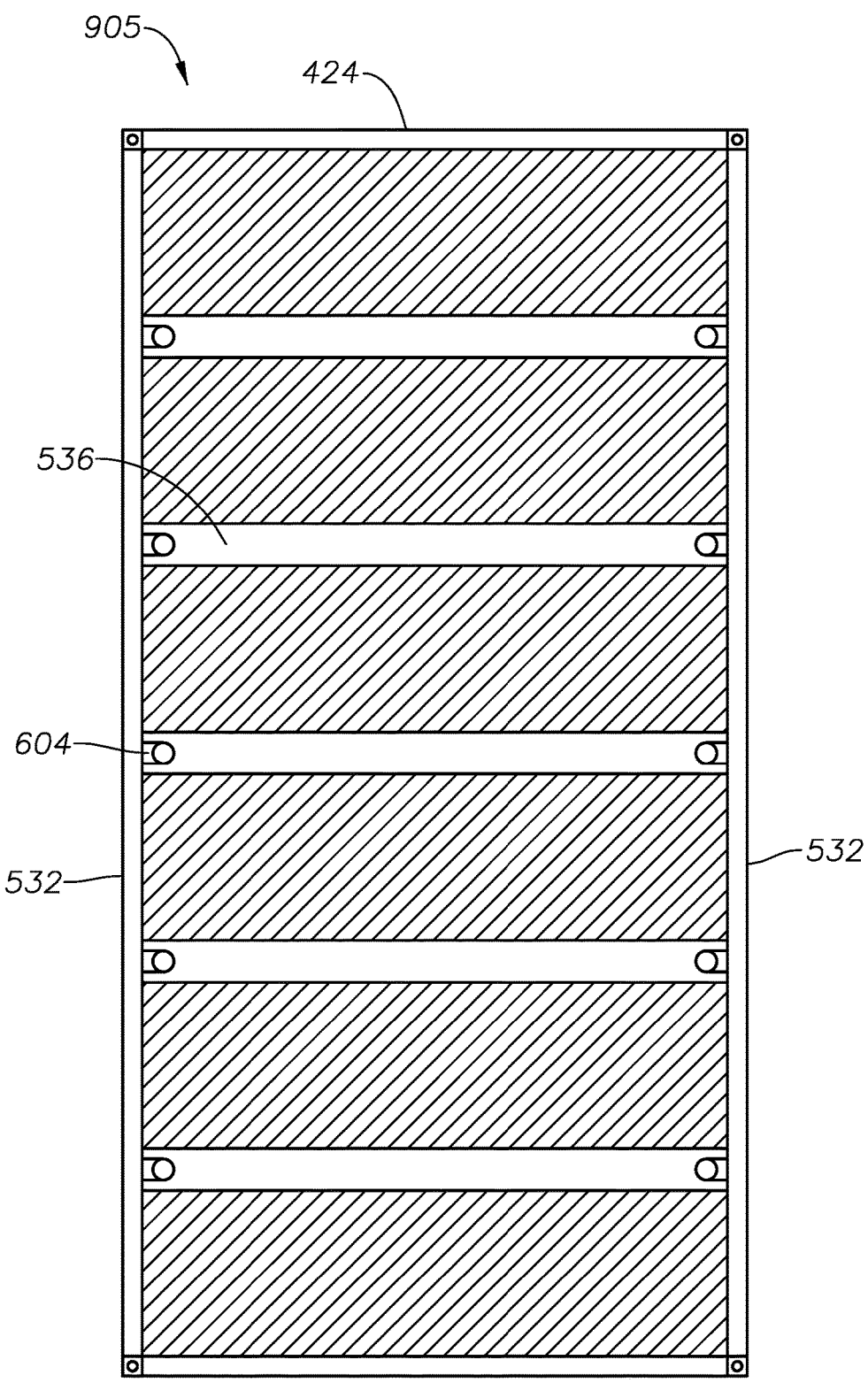
FIGS. 9A-9B illustrate elevational views of a standard panel assembly in accordance with implementations of various techniques described herein.
Figure 9B:
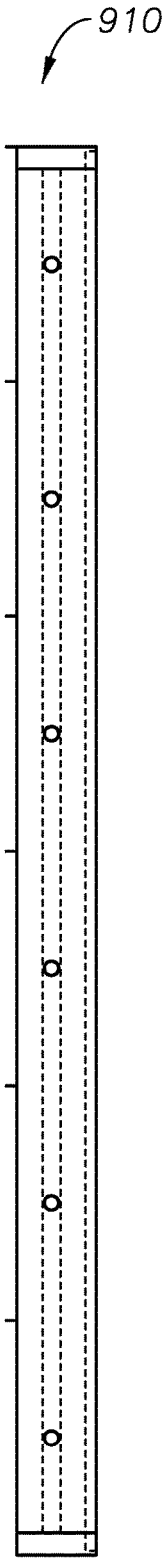

FIGS. 9A-9B illustrate elevational views of a standard panel assembly, e.g., panel 424. Item 905 shows an elevational view. Item 905 is shown in FIG. 9A and includes side rail 532, inner rail 536, and tie extrusion 604. Item 910 is shown in FIG. 9B and shows a side elevational view.

Figure 10A:
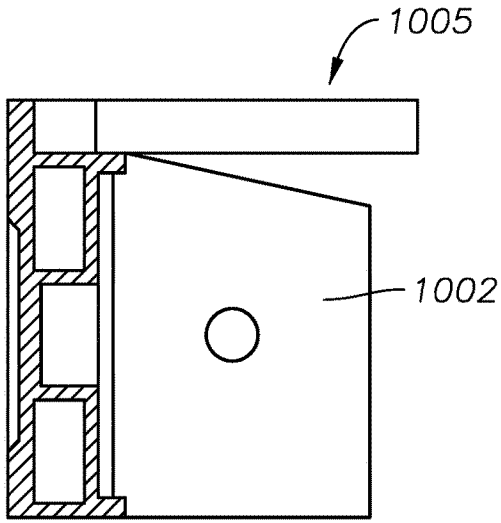
FIGS. 10A-10G illustrate filler extensions and fittings in accordance with implementations of various techniques described herein.
Figure 10B:
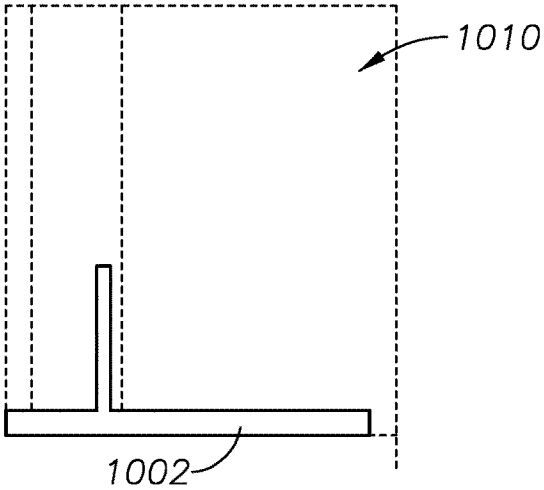
Figure 10C:
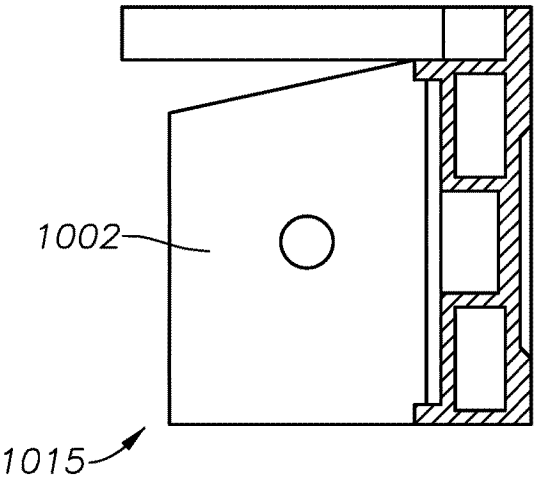
Figure 10D:
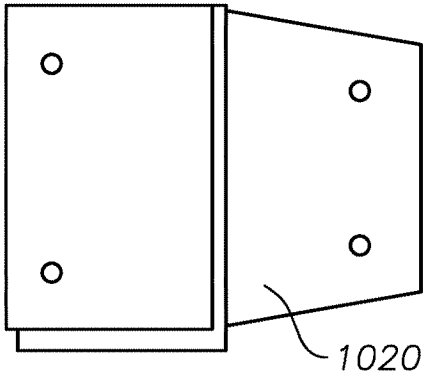
Figure 10E:
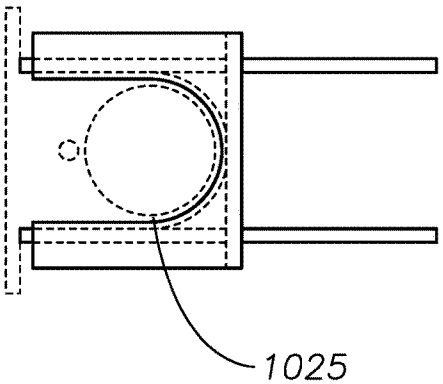
Figure 10F:
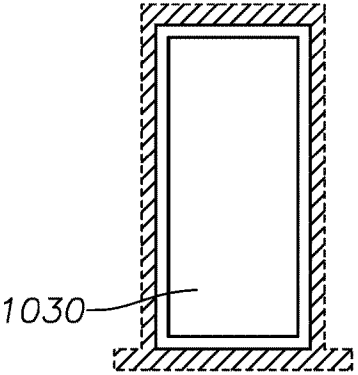
Figure 10G:
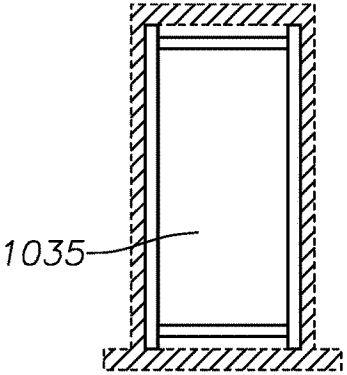
Figure 11B:
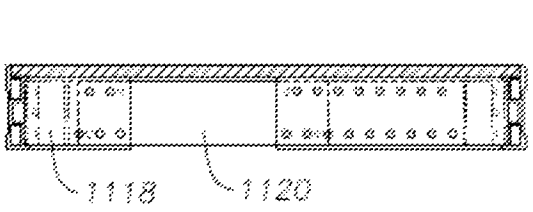
FIGS. 11A-11L illustrate filler assembly plan views in accordance with implementations of various techniques described herein.
Figure 11E:
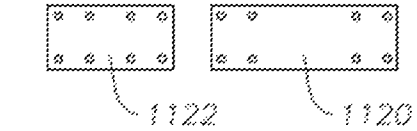
Figure 11A:
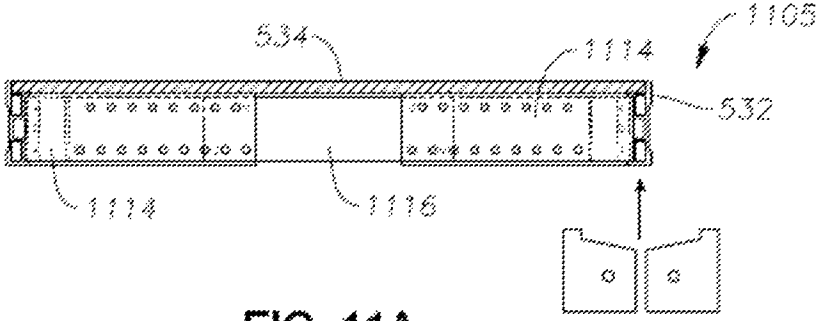
Figure 11D:
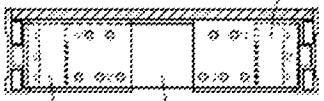
Figure 11F:
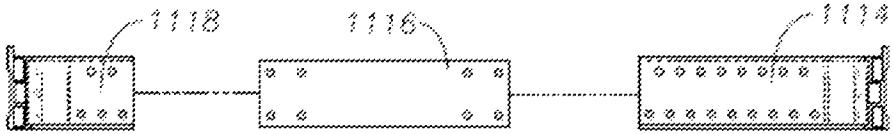
Figure 11C:
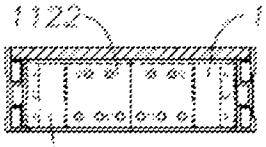
Figure 11H:
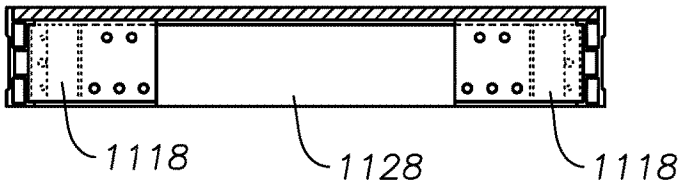
Figure 11L:
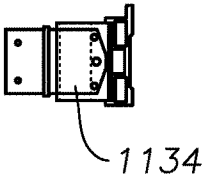
Figure 11K:
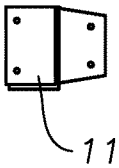
Figure 11G:
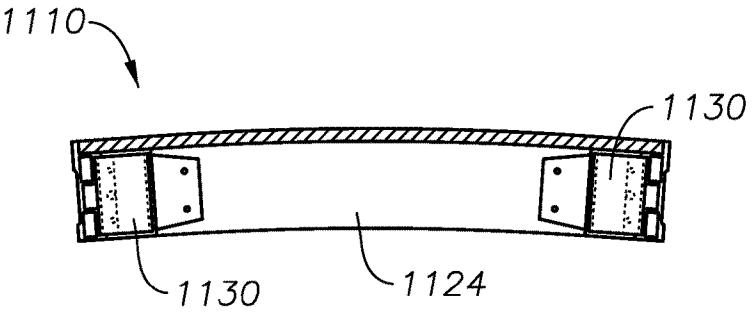
Figure 11I:
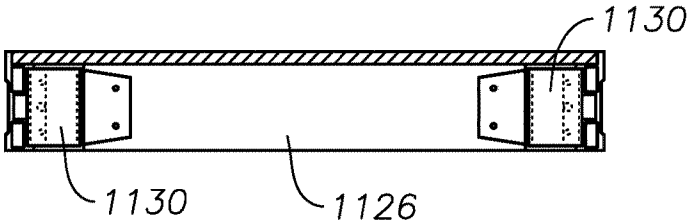
Figure 11J:
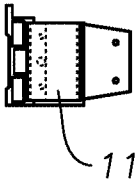

FIGS. 10A-10G illustrate filler extensions and fittings. In particular, FIG. 10A shows a left hand view 1005, FIG. 10B shows an edge view 1010 and FIG. 10C shows a right hand view 1015 of a filler edge clip 1002 are shown. Also shown in FIGS. 10D and 10E is a lumber inner rail clip 1020, 1025 an adjustable filler splice extrusion 1030 in FIG. 10F and an optional steel splice 1035 in FIG. 10G.

FIGS. 11A-11L illustrate filler assembly plan views. FIGS. 11A-11L show plan views of different configurations for adjustable fillers 1105 and lumber filler 1110 including any necessary extrusions and clips. Configurations for adjustable fillers may include combinations of adjustable filler assembly components 1114, 1116, 1118, 1120, 1122. Using these adjustable fillers provides greater flexibility and reduces the need for lumber filler in the formwork system. Using the adjustable filler assembly components provides the ability to incrementally adjust the filler from 18 inches to 31 inches. In one implementation, the adjustable filler can be incrementally adjusted in half-inch increments. In one implementation, the adjustable filler assembly includes spring loaded pins to attach the assembly components. The adjustable filler can be made from aluminum or galvanized steel. Lumber filler of varying sizes can still be used when necessary, however, through the use of the adjustable filler, the need for lumber filler is greatly reduced in the present formwork system. Configurations 1110 for lumber filler may include clips 1130, 1132, 1134 and adjustable filler components 1114, 1118 for curved 1124 and straight 1126, 1128 lumber inner rails.

Figure 12A:
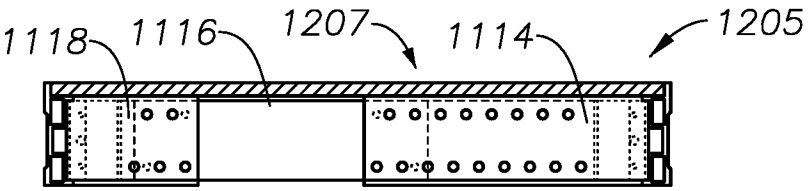
FIGS. 12A-12O illustrate the range of lengths achievable using adjustable fillers in the present formwork system in accordance with implementations of various techniques described herein.
Figure 12B:
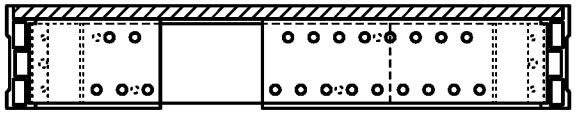
Figure 12C:
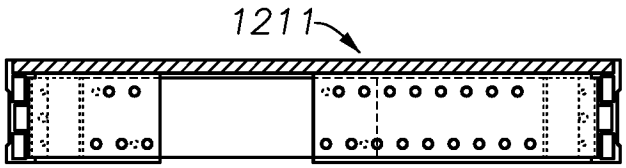
Figure 12D:
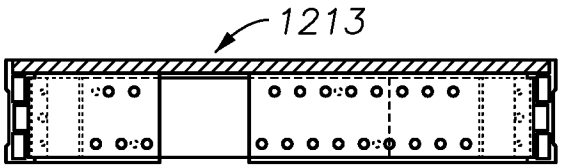
Figure 12E:
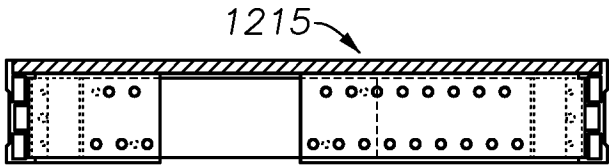
Figure 12F:
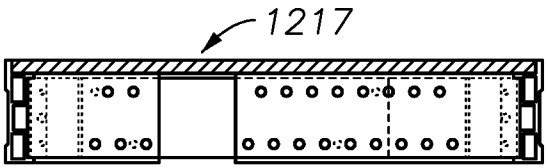
Figure 12G:
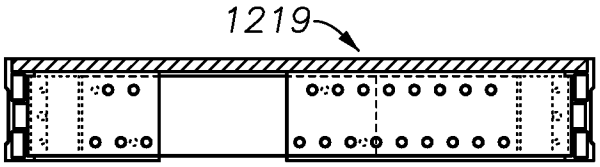
Figure 12H:
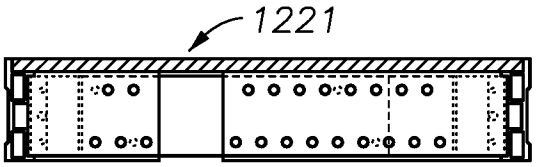
Figure 12I:
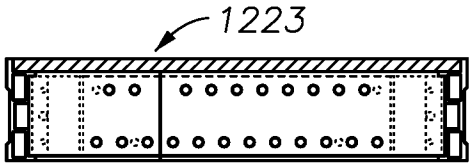
Figure 12J:
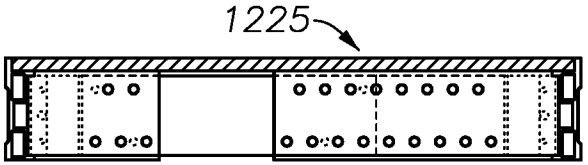
Figure 12K:
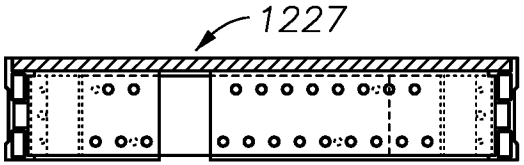
Figure 12L:
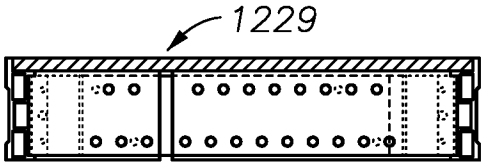
Figure 12M:
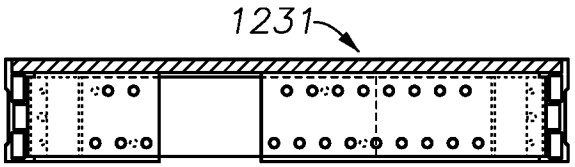
Figure 12N:
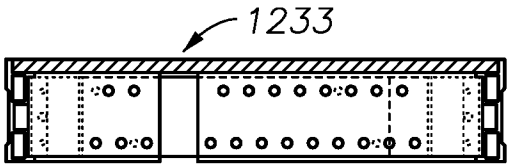
Figure 12O:
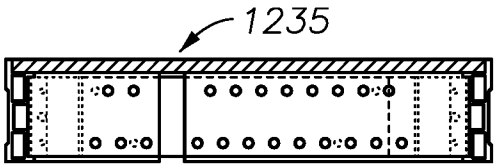

FIGS. 12A-12O illustrate various configurations 1205 for the range of lengths 1207, 1209, 1211, 1213, 1215, 1217, 1219, 1221, 1223, 1225, 1227, 1229, 1231, 1233, 1235 achievable using adjustable fillers in the present formwork system. In the present implementation, the length can be adjusted from 18 inches to 25 inches.

Figure 13A:
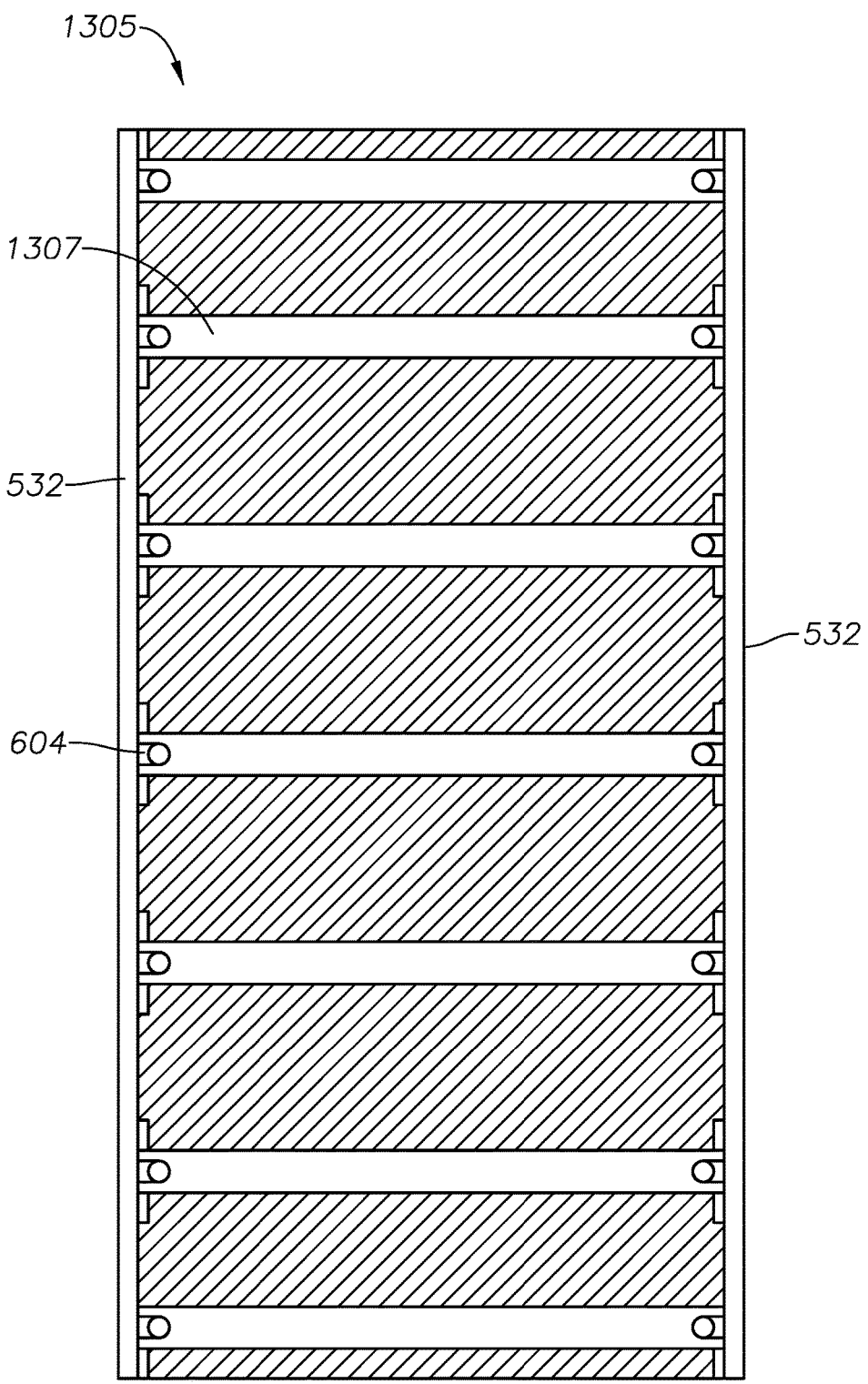
FIGS. 13A-13B illustrate elevational views of the filler frame in accordance with implementations of various techniques described herein.
Figure 13B:
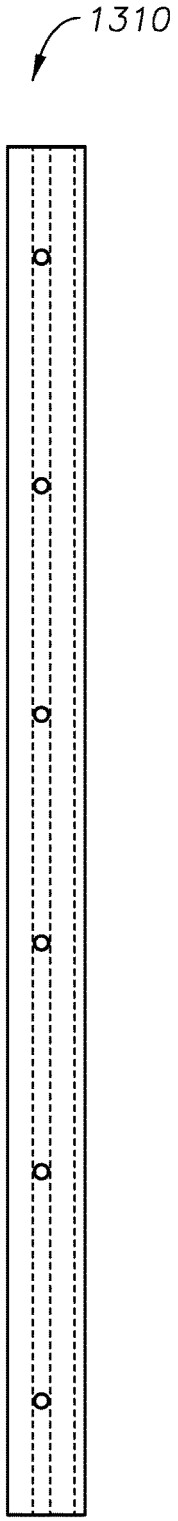
Figure 14D:
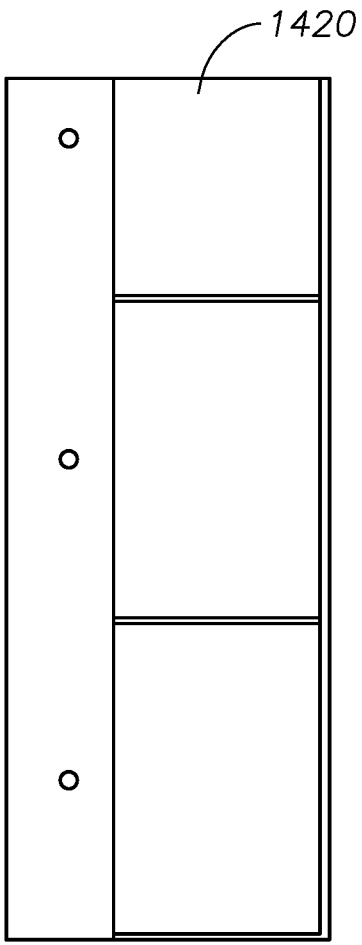
FIGS. 14A-14F illustrate corner assembly details in accordance with implementations of various techniques described herein.
Figure 14C:
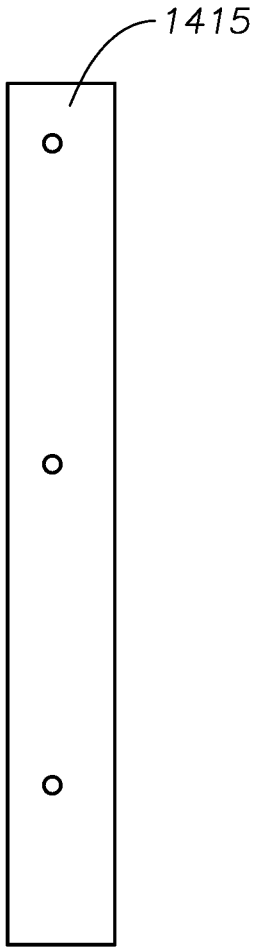
Figure 14A:
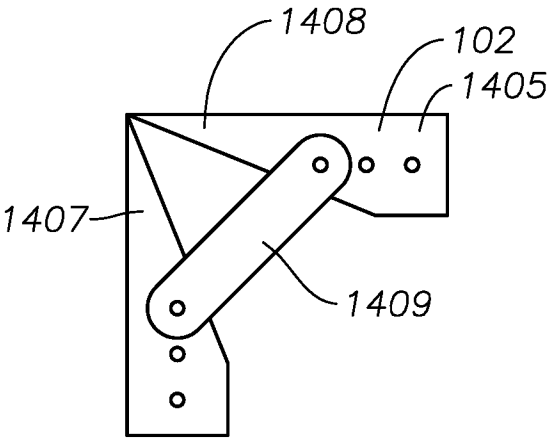
Figure 14B:
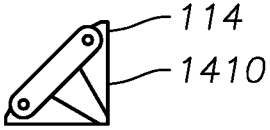
Figure 14F:
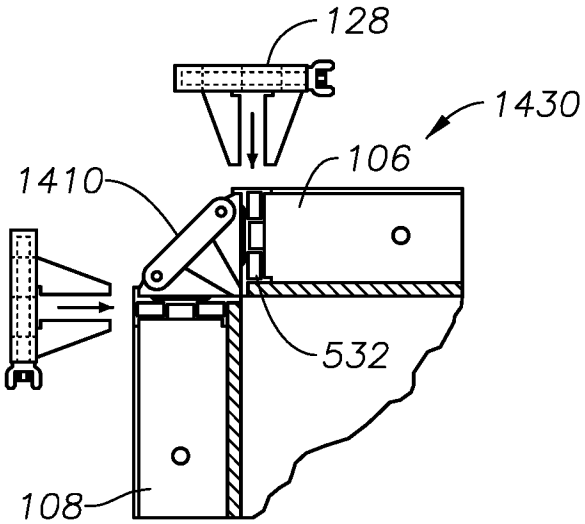
Figure 14E:
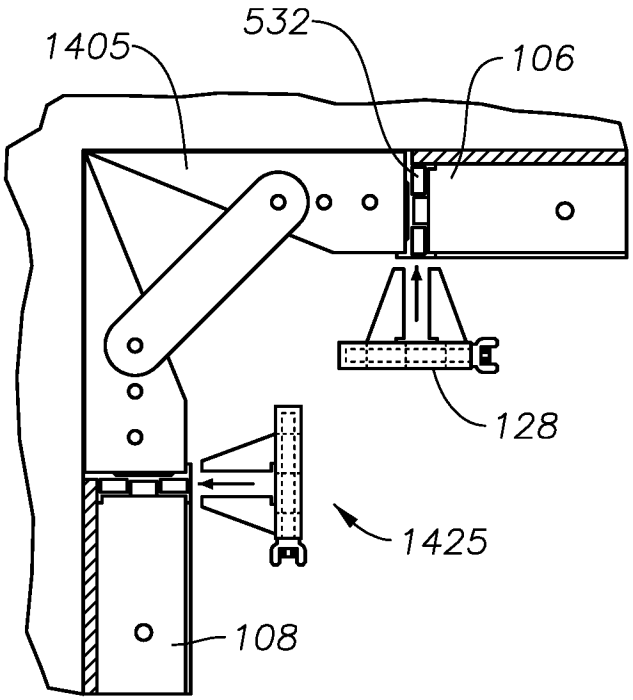

FIGS. 13A-13B illustrate elevational views of the filler frame. Item 1305 shows a back view of a variable filler elevation. Item 1305 is illustrated in FIG. 13A and shows a panel that includes inner rails 1307, side rails 532 and tie extrusion 604. Item 1310 is illustrated in FIG. 13B and shows a side view of a variable filler elevation.

FIGS. 14A-14F illustrate corner assembly details. Plan views for a hinged inside corner 102, 1405 and a hinged outside corner 114, 1410 are shown. Hinged inside corner includes arms 1407, 1408 and cross bar 1409. Also shown are partial elevation views of the hinged outside corner 1415 and the hinged inside corner 1420. Further, connection details 1425, 1430 illustrating how the hinged corners are connected to the panels 106, 108 using the standard clamp 128*a* are shown for the inside corner hinge and the outside corner hinge.

Figure 15:
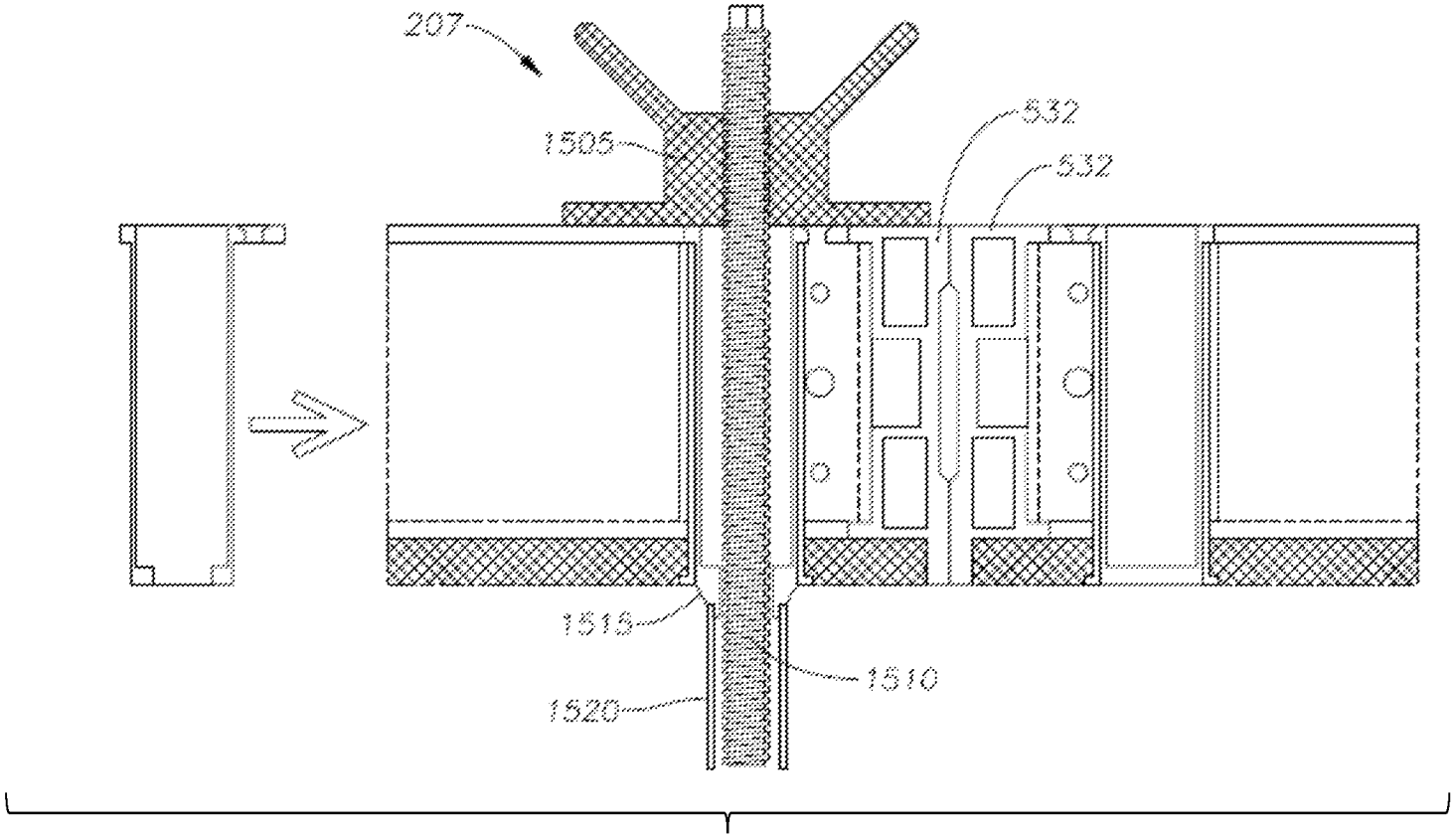
FIG. 15 illustrates a top cutaway view of the formwork system using a tie assembly in accordance with implementations of various techniques described herein.
Figure 16G:
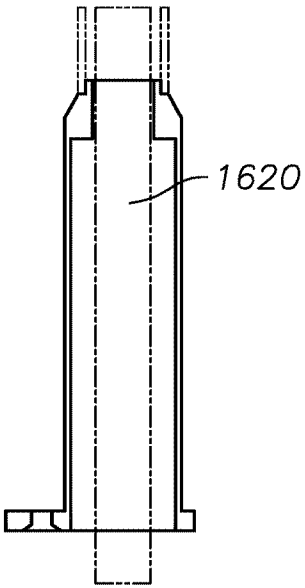
FIGS. 16A-16H illustrate tie port inserts in accordance with implementations of various techniques described herein.
Figure 16H:
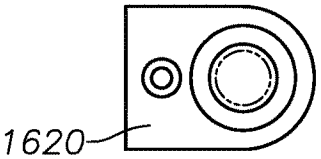
Figure 16E:
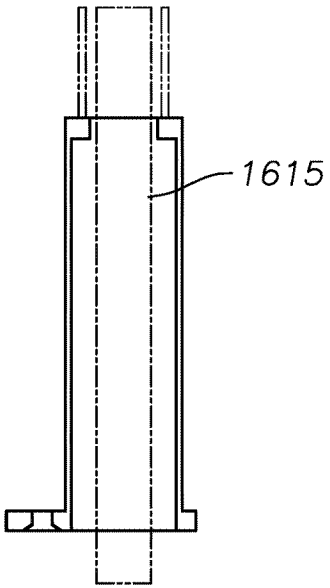
Figure 16F:
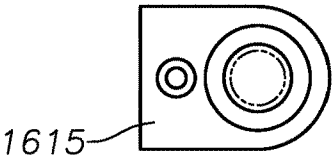
Figure 16C:
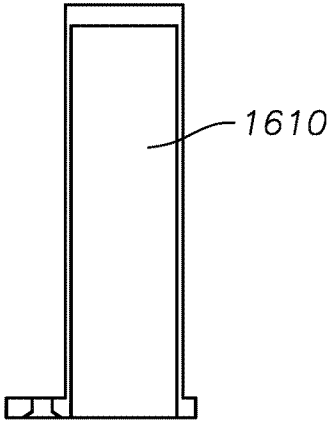
Figure 16D:
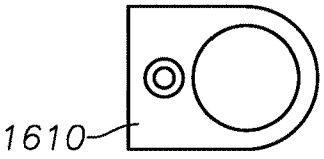
Figure 16A:
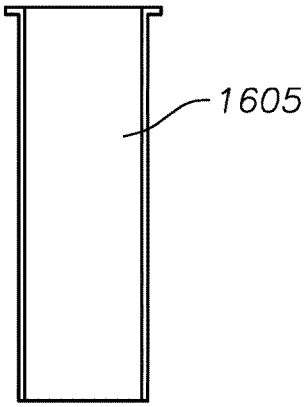
Figure 16B:
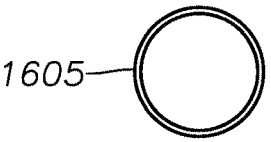

FIG. 15 illustrates a top cutaway view of the formwork system using a tie assembly, e.g., tie assembly 207. The tie assembly includes a tie rod 1510 and a wing nut 1505. The tie rod passes through a tie port insert 1515 and a polyvinyl chloride (PVC) sleeve 1520 and is used to tie one panel to another using a second wing nut (not shown).

FIGS. 16A-16H illustrate tie port inserts for insertion into tie extrusion 604. Tie port inserts can be permanent inserts 1605, plugs 1610, flush tie inserts 1615 and cone tie inserts 1620. The flush tie inserts and cone tie inserts may include a PVC sleeve, e.g., sleeve 1510.

Figure 17A:
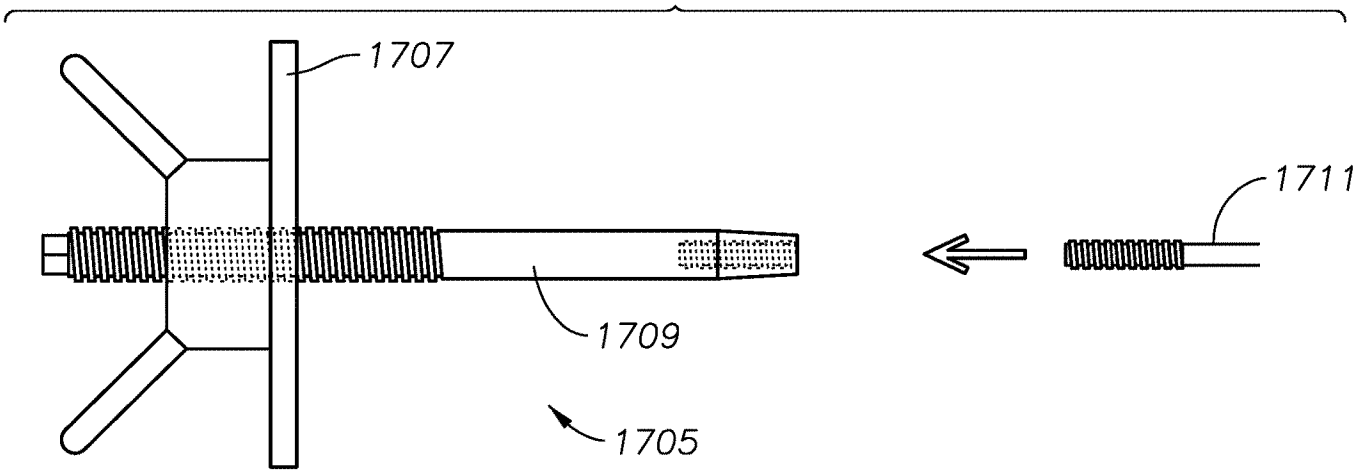
FIGS. 17A-17B illustrate a she bolt assembly in accordance with implementations of various techniques described herein.
Figure 17B:
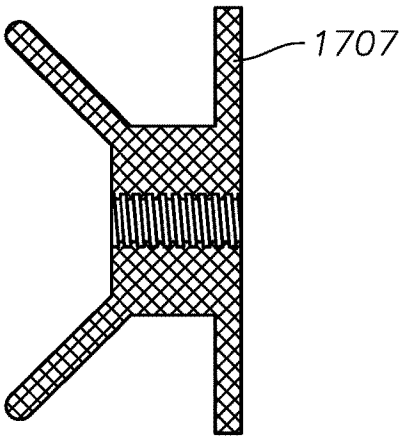
Figure 18D:
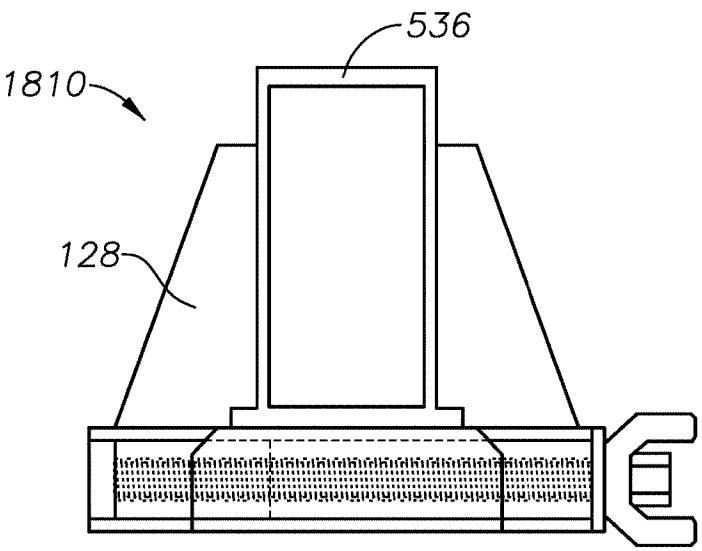
FIGS. 18A-18E illustrate different views of a standard clamp in accordance with implementations of various techniques described herein.
Figure 18E:
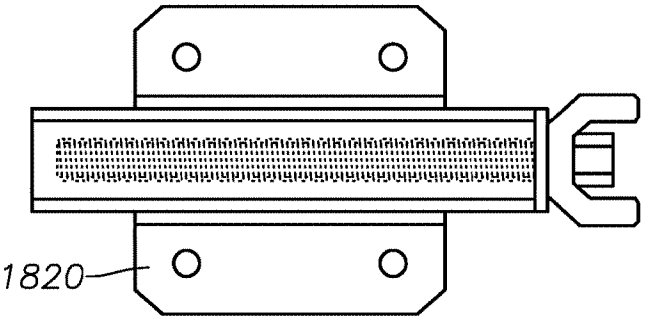
Figure 18C:
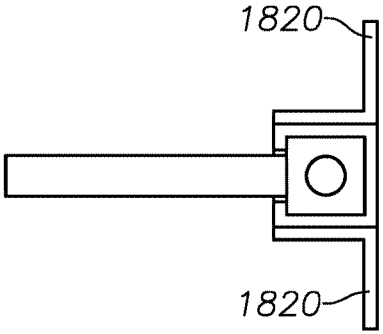
Figure 18A:
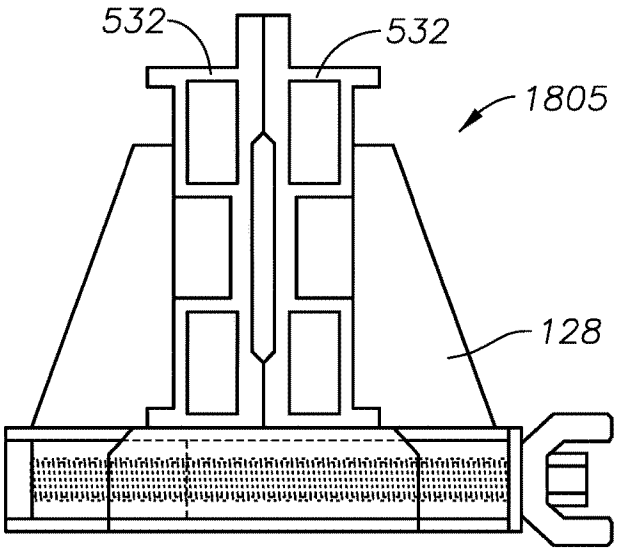
Figure 18B:
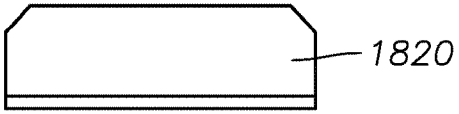
Figure 19E:
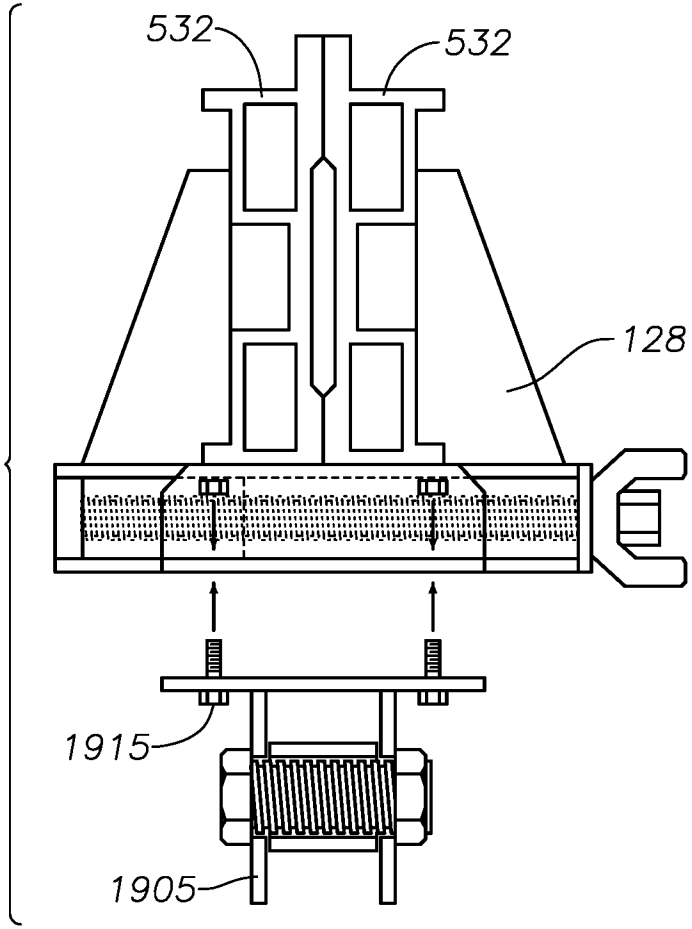
FIGS. 19A-19E illustrate an accessory clip in accordance with implementations of various techniques described herein.
Figure 19B:
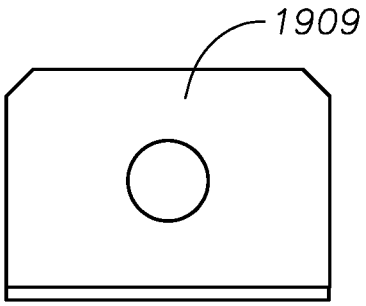
Figure 19C:
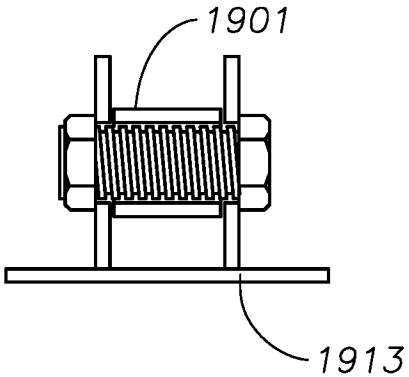
Figure 19A:
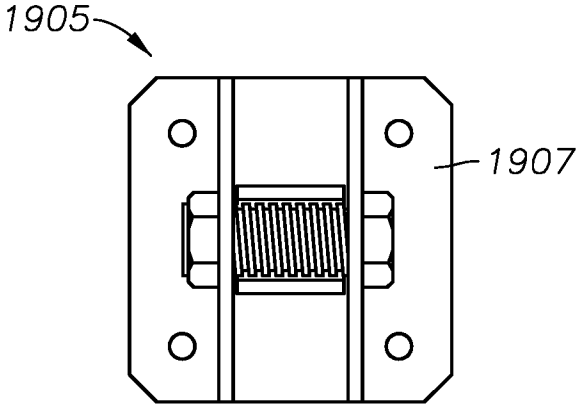
Figure 19D:
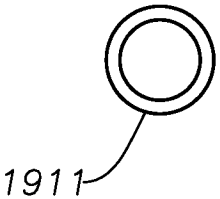
Figure 20D:
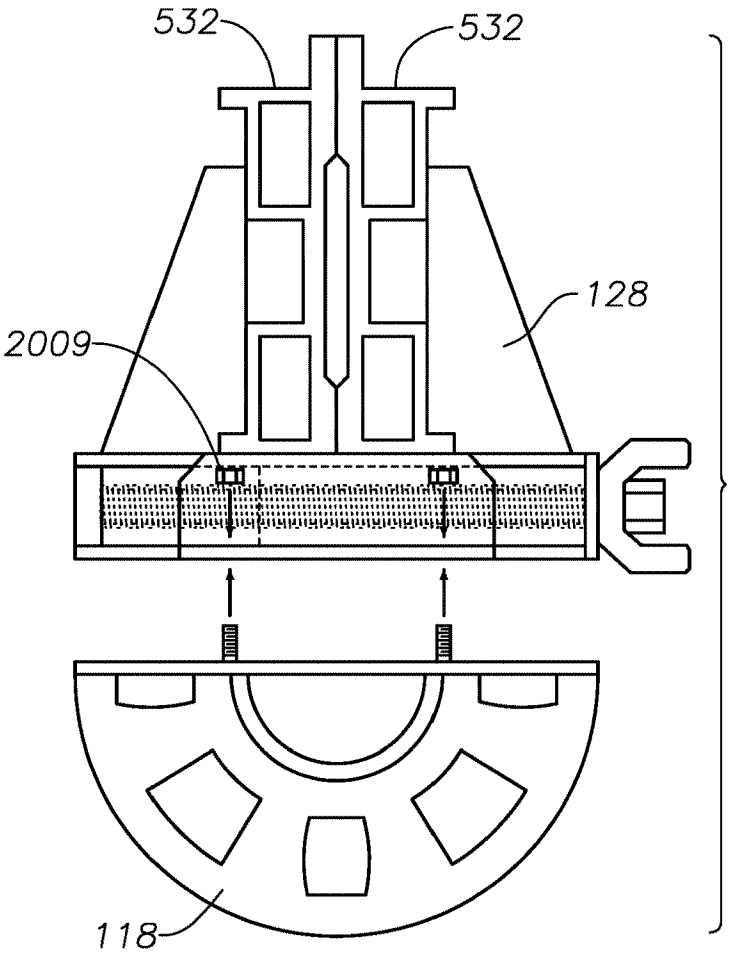
FIGS. 20A-20D illustrate various views of a scaffold bracket adaptor in accordance with implementations of various techniques described herein.
Figure 20B:
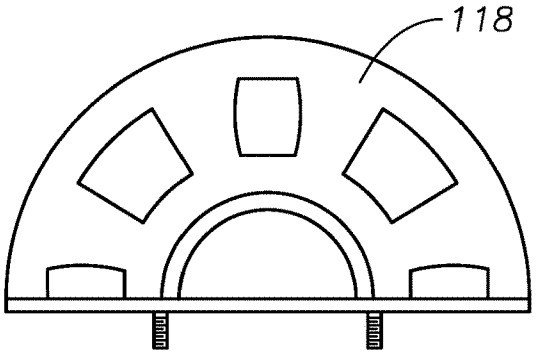
Figure 20C:
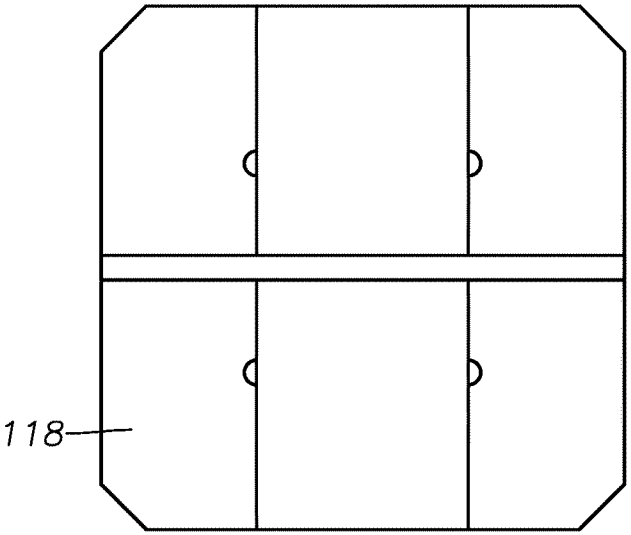
Figure 20A:
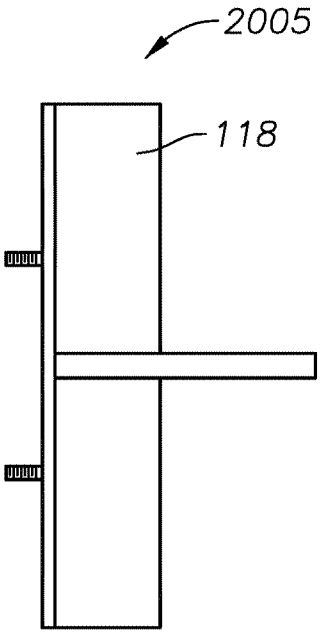
Figure 21B:
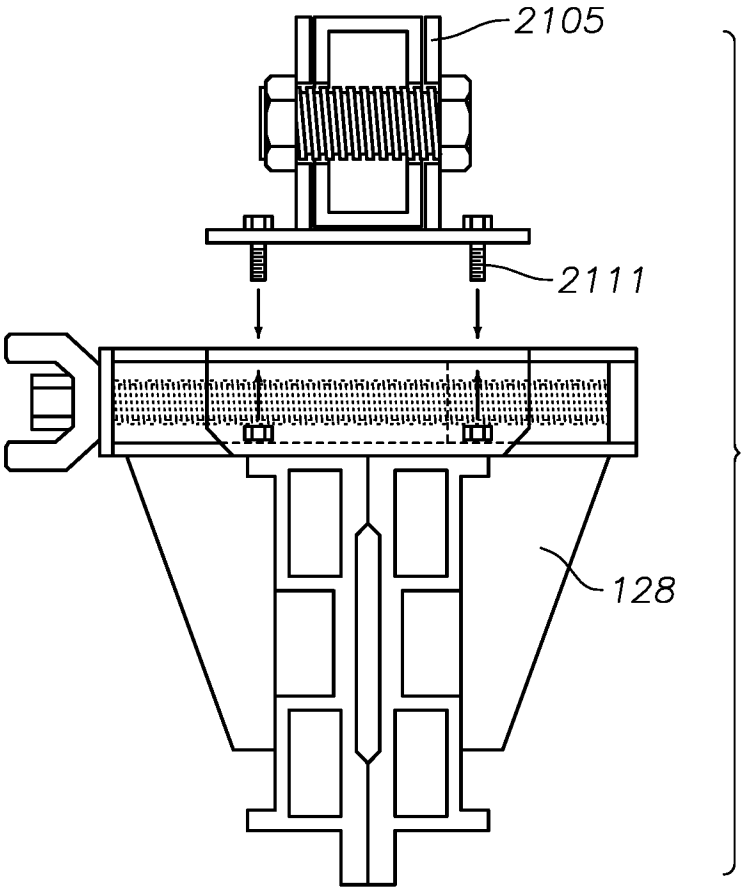
FIGS. 21A-21D illustrate various views of an alignment/lifting bar clamp attachment in accordance with implementations of various techniques described herein.
Figure 21A:
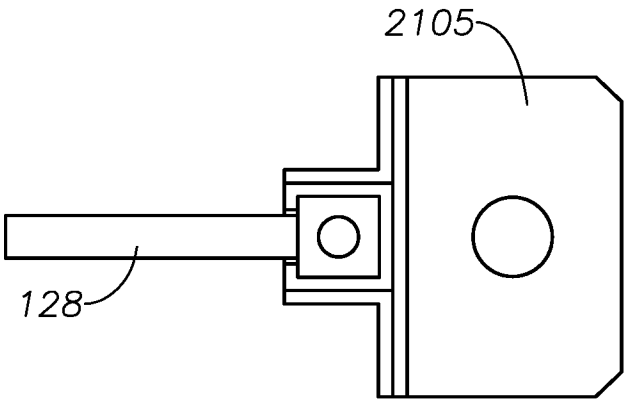
Figure 21C:
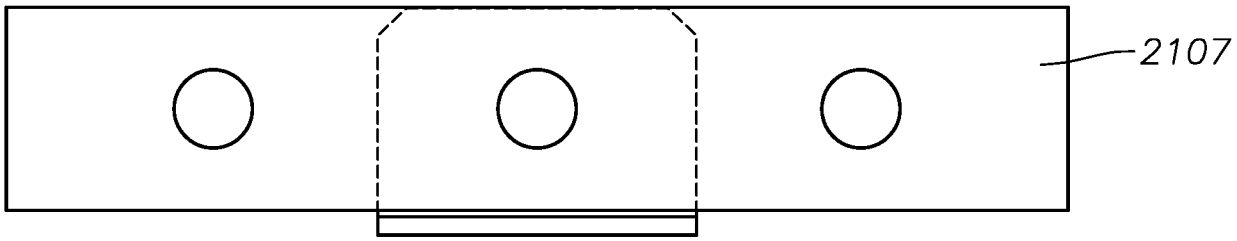
Figure 21D:
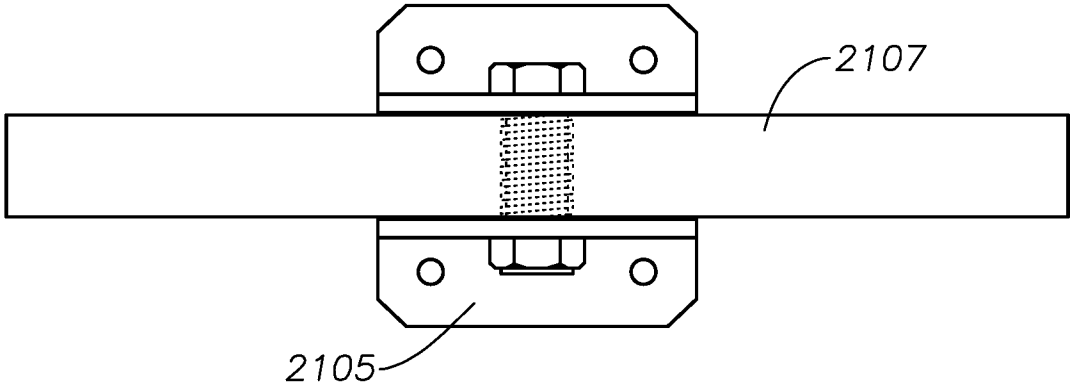

FIGS. 17A-17B illustrate a she bolt assembly 1705. She bolt assembly includes wing nut 1707, rod 1709 and rod 1711. The she bolt assembly is used to secure one formwork assembly to another. This she bolt assembly may secure the form panels to each other using tie port inserts in the form panels.

FIGS. 18A-18E illustrate different views of a standard clamp 128*a*. In item 1805, the clamp 128*a* is shown clamping two side rails 532. In item 1810, the clamp 128*a* is shown clamping an inner rail 536. The standard clamp is designed to tighten with a screw mechanism and generally can be tightened without using a tool. Using this type of standard clamp makes all accessory connections more efficient and easier for the end user. The screw mechanism is safer than other coupling mechanisms because the clamp will not loosen as easily if someone accidentally hits the clamp. The accessory clip 1820 that attaches to the standard clamp serves as a standard connection for the alignment bar configuration, personal tie-off point, pipe brace attachment, and lifting bar configuration. FIGS. 18A-18E correspond to FIGS. 48A-48E which are described in more detail below.

FIGS. 19A-19E illustrate an accessory clip 1905. The accessory clip 1905 can be used with the standard clamp and for various other applications, e.g., pipe brace clip, alignment bar, lifting bar and tie-off point. FIGS. 19A-19E show a top view 1907 and side views 1909, 1913 of accessory clip 1905. Sleeve 1911 of accessory clip 1905 is also shown. Accessory clip 1905 may be attached to standard clamp 128*a* using screw assembly 1915. FIGS. 19A-19E correspond to FIG. 49A-49E, which are described in more detail below.

FIGS. 20A-20D illustrate various views 2005 of a scaffold bracket adaptor 118. The scaffold bracket adaptor 118 may be attached to the standard clamp 128*a* using nut 2009. FIGS. 20A-20D correspond to FIGS. 50A-50D, which are described in more detail below.

FIGS. 21A-21D illustrate various views of an alignment/lifting bar clamp attachment 2105. The alignment/lifting bar clamp 2105 can be coupled to standard accessory clip 2107. The alignment/lifting bar clamp 2107 and standard accessory clip 2107 can be coupled to standard clamp 128*a* using screw assembly 2111. FIGS. 21A-21D correspond to FIGS. 52A-52D, which are described in more detail below.

Figure 22E:
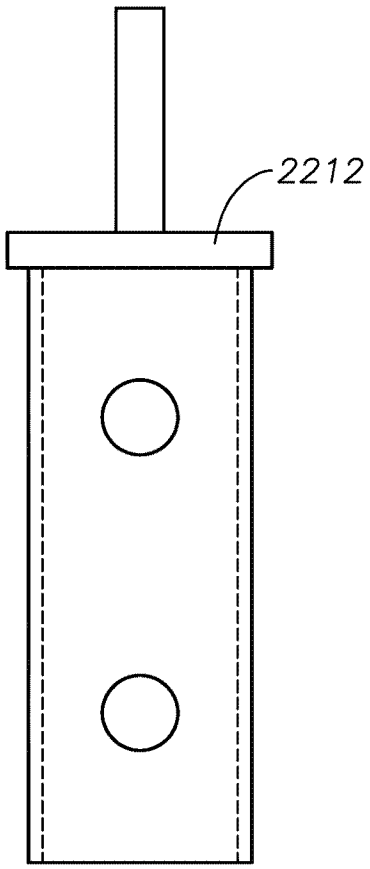
FIGS. 22A-22E illustrate additional alignment/lifting bar attachments in accordance with implementations of various techniques described herein.
Figure 22D:
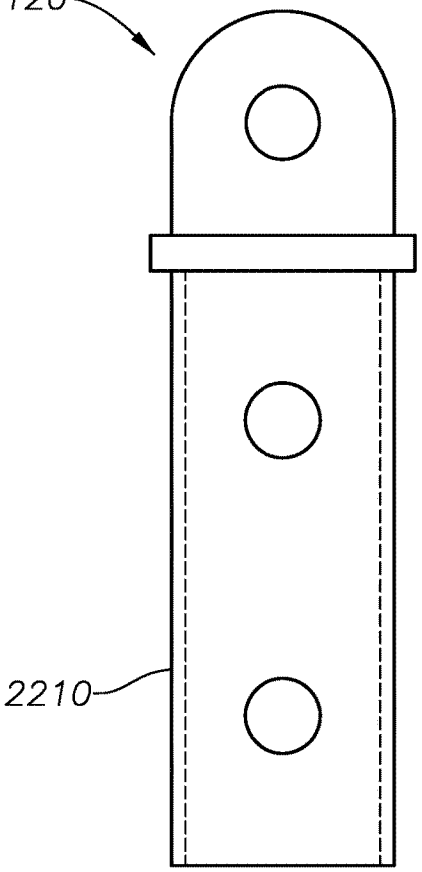
Figure 22A:
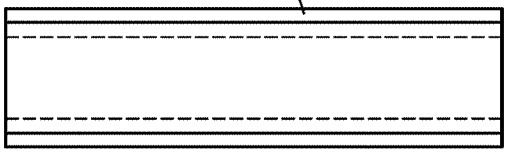
Figure 22B:
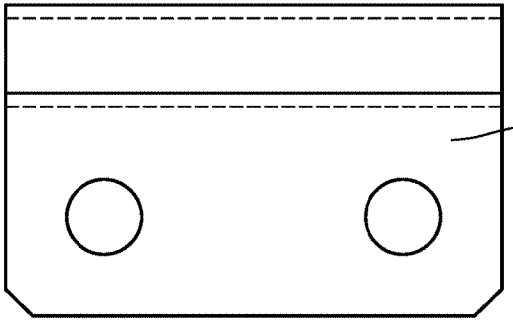
Figure 22C:
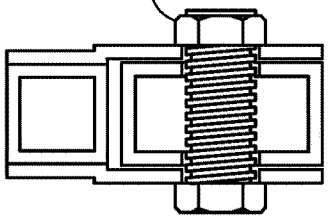

FIGS. 22A-22E illustrate additional alignment/lifting bar attachments. FIGS. 22A-22C, respectively, include various views 2205, 2207, 2209 of an optional center support attachment 132*a* and FIGS. 22D and 22E, respectively, include various views 2210, 2212 of a lifting bracket attachment 120*a* and a side 120*b* of lifting bracket attachment 120*a*.

Figure 23C:
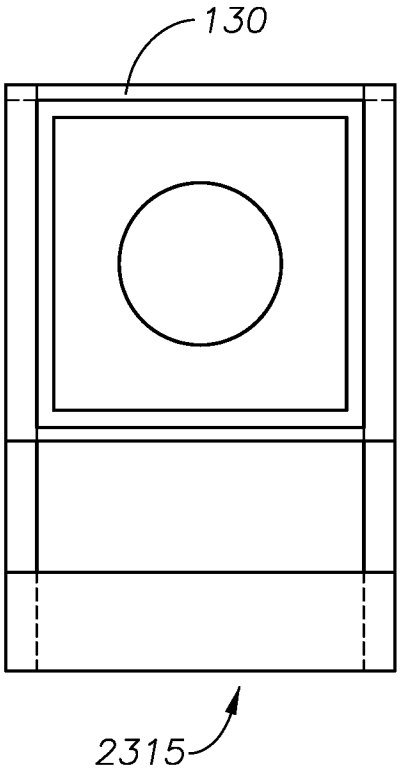
FIGS. 23A-23C illustrate various views of a dry tie/hold down bracket in accordance with implementations of various techniques described herein.
Figure 23B:
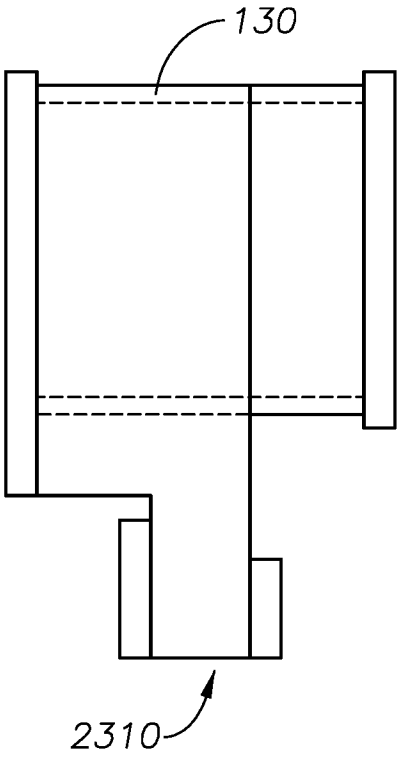
Figure 23A:
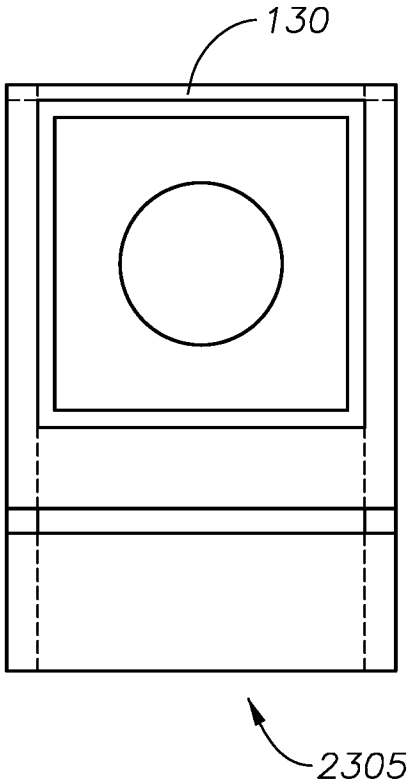
Figure 24A:
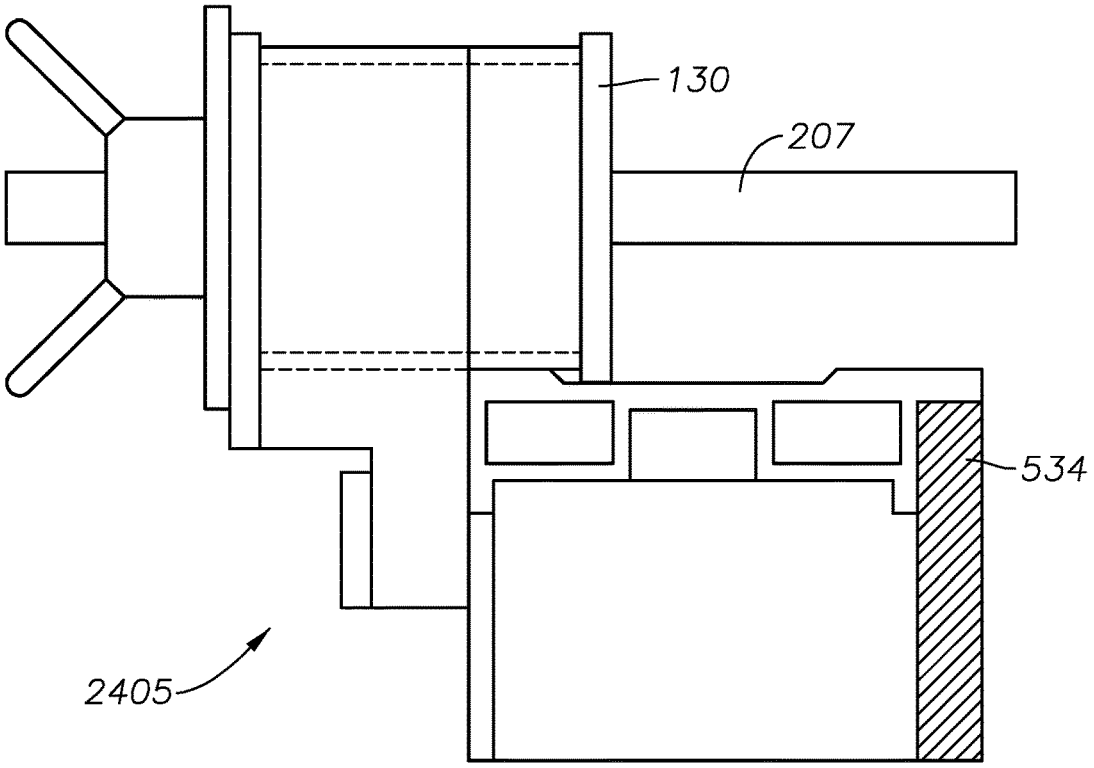
FIGS. 24A-24B illustrate implementations of a dry tie/hold down bracket in accordance with implementations of various techniques described herein.
Figure 24B:
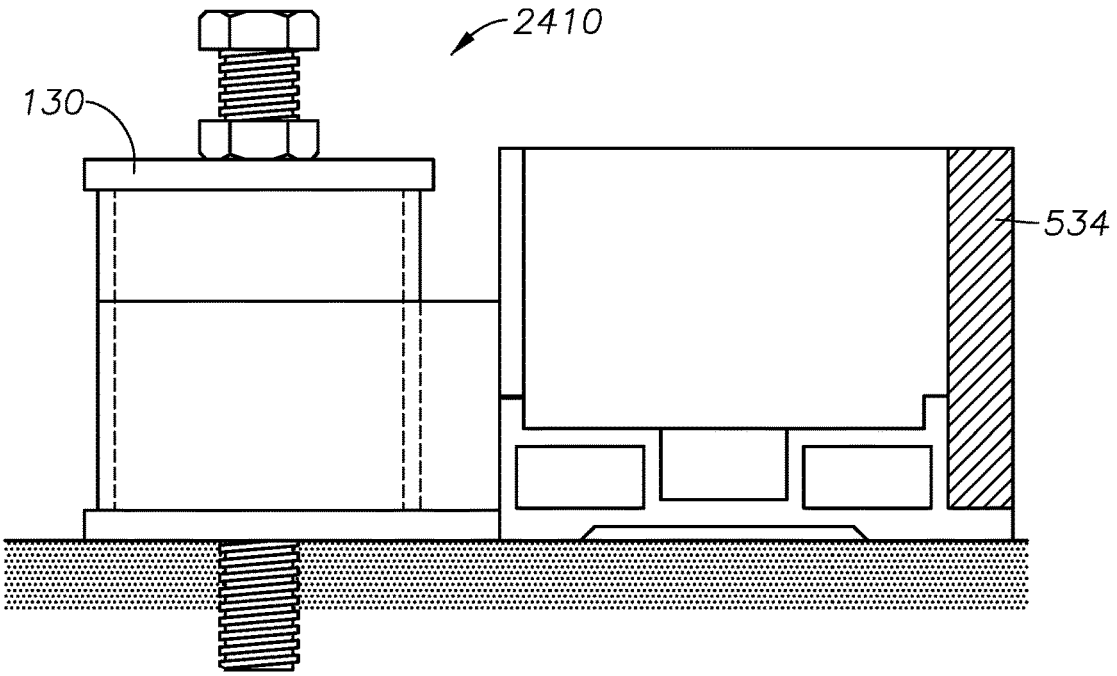

FIGS. 23A-23C, respectively, illustrate illustrates various views 2305, 2310, 2315 of a dry tie/hold down bracket 130. FIGS. 24A-24B illustrate implementations of a dry tie/hold down bracket 130. Item 2405, illustrated in FIG. 24A, is a view of a dry tie application and item 2410, illustrated in FIG. 24B, is a view of a hold down application. Also shown in FIG. 23A is tie assembly 207 and form face 534. FIGS. 23A-23C and 24A-24B correspond to FIGS. 54A-54C and 55A-55B, which are described in more detail below.

Figures 25A, 25B, 25C, 25D, 25E, 25F, 25G, 25H, 25I, 25J, 25K, 25L, 25M, 25N, 25O, 25P:
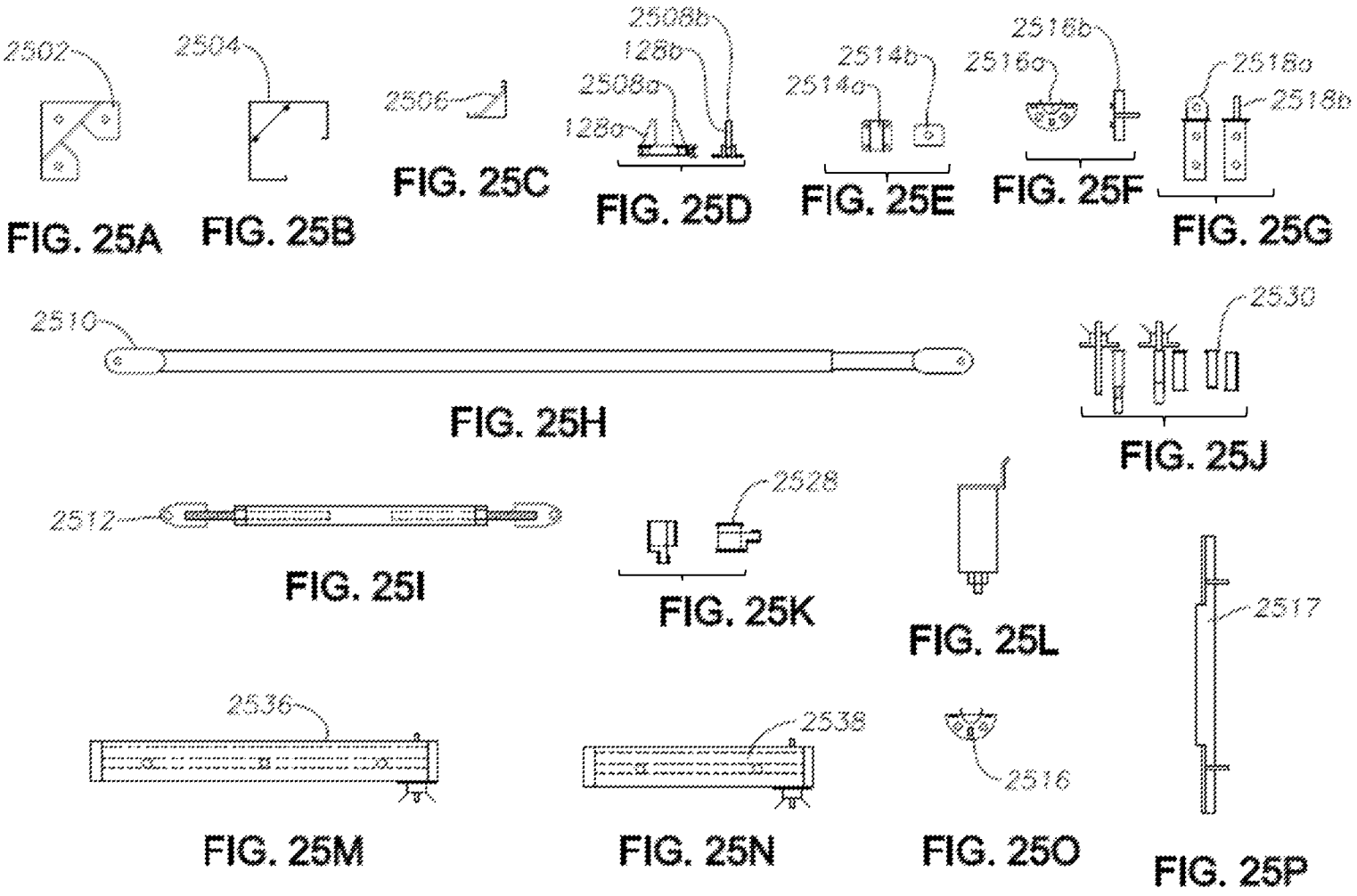
FIGS. 25A-25W illustrate various formwork system component drawings in accordance with implementations of various techniques described herein.
Figure 25T:
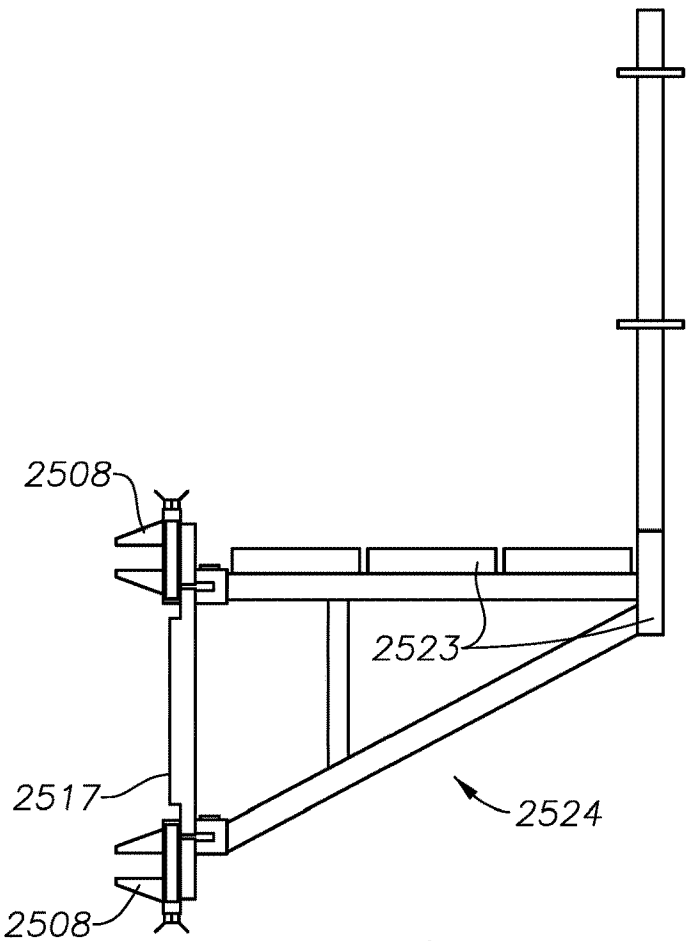
Figure 25S:
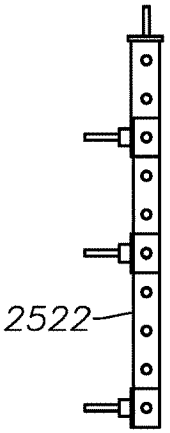
Figure 25R:
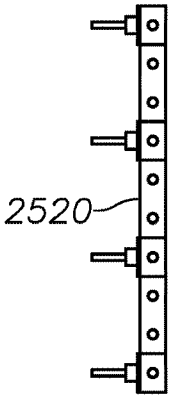
Figure 25Q:
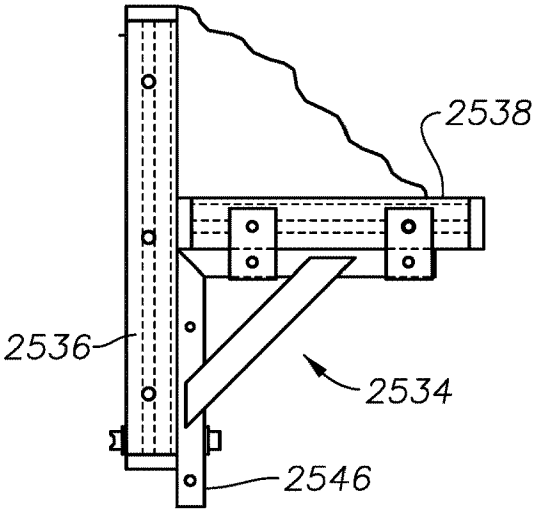
Figure 25V:
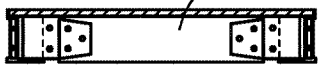
Figure 25U:
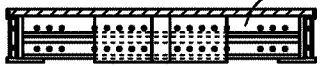
Figure 25W:
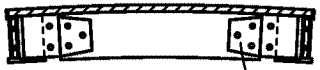

FIGS. 25A-25W include plan views of the formwork at various widths (adjustable 2540, lumber (straight 2542 and radius 2544), standard 2' panel 2538, standard 3' panel 2536). FIGS. 25A-25W also include views of clamps, brackets, clips, adaptors, supports, assemblies, insert systems and braces used with the formwork system. Additionally, FIGS. 25A-25W show an implementation that couples the present formwork system with a standard scaffold.

FIGS. 25A-25W include corner brackets 2502, 2504, 2506. Element 2502 is an inside stripping corner bracket. Element 2504 is a hinged inside corner bracket and element 2506 is a hinged outside corner bracket. The hinged inside and outside corner brackets 2504, 2506 may be aluminum components. Brackets 2504, 2506 can be configured to be set at a 90 degree angle. In some implementations, brackets 2504, 2506 can be configured to be set at angles other than 90 degrees.

Standard clamp 2508 is the primary method of attaching all accessories to the standard form panels. Standard clamp 2508 may also be used to tie formwork panels having different heights and as a lifting device for a series of ganged formwork panels. Also illustrated (in FIG. 25D) is a side view 2508*b* of the standard clamps 2508*a*.

Element 2510 is a standard LD and HD pipe brace with a clip assembly. Element 2512 is a turnbuckle brace with a clip assembly. Pipe brace 2510 can be used to provide support for scaffolding. Turnbuckle brace 2512 can be used to provide support for a formwork panel.

The accessory clip 2514 attaches to the standard clamp and serves as a standard connection for the alignment bar configuration (using alignment bar 2520), personal tie-off point (using Ringlok adaptor 2516), pipe brace attachment (using pipe brace 2510), and lifting bar configuration (using gang lifting configuration 2522). Also illustrated (in FIG. 25E) is a side view 2514*b* of the accessory clip 2514*a*.

When used as a personal tie-off point, Ringlok adaptor 2516 can be attached to inner rails of the formwork panels. Scaffold assembly 2524 includes a pin-lock scaffold bracket and post 2523 and includes a Ringlok adaptor 2516, Ringlok leg material 2517 and two standard clamps 2508 coupled to the pin-lock scaffold bracket and post 2523. Also illustrated (in FIG. 25E) is a side view 2516*b* of the Ringlok adaptor 2516*b*.

Standard adjustable shear wall bracket 2526 is used to support the weight of the form panels and fillers in a shear wall or exterior wall condition.

A dry tie or hold down bracket 2528 is included in FIG. 25K. This element is further described below with respect to FIGS. 54A-54C and FIGS. 55A-55B.

A self-sealing tie and color-coded insert system 2530 is included in FIGS. 25A-25W. The various elements of the self-sealing tie and color-coded insert system 2530 are further described below with respect to FIGS. 33A-34U and 36A-42.

An outside corner bracket configuration 2534 is also shown in FIG. 25A-25W. This outside corner bracket 2546 is used to attach to formwork panels 2536, 2538 in a corner configuration. The outside corner bracket can be adjusted in 1" increments along one of the formwork panels in the corner configuration. The outside corner bracket can be adjusted up to 1', e.g., 3" to 15", when a 2' panel is used and up to 2', e.g., 15" to 27", when a 3' panel is used.

Figure 26A:
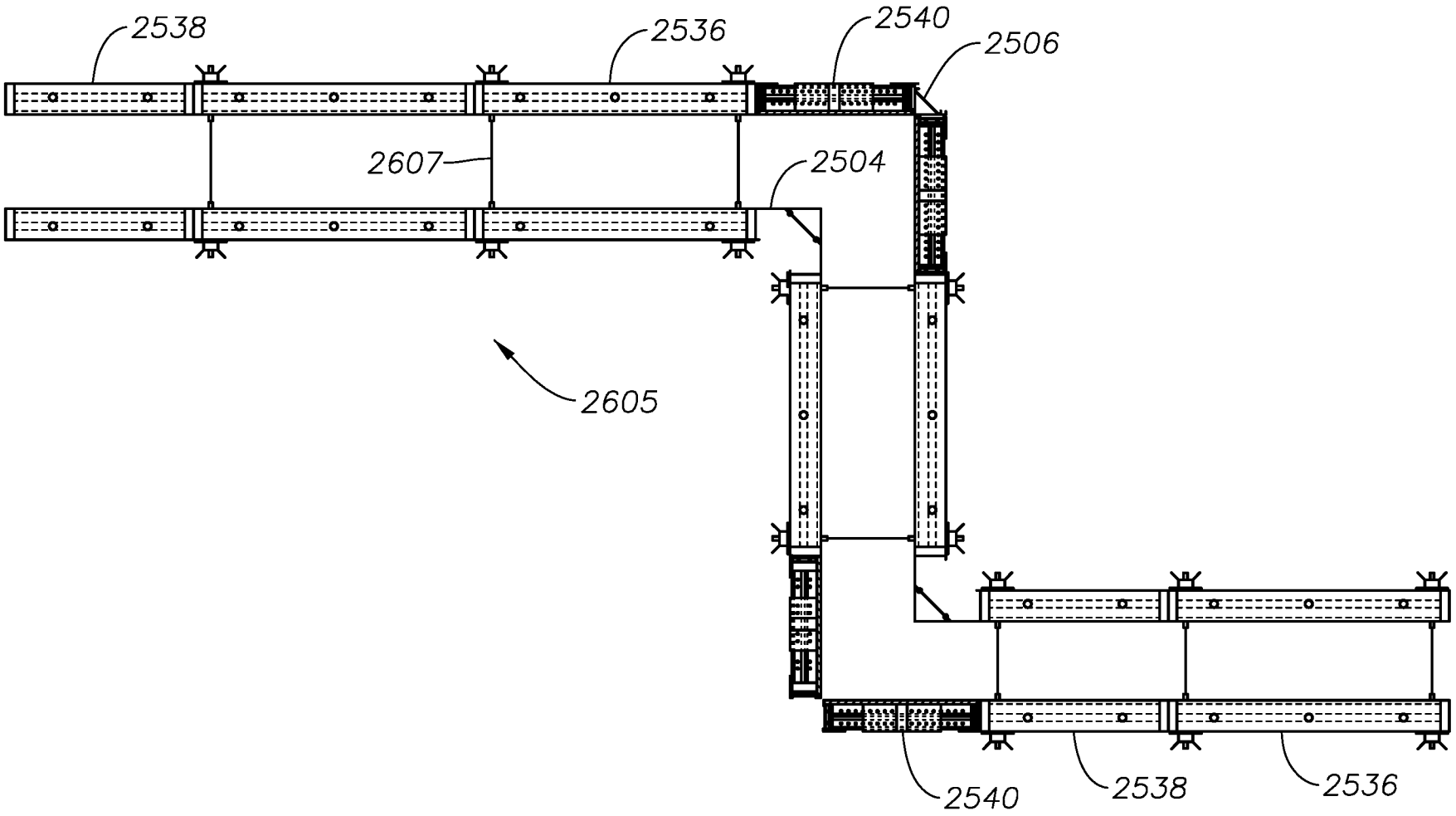
FIGS. 26A-26E show a top view of wall and corner plan details of the present formwork system in accordance with implementations of various techniques described herein.
Figure 26C:
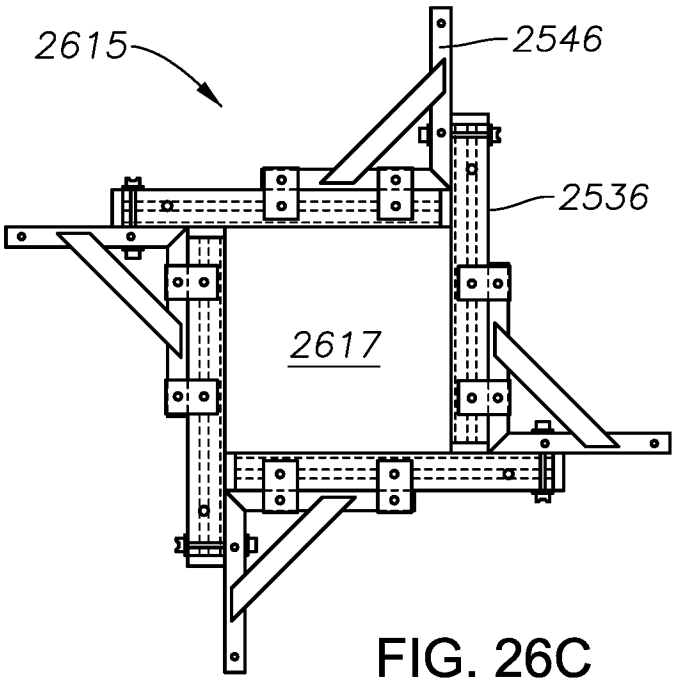
Figure 26E:
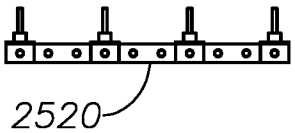
Figure 26B:
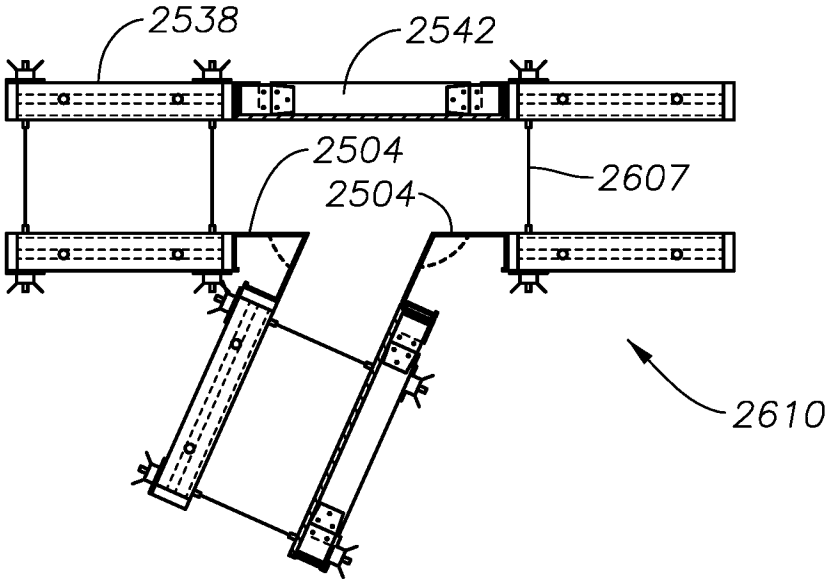
Figure 26D:
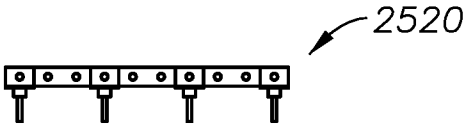

FIGS. 26A-26E show a top view of wall and corner plan details of the present formwork system. Also shown is an alignment bar configuration 2520 that can be used to provide additional support for the panels. Element 2605, illustrated in FIG. 26A, shows a wall detail at an inside corner using standard panels 2536, 2538 and adjustable filler 2540. In addition, tie rod assemblies 2607, standard clamps (not shown), inside corner brackets 2504 and aluminum outside corner brackets 2506 are shown. Element 2610, illustrated in FIG. 26B, shows wall details for an implementation of a variable angle inside corner. The implementation of element 2610 uses lumber filler 2542 in addition to standard panel 2538; however, other implementations may include adjustable filler, lumber filler and/or standard panels. Element 2615, illustrated in FIG. 26C, shows details for a column 2617 using standard panels 2536 and outside windmill corner brackets 2546.

Figure 27:
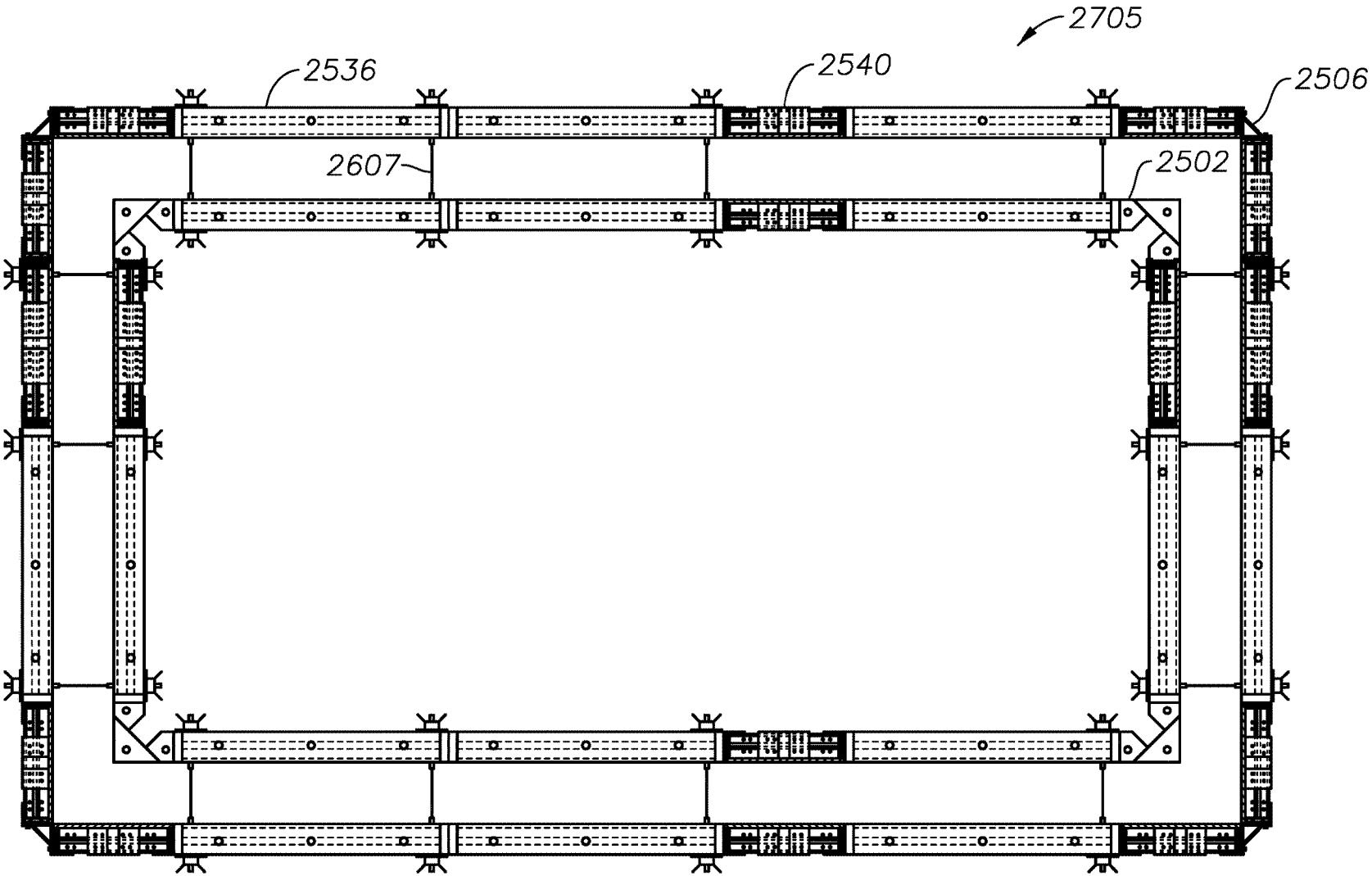
FIG. 27 shows a top view of a rectangular core wall configuration in accordance with implementations of various techniques described herein.

FIG. 27 shows a top view of a rectangular core wall configuration 2705. This particular configuration 2705 is achieved using standard panels 2536, adjustable fillers 2540, tie rod assemblies 2607, inside stripping corners 2502 and outside hinged corners 2506.

Figure 28A:
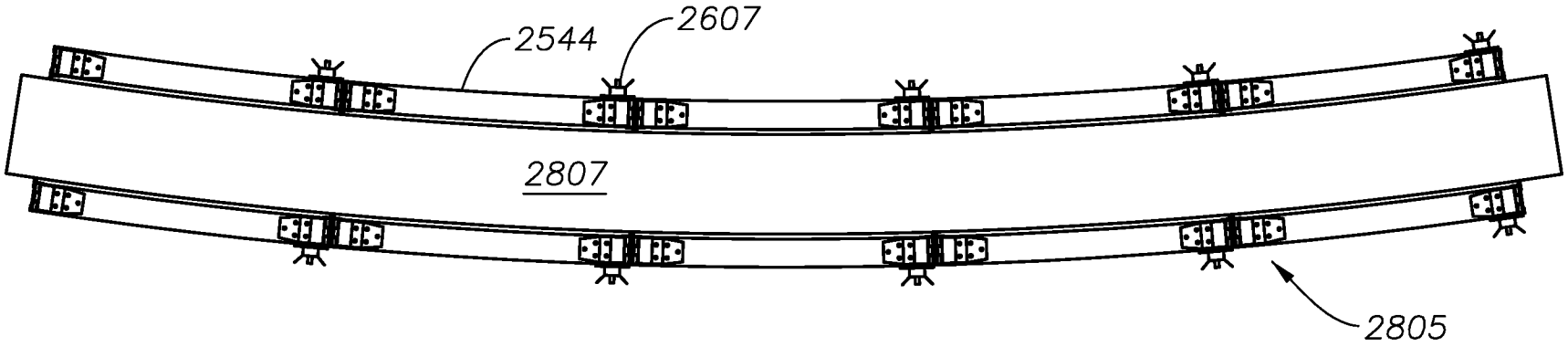
FIGS. 28A-28C show various wall plans that provide arc and circular configurations in accordance with implementations of various techniques described herein.
Figure 28C:
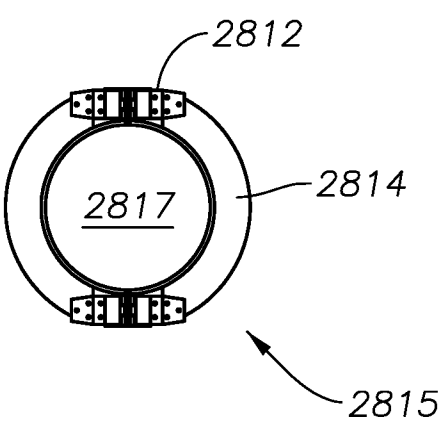
Figure 28B:
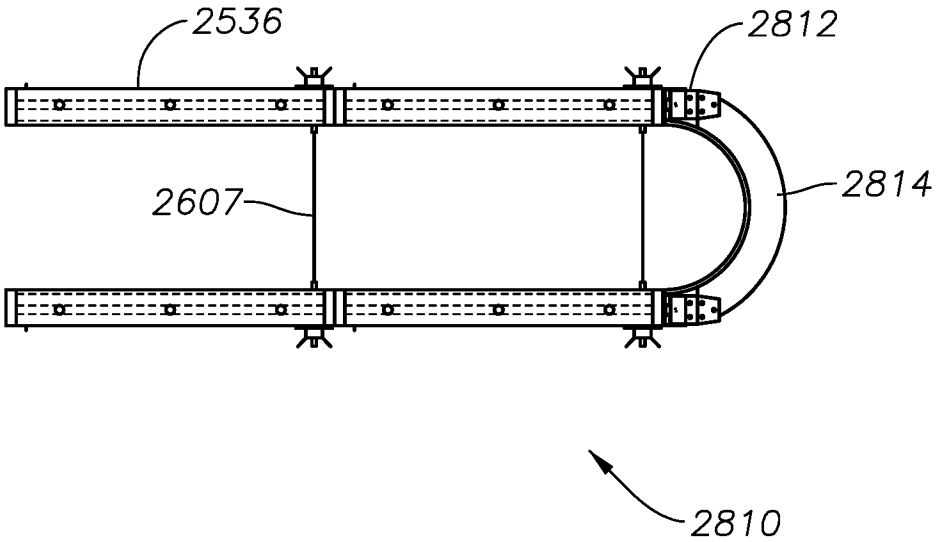

FIGS. 28A-28C show various wall plans that provide arc and circular configurations. Element 2805, shown in FIG. 28A, illustrates an implementation that provides a large diameter tank or serpentine walls 2807 provided using lumber filler forms 2544, tie rod assemblies 2607 and standard clamps (not shown). Element 2810, illustrated in FIG. 28B, shows standard panels 2536 with an arc shaped or rounded nose 2814 that is provided using standard panels 2536 and tie rod assemblies 2607, a lumber filler form 2814, lumber clips 2812 and standard clamps (not shown). Element 2815, illustrated in FIG. 28C, shows a circular column 2817 provided using lumber filler forms 2814, lumber clips 2812 and standard clamps (not shown).

Figure 29B:
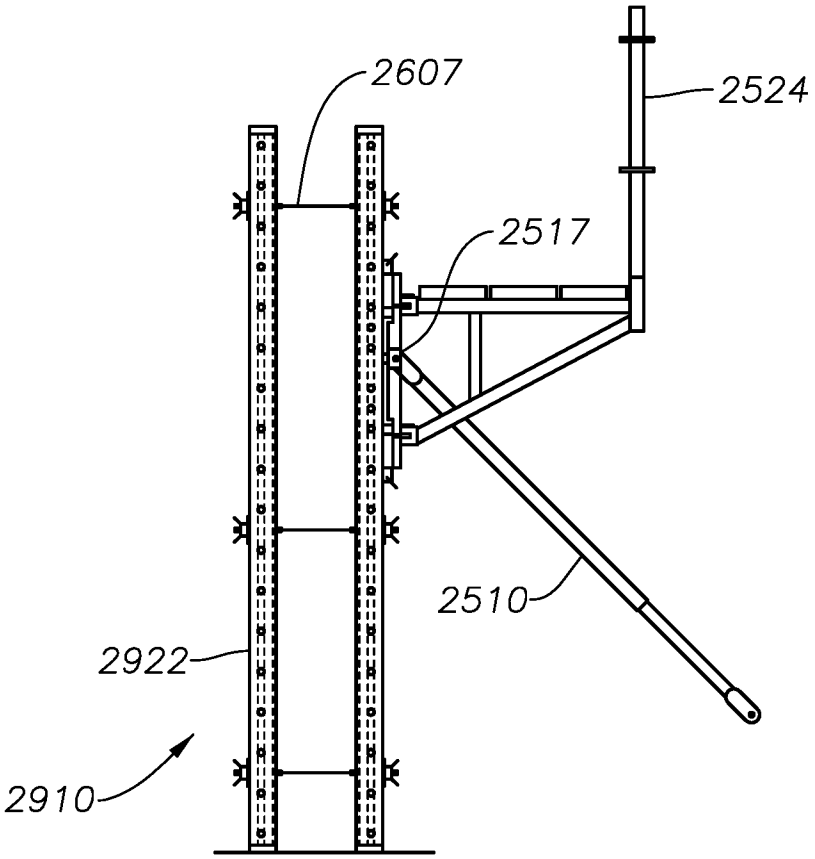
FIGS. 29A-29G show side views of various wall configurations in accordance with implementations of various techniques described herein.
Figure 29A:
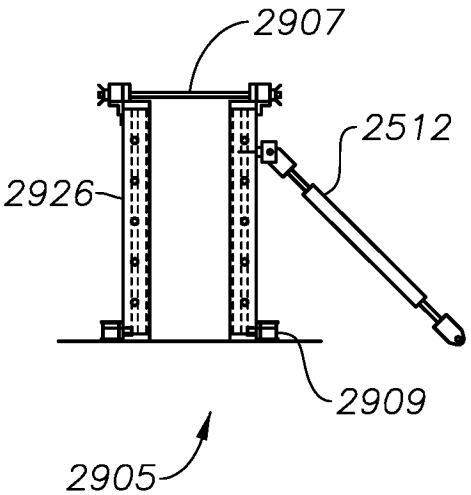
Figure 29G:
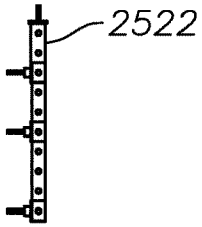
Figure 29F:
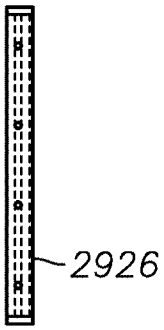
Figure 29E:
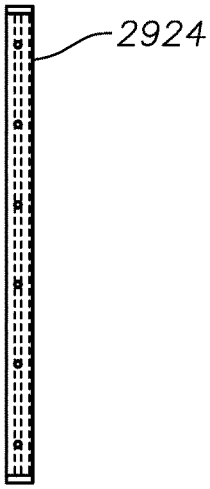
Figure 29D:
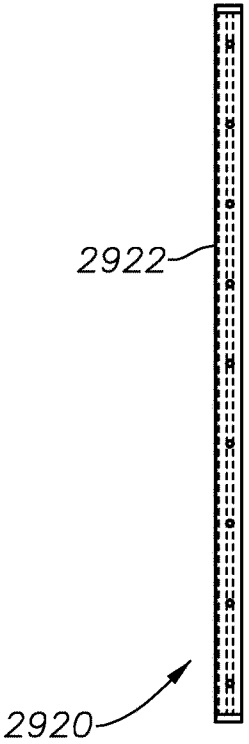
Figure 29C:
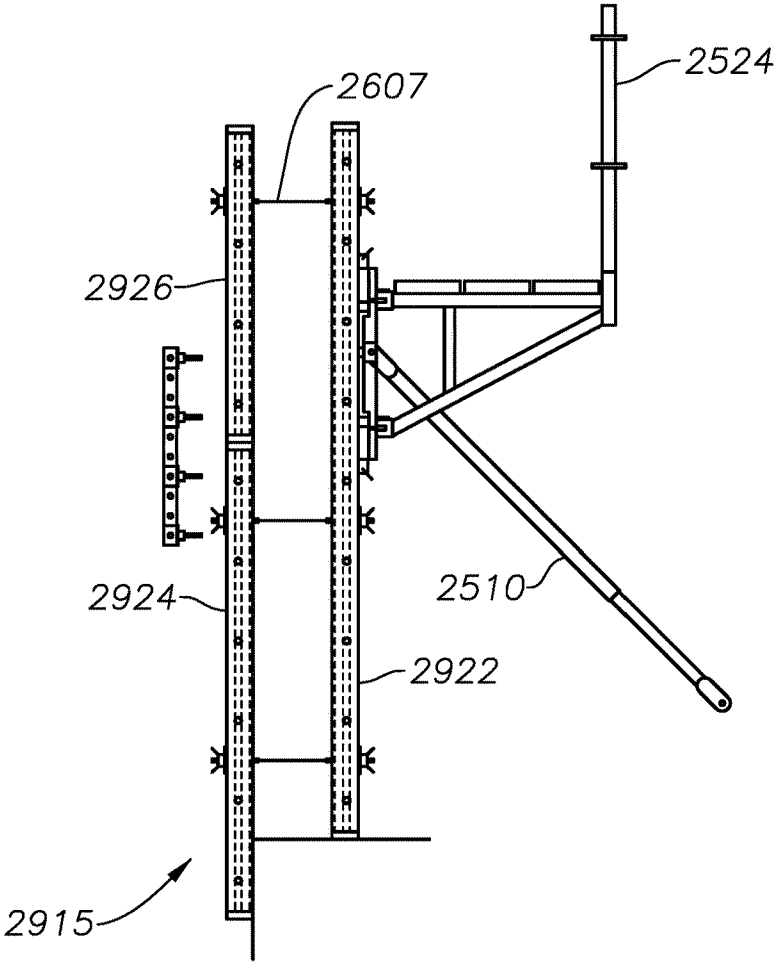
Figure 30A:
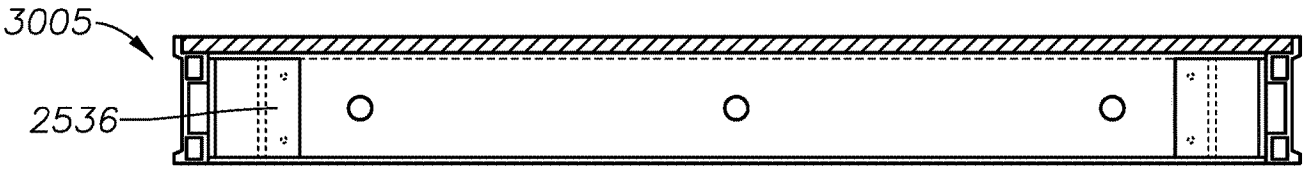
FIGS. 30A-30D illustrate standard panel assembly plan views in accordance with implementations of various techniques described herein.
Figure 30B:
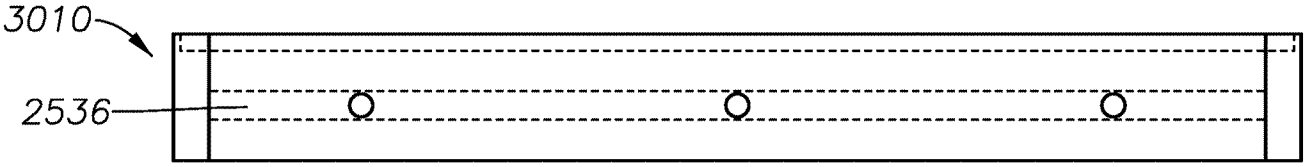
Figure 30C:
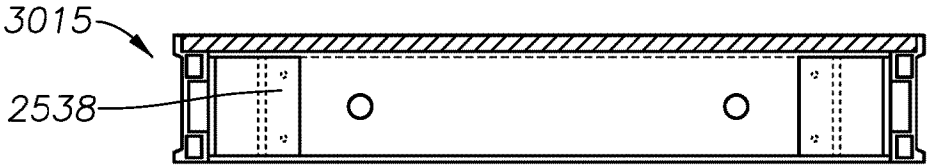
Figure 30D:
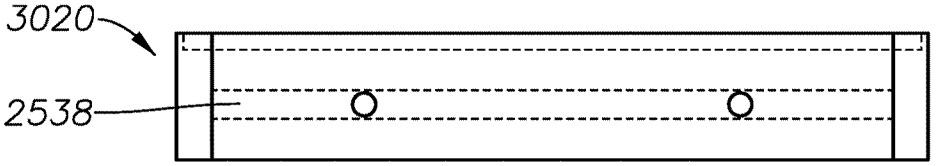

FIGS. 29A-29F show side views of various wall configurations. As stated previously, standard panels can be 2' or 3' in width. Each standard panel 2536, 2538 of width 2' or 3' can have a panel length of 3', 6', or 9' as shown in panels 2926, 2924, 2922, respectively. Element 2905, shown in FIG. 29A, illustrates short panel walls 2926, e.g., 3' or 4', supported by a dry tie 2907 on a top portion and a hold down or tie assembly 2909 on a bottom portion. Additionally, in element 2905, bracing 2512 is shown. Element 2910, shown in FIG. 29B, illustrates tall panel walls 2922 supported by three tie assemblies 2607 or dry ties. Element 2910 also shows a standard scaffold 2524 attached to the tall panel walls 2922 using a scaffold bracket adaptor 2517 and secured with a pipe brace assembly 2510. Element 2915, shown in FIG. 29C, illustrates a vertical panel shear condition where panels 2922, 2924, 2926 having different lengths, e.g., 3', 6' and 9', are used. This type of configuration, i.e., using unequal heights for the formwork, is made possible because the formwork uses standardized tie hole locations. Element 2915 also includes the scaffolding described in element 2910. Element 2920, illustrated in FIG. 29D, shows typical panel heights (9' (panel 2922), 6' (panel 2924) and 4' (panel 2926)) for the formwork system. In addition, a gang lifting configuration 2522 is shown. The gang lifting configuration 2522 is used to move one or more panels, for example, with a crane or some other lifting/moving apparatus.

FIG. 30A-30D illustrate standard panel assembly plan views. Top/bottom 3010, 3020 and cutaway views 3005, 3015 are shown for both 3 ft (panel 2536) and 2 ft (panel 2538) panel widths.

Figure 31C:
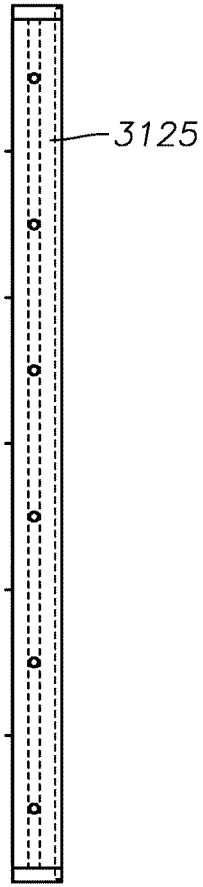
FIGS. 31A-31E illustrate elevational views of the standard panel assembly in accordance with implementations of various techniques described herein.
Figure 31B:
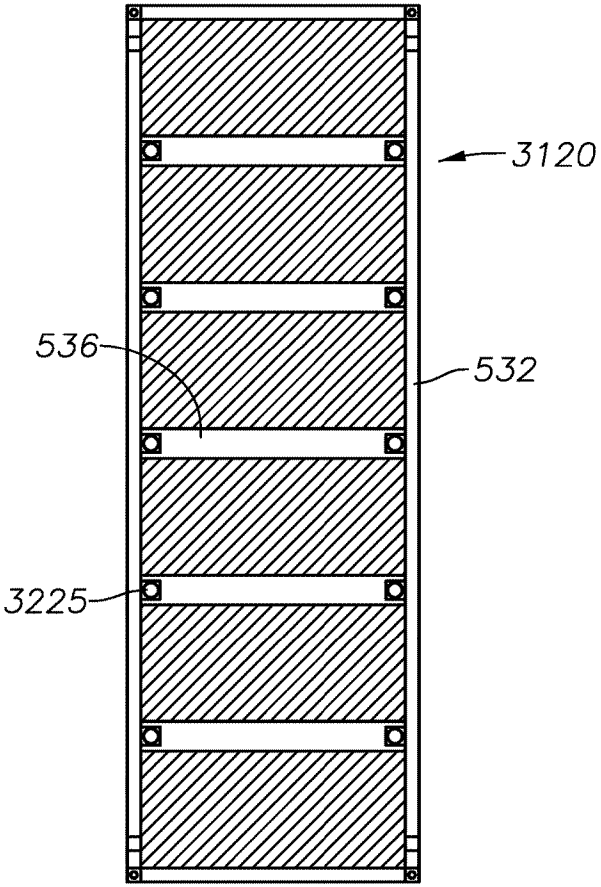
Figure 31E:
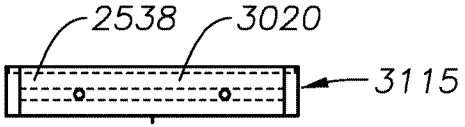
Figure 31A:
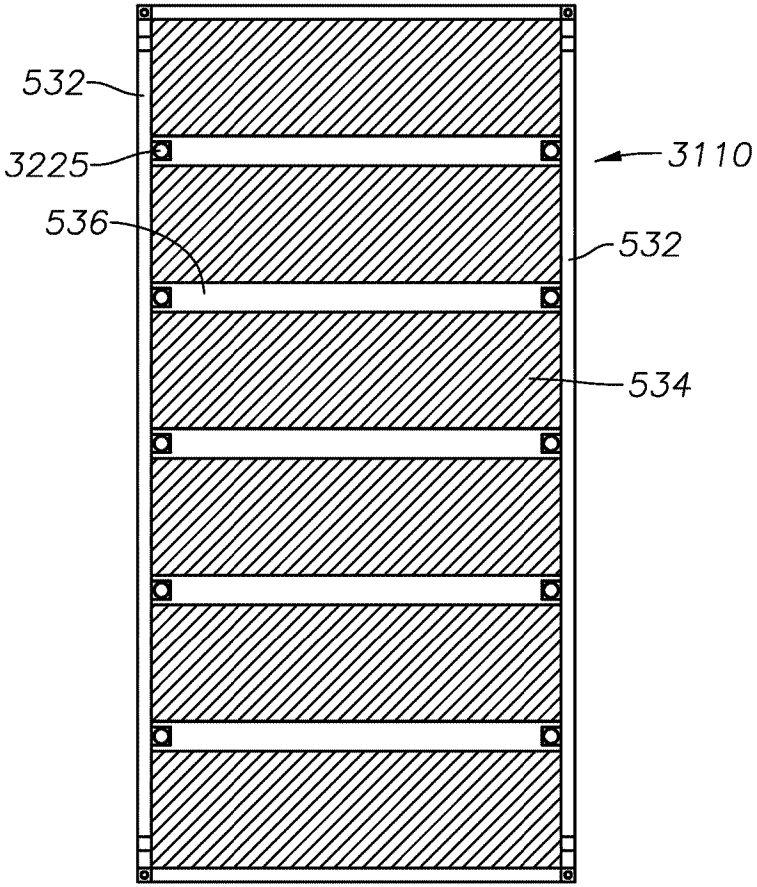
Figure 31D:
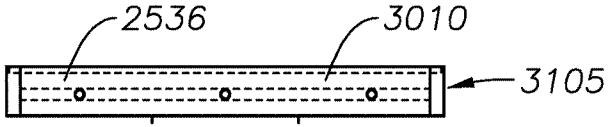

FIG. 31A-31E illustrate elevational views 3110, 3120 of the standard panel assembly for 2' (panel 2538) and 3' (panel 2536) widths. FIGS. 31D, 31E and 31C, respectively, illustrate top/bottom 3105, 3115 and side elevational 3125 views of panels 2536, 2538 are also shown. Standard panels 2536, 2538 include side rails 532, inner rails 536 and tie extrusion 3225.

Figure 32D:
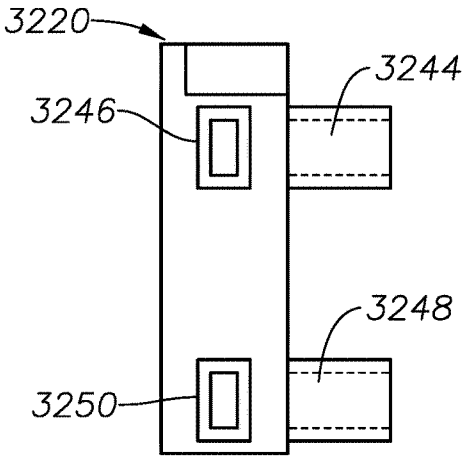
FIGS. 32A-32G illustrate views of a side rail extrusion, an interior rail extrusion, a corner casting and a tie extrusion in accordance with implementations of various techniques described herein.
Figure 32C:
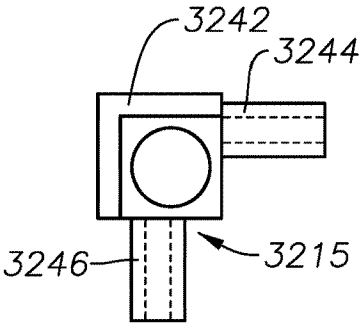
Figure 32B:
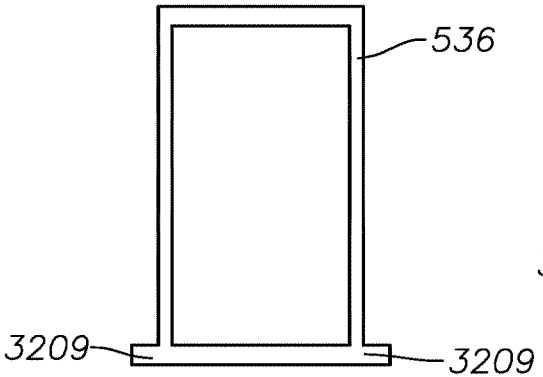
Figure 32A:
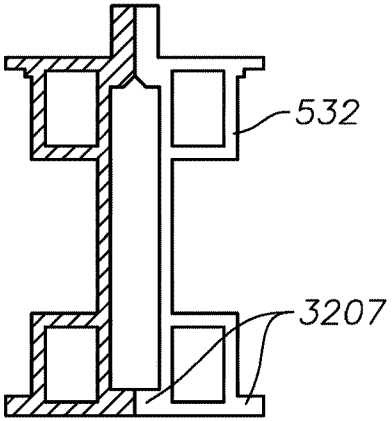

FIGS. 32A-32G illustrate views of a side rail extrusion 532, an interior rail extrusion 536, a p 3242 and a tie extrusion 3225. Item 3215, illustrated in FIG. 32C, shows a top view of corner casting 3242. Item 3220, illustrated in FIG. 32D, shows an elevational side view of corner casting 3242. Corner casting includes arms 3244, 3246, 3248, 3250. The inside rail extrusions (interior rail extrusions 536) can be coupled to side rail extrusions 532 and/or press fit with arms 3244, 3246, 3248, 3250 of corner castings 3225 to together make up part of the assembly for the formwork panels. It should be noted that when two side rails 532 are placed (as shown) back to back, they form the same basic shape as the inner rail 536. Having the same basic shape makes the connection of a standard clamp identical in both the vertical and horizontal positions. The standard clamp is described further in Figured 48A-48E. The flange design 3207, 3209 on the inner & side rails 532, 536 help to increase the pull away capacity of the standard clamp 2508*a*, which is useful since the standard clamp 2508*a* is used to attach all of the accessories. The use of the standard clamp 2508*a* to attach all of the accessories is unique to this formwork system.

Figure 32G:
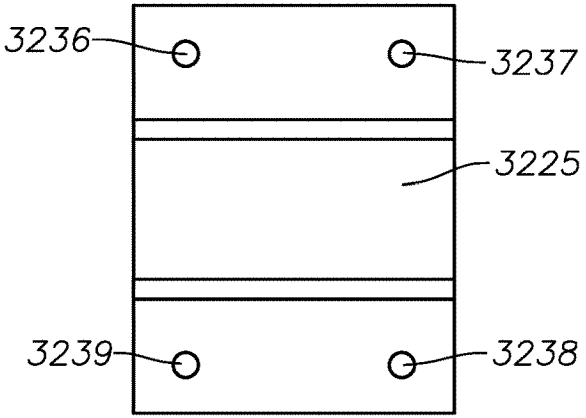
Figure 32F:
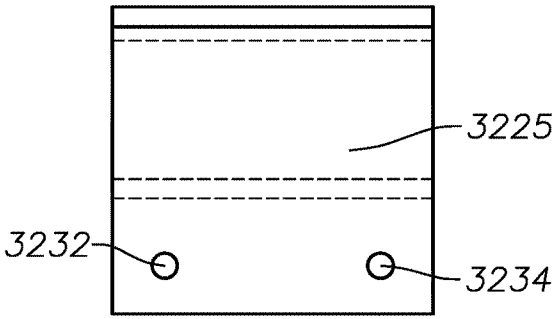
Figure 32E:
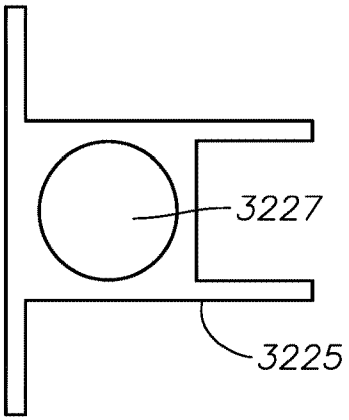

Different views of the tie extrusion 3225 are shown in FIG. 32E-32G. Tie extrusion 3225 has an opening 3227 for a tie rod. Openings 3232, 3234 of tie extrusion 3225 are used to attach the tie extrusion 3225 to the interior rail extrusion 536. Openings 3236, 3237, 3238, 3239 are used to attach the tie extrusion to the side rail extrusion.

Figure 33A:
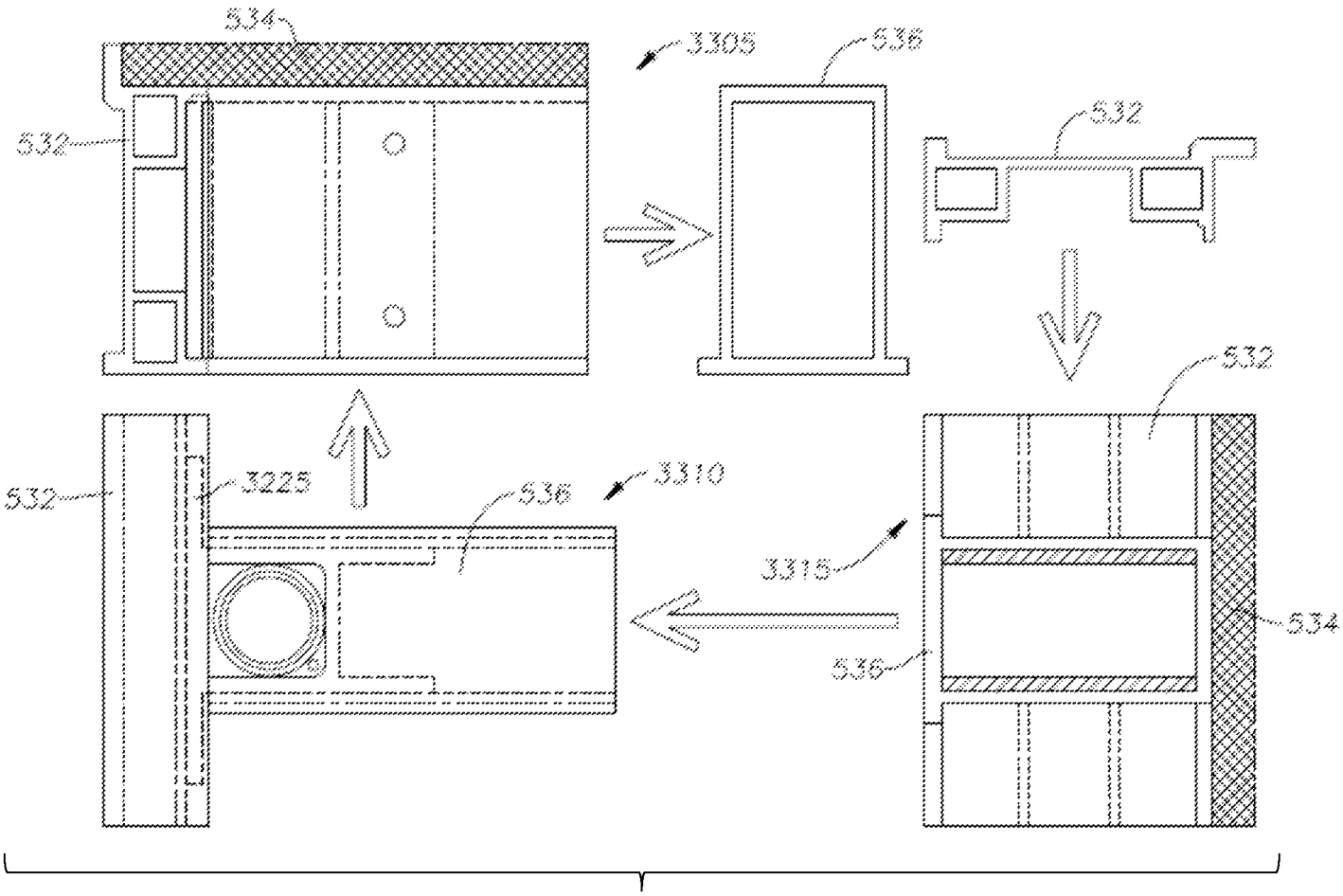

FIG. 33A-33D illustrates how a side rail 532, an interior rail 536 and a tie extrusion 3225 fit together in the formwork system. In particular, the views of FIG. 33A-33D show back side views of the formwork system. Element 3305, illustrated in FIG. 33A, shows a top cutaway view of the formwork system. Element 3310 shows a side view of the formwork system. In this view, side rail 532, interior rail 536 and the tie extrusion 3225 are clearly shown. Different types of tie port inserts 3311, 3312, 3313 may be used within tie extrusion 3225. These tie port inserts are discussed further in FIG. 38. Element 3315 shows a vertical cutaway view of a portion of the formwork system. This view shows the interior rail 536 in further detail along with tie extrusion 3225 and side rail 532.

Figure 34R:
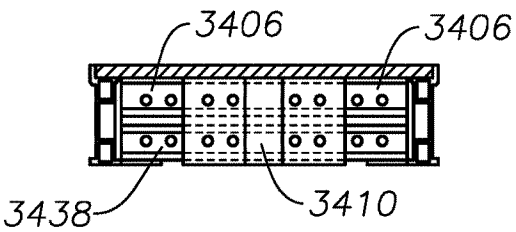
FIGS. 34A-34U illustrate filler assembly plan views in accordance with implementations of various techniques described herein.
Figure 34S:
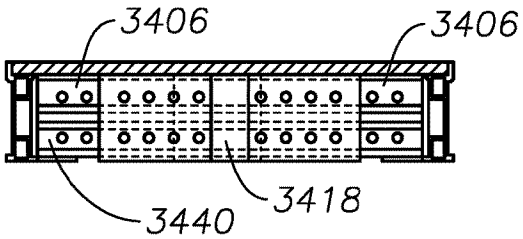
Figure 34U:
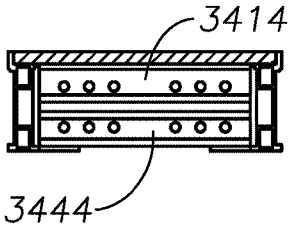

FIGS. 34A-34U illustrates filler assembly plan views. FIGS. 34A-34U show plan views of different configurations for adjustable fillers and lumber filler including any necessary extrusions, clips, inside splices and outside splices. Configurations for adjustable fillers may include combinations of adjustable filler assembly components 3406, 3410, 3414, 3418, 3422*a*. Using these adjustable fillers provides greater flexibility and reduces the need for field fitted lumber shimming in the formwork system. Using the adjustable filler assembly components provides the ability to incrementally adjust the filler. Tie locations can be placed in panels having adjustable or lumber fillers. Straight or curved lumber fillers of varying sizes can still be used when necessary, however, through the use of the adjustable filler, the need for lumber filler is greatly reduced in the present formwork system. Configurations for lumber filler may include filler side rails 3422 and clips 3424*a*, 3424*b*, 3425, 3426*a* for curved 3402 and straight 3404 lumber inner rails.

Filler side rails 3422*a* can be used in both lumber and adjustable filler configurations. An opposing end 3422*b* of filler side rail 3422*a* is illustrated in FIG. 34K. Filler side rails can be 4', 6', or 9' in height. Filler side rails can be attached to inside splices 3406, 3414. Inside splices 3406, 3414 can be 5½ inches or 8½ inches long. FIGS. 34D and 34E illustrate elements 3408 and 3416, which are side views of inside splices 3406 and 3414, respectively. Filler side rails can also be attached to lumber inner rail clip 3426*a*. FIG. 34M illustrates element 3426*b*, which is a side view of lumber inner rail clip 3426*a*. Left and right edge clips 3424*a*, 3424*b* are used to attach to adjacent filler side rails at top and bottom. Further details regarding the edge clips 3424*a*, 3424*b* are described below in FIG. 37A-37F. Outside splices 3410, 3418 can be attached to inside splices 3406, 3414. Outside splices can be 6½ or 10½ inches long. FIGS. 34F and 34J illustrates elements 3412 and 3420, which are side views of outside splices 3410 and 3418, respectively. The "U" connector 3430 is used to connect various components. In one implementation, the "U" connector is used to attach the splices together and to attach the adjustable or lumber rail to the filler side rail. Further details regarding "U" connector connections are described below in FIGS. 36A-36D and 37A-37F.

FIG. 34A illustrates element 3402, which is a configuration having filler side rails 3422*a* with lumber clips 3426*a* and radius cut lumber 3448. FIG. 34B illustrates element 3404, which is a configuration having filler side rails 3422*a* with lumber clips 3426*a* and sized or straight lumber 3450.

Figure 34T:
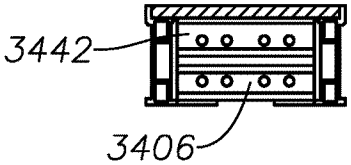
Figure 34O:
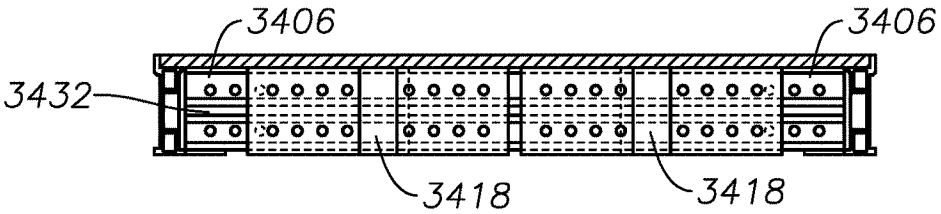

FIG. 34O illustrates element 3432, which is a configuration having two 10½ inch outside splices and three 8½ inch inside splices. This configuration is adjustable from 29 to 43 inches in one inch increments.

Figure 34P:
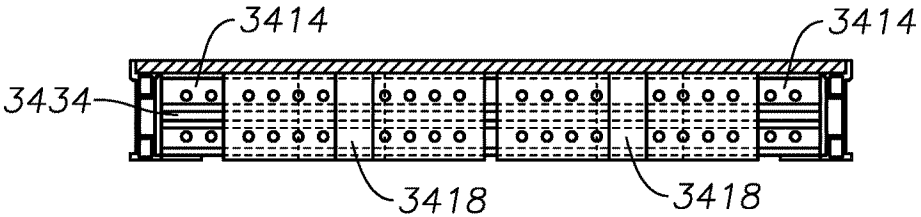

FIG. 34P illustrates element 3434, which is a configuration having one 8½ inch inside splice, two 5½ inch inside splices and one 10½ inch outside splice. This configuration is adjustable from 29 to 37 inches in one inch increments.

Figure 34Q:
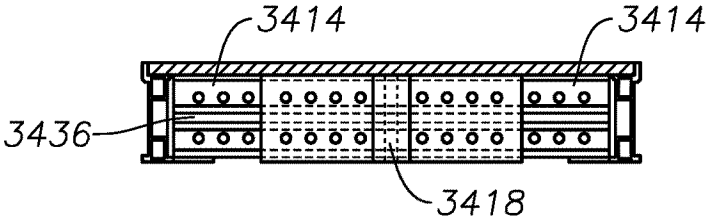
Figures 35A, 35B, 35C, 35D, 35E, 35F, 35G, 35H, 35I:
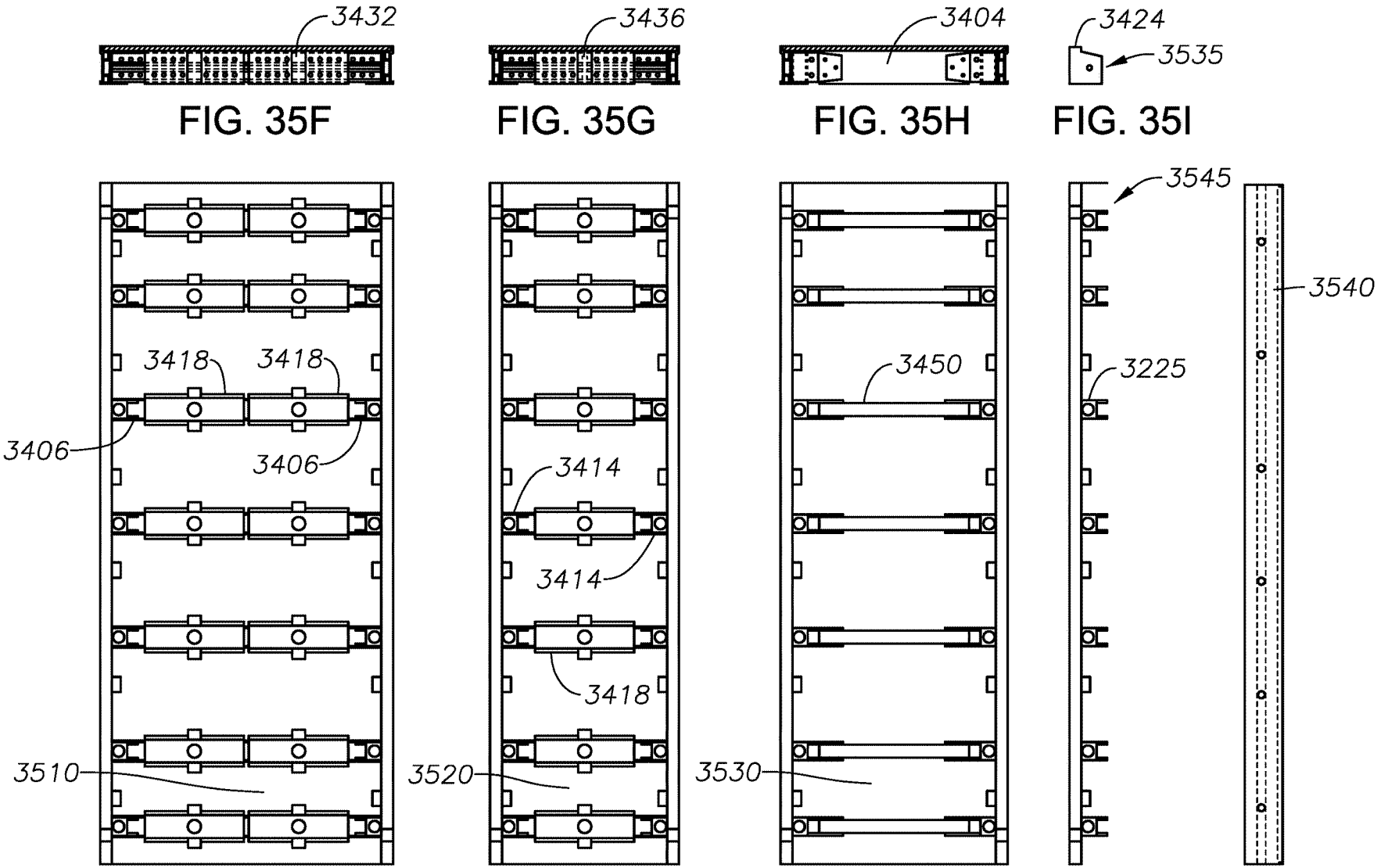
FIGS. 35A-35I illustrate lumber and adjustable fillers in accordance with implementations of various techniques described herein.
Figure 36C:
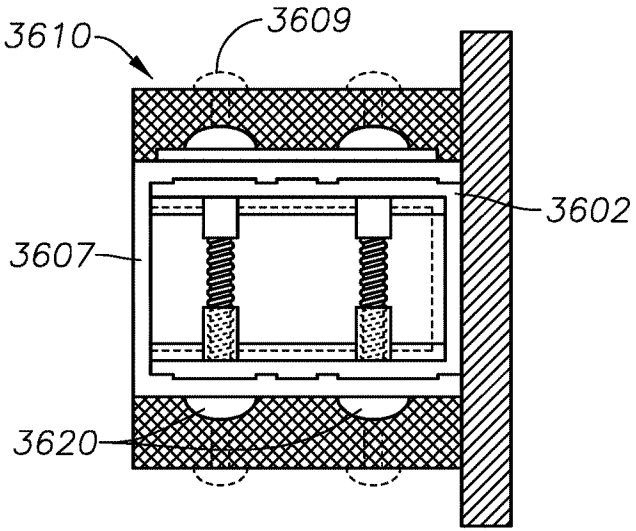
FIGS. 36A-36D illustrate adjustable filler splice extrusions in accordance with implementations of various techniques described herein.
Figure 36D:
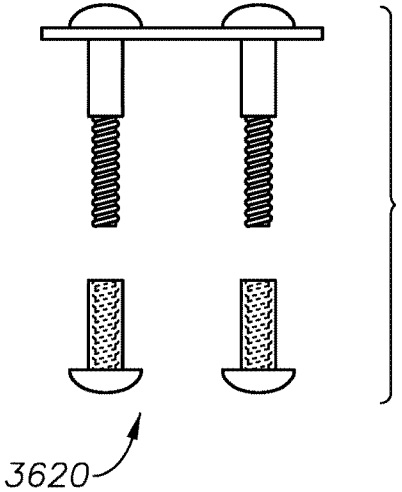
Figure 36A:
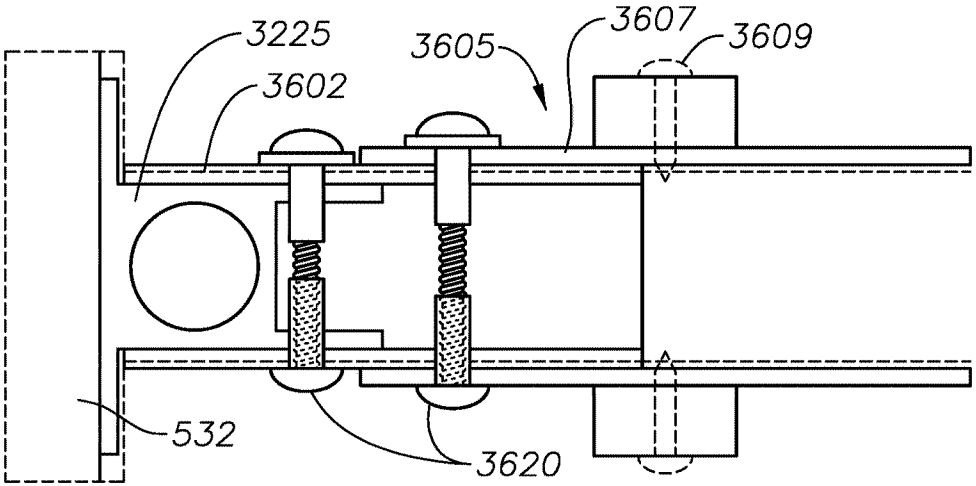
Figure 36B:
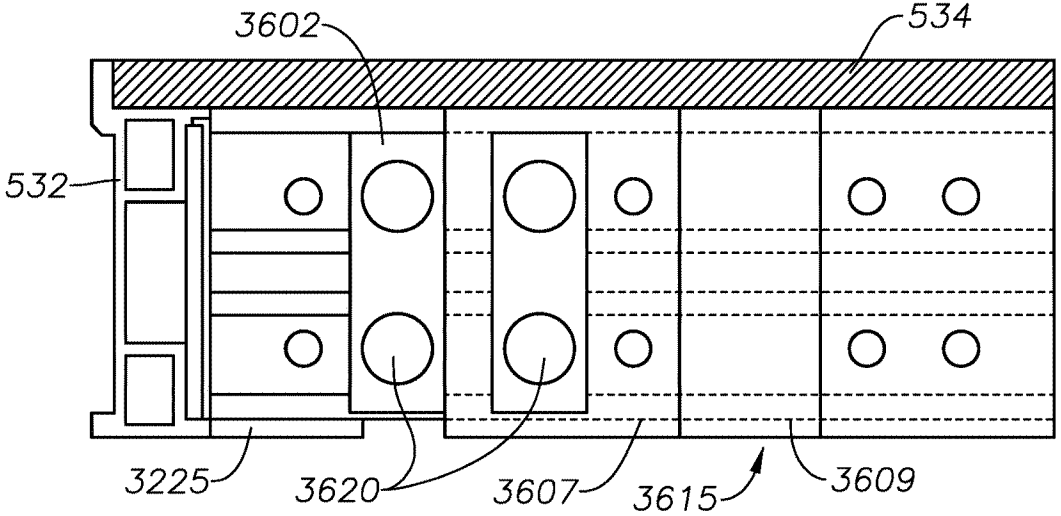

FIG. 34Q illustrates element 3436, which is a configuration having two 8½ inch inside splices and one 10½ inch outside splice. This configuration is adjustable from 20 to 28 inches in one inch increments.

FIG. 34R illustrates element 3438, which is a configuration having two 5½ inch inside splices and one 6½ inch outside splice. This configuration is adjustable from 14 to 18 inches in one inch increments.

FIG. 34S illustrates element 3440, which is a configuration having two 5½ inch inside splices and one 10½ inch outside splice. This configuration is adjustable from 18 to 22 inches in one inch increments.

FIG. 34T illustrates element 3442, which is a configuration that includes a single 5½ inch inside splice. This configuration is adjustable from 8 to 10 inches in 1 inch increments.

FIG. 34U illustrates element 3444, which is a configuration that includes a single 8½ inch inside splice. This configuration is adjustable from 11 to 13 inches in one inch increments.

FIG. 35A-35I illustrate lumber and adjustable fillers. Top/bottom views of adjustable filler 3432 and adjustable filler 3436 are shown. Adjustable fillers 3432 and 3436 have different adjustable filler widths. A top/bottom view of lumber filler 3404 is shown. Also shown are top/bottom 3535 and elevational side 3545 and end 3540 views of an edge clip 3424. Elevational views of interior rail configurations of variable/adjustable fillers 3510, 3520 and lumber filler 3530 are also shown.

FIGS. 36A-36D illustrate adjustable filler splice extrusions. FIGS. 36A-36D also show how the adjustable filler splice extrusions 3602, 3607 are connected, e.g., using "U" connector 3620. Front 3605, side 3610 and top 3615 elevational views show how the adjustable fillers 3602, 3607 are connected to the side rail extrusion 532 and the tie extrusion 3225 using the "U" connectors 3620. The synthetic nailer 3609 is used to fasten the form face 534 material (plywood or synthetic) to the body of the assembled adjustable or lumber filler frame The side rail 532, interior rails 536, corner castings 3242, and tie extrusion 3225 are made of structural grade aluminum. In one implementation, the structural grade aluminum can be 6060-T6 or equivalent.

FIGS. 37A-37F illustrate filler side rail edge fittings and lumber inner rail fittings and details. In particular, a left hand view 3705, illustrated in FIG. 37A, an edge view 3710, illustrated in FIG. 37B, and a right hand 3715 view, illustrated in FIG. 37C, of a filler edge clip 3702 are shown. Also shown are different views 3720 illustrated in FIG. 37E, for coupling a lumber clip 3426 to a side rail 532 and a tie extrusion 3225 and further attaching the lumber clip to a lumber inner rail 3625, for example, using a "U" connector 3620.

Figure 38A:
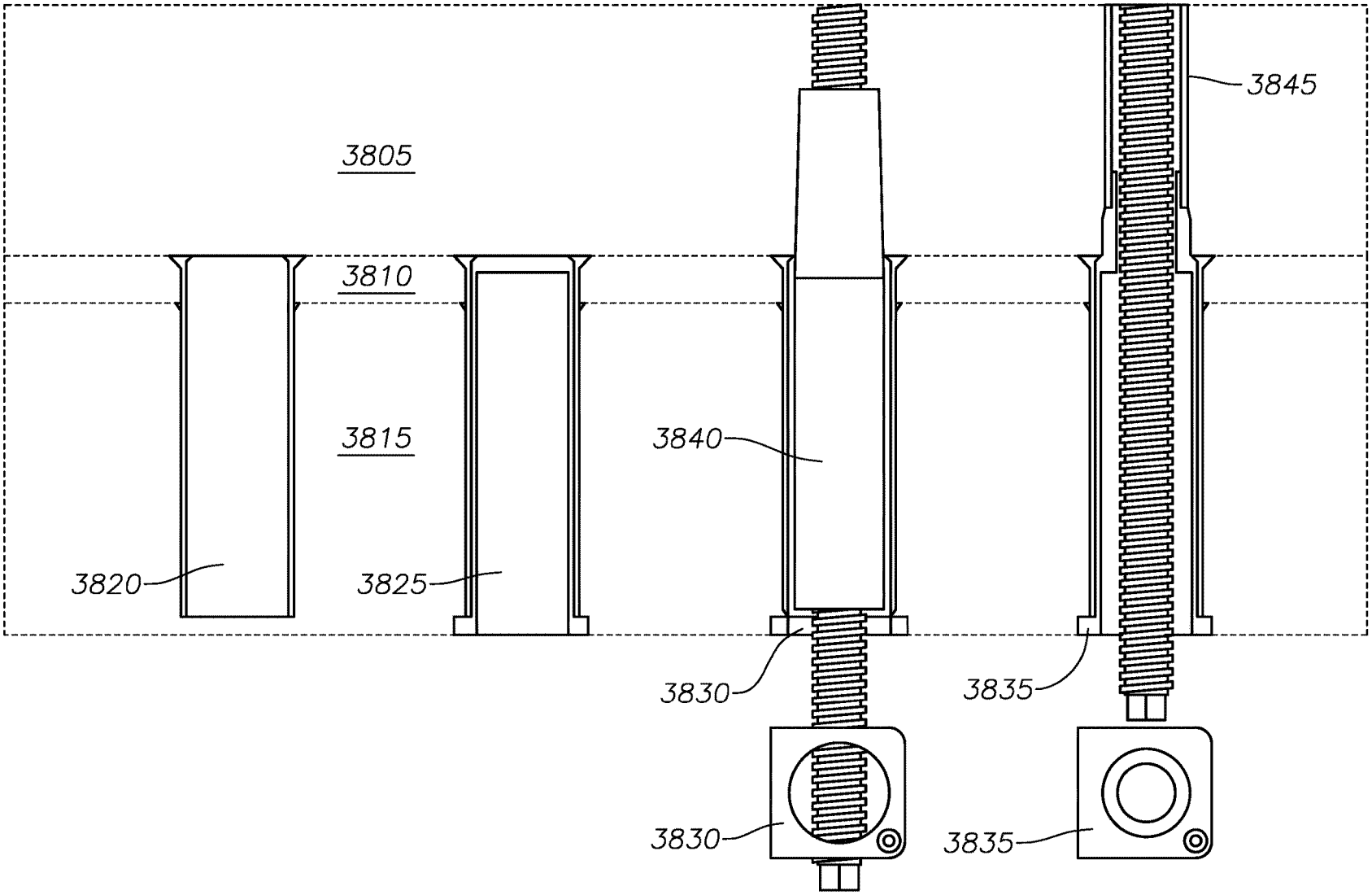
FIGS. 38A-38C illustrate tie port inserts in accordance with implementations of various techniques described herein.
Figure 38B:
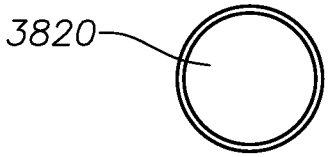
Figure 38C:
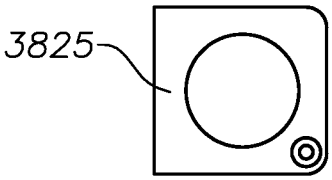

FIGS. 38A-38C illustrate tie port inserts. Tie port inserts can be permanent inserts 3820, plugs 3825, she-bolt tie washers 3830 and cone tie inserts 3835. FIG. 38B-38C show different top cross-sectional configurations for tie port inserts. These views show the tie port inserts projecting through the form frame 3815 and the form facing panel 3810. These views also show poured concrete 3805 adjacent to the form facing panel. A permanent insert 3820 is press-fit into the form frame 3815 and an end of the permanent insert occupies an opening of the form facing panel 3810. Plug insert 3825 fits within permanent insert 3820 and is used to prevent concrete from leaking through the tie ports. She-bolt tie washer 3830 can be used to secure a tie rod passing through a sleeve 3840 passing through permanent insert 3820 and protruding out from form facing panel 3810 into the area for the concrete 3805. Cone tie insert 3835 can be used to pass a tie rod through concrete while keeping the concrete from hardening on a surface of the tie rod. The cone tie insert 3835 is passed through permanent insert 3820 and protrudes out from the form facing panel. A sleeve 3845, e.g., a PVC sleeve, can be attached to the cone tie insert to prevent concrete from coming into contact with the tie rod.

Figure 39:
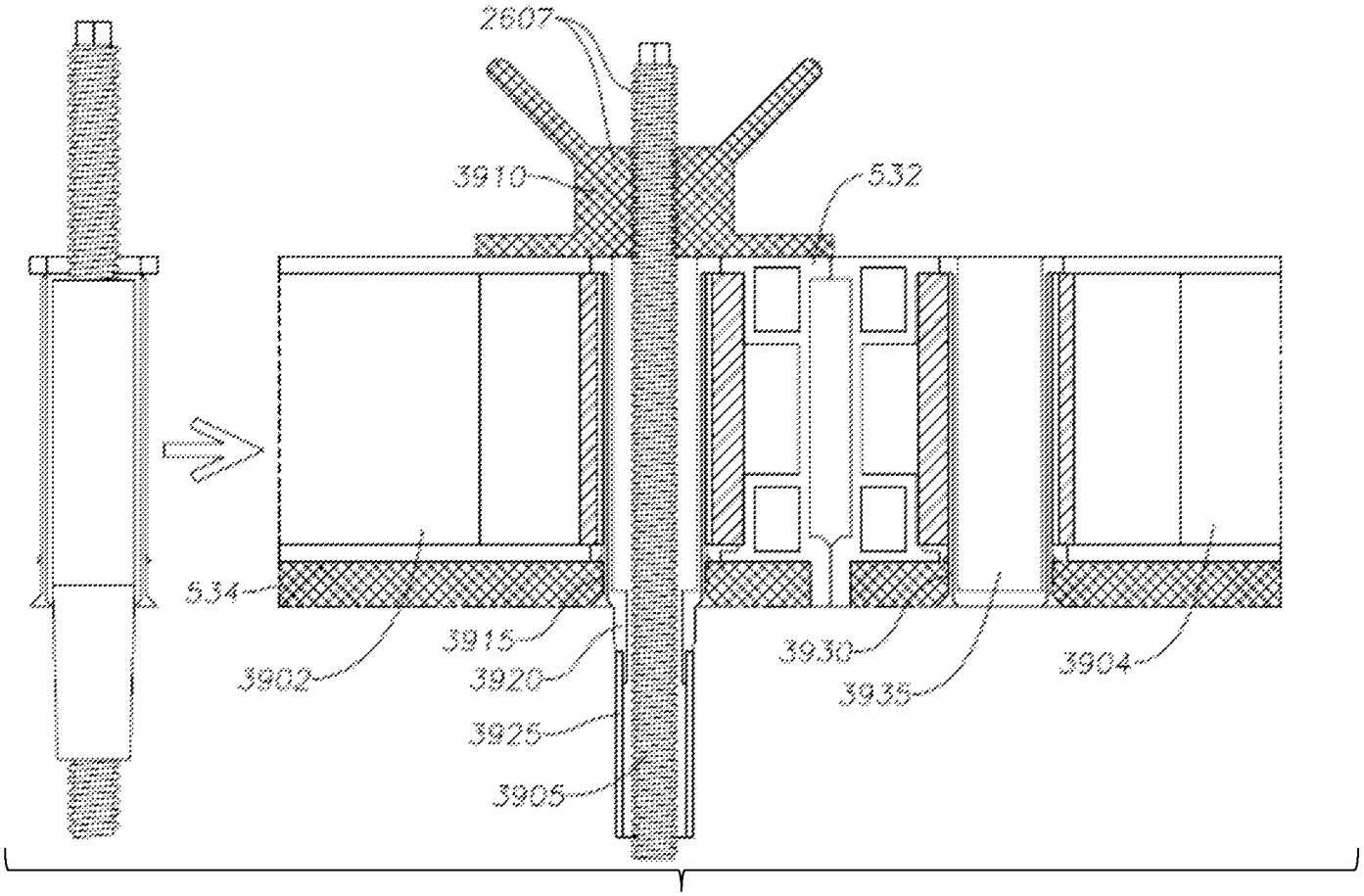
FIG. 39 illustrates a top cross-sectional view of a tie rod assembly in accordance with implementations of various techniques described herein.

FIG. 39 illustrates a top cross-sectional view of a tie rod assembly 2607 at panel 3902. A form face 534 of panel 3902 and a side rail 532 are also shown. The tie assembly includes a tie rod 3905 and a wing nut 3910. The tie rod passes through a permanent insert 3915 and a cone tie insert 3920 inserted into the permanent insert 3915. The tie rod further passes through a PVC sleeve 3925 attached to the tie rod insert. The tie rod is used to tie one panel to an opposing panel. Also shown at panel 3904, which is serially attached to panel 3902, is a plug insert 3935 inserted into permanent insert 3930.

Figure 40:
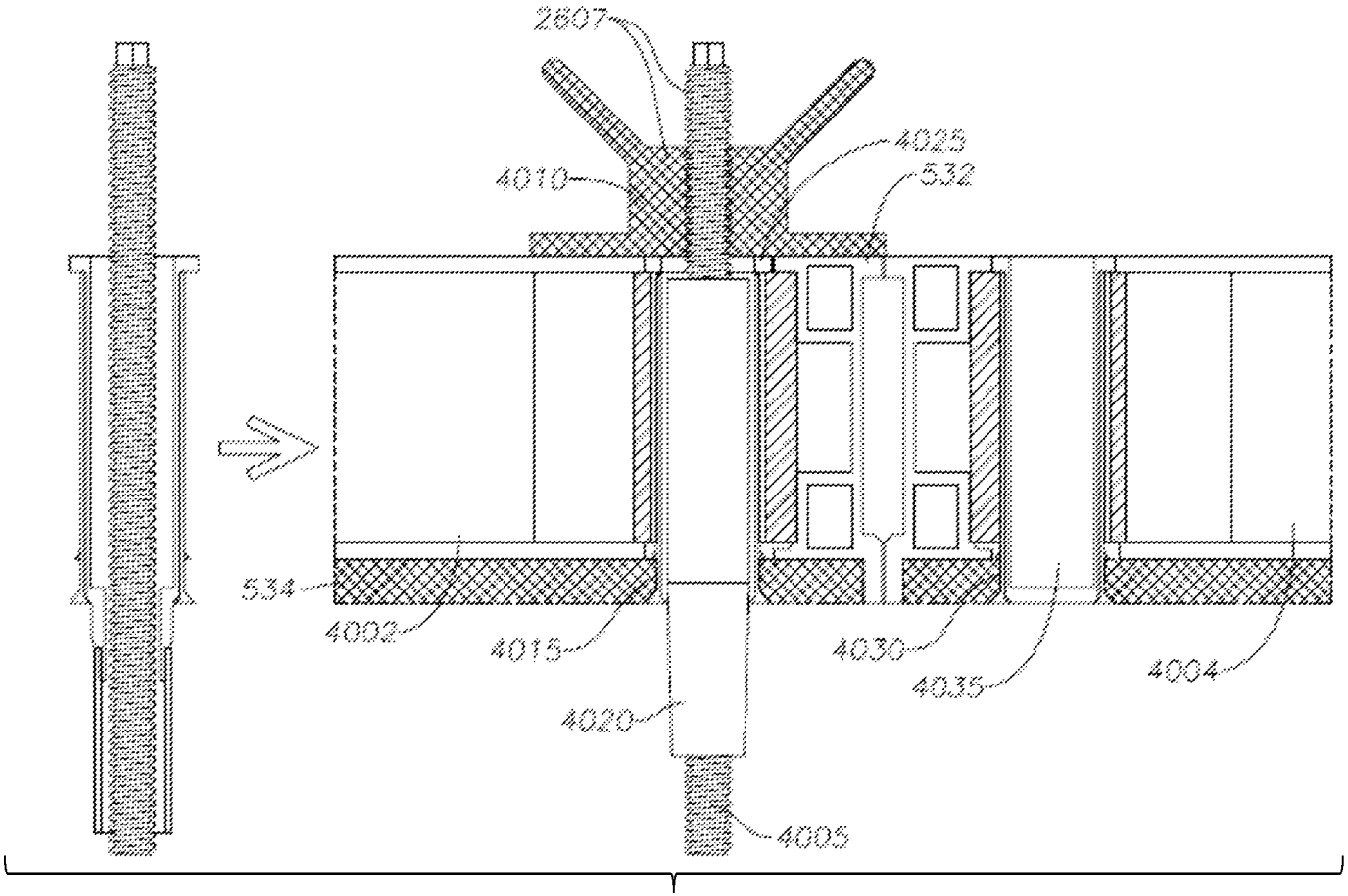
FIG. 40 illustrates a top cross-sectional view of a she bolt and a tie rod assembly in accordance with implementations of various techniques described herein.

FIG. 40 illustrates a top cross-sectional view of a she bolt and a tie rod assembly 2607 at panel 4002. A form face 534 of panel 4002 and a side rail 532 are also shown. The tie rod assembly includes a tie rod 4005, she-bolt 4020 and a wing nut 4010. The tie rod and she-bolt pass through a permanent insert 4015. The tie rod is secured to the panel using she bolt 4020 and wing nut 4010. The tie rod is used to tie one panel to an opposing panel. Also shown at panel 4004, which is serially attached to panel 4002, is a plug insert 4035 inserted into permanent insert 4030.

Figure 41:
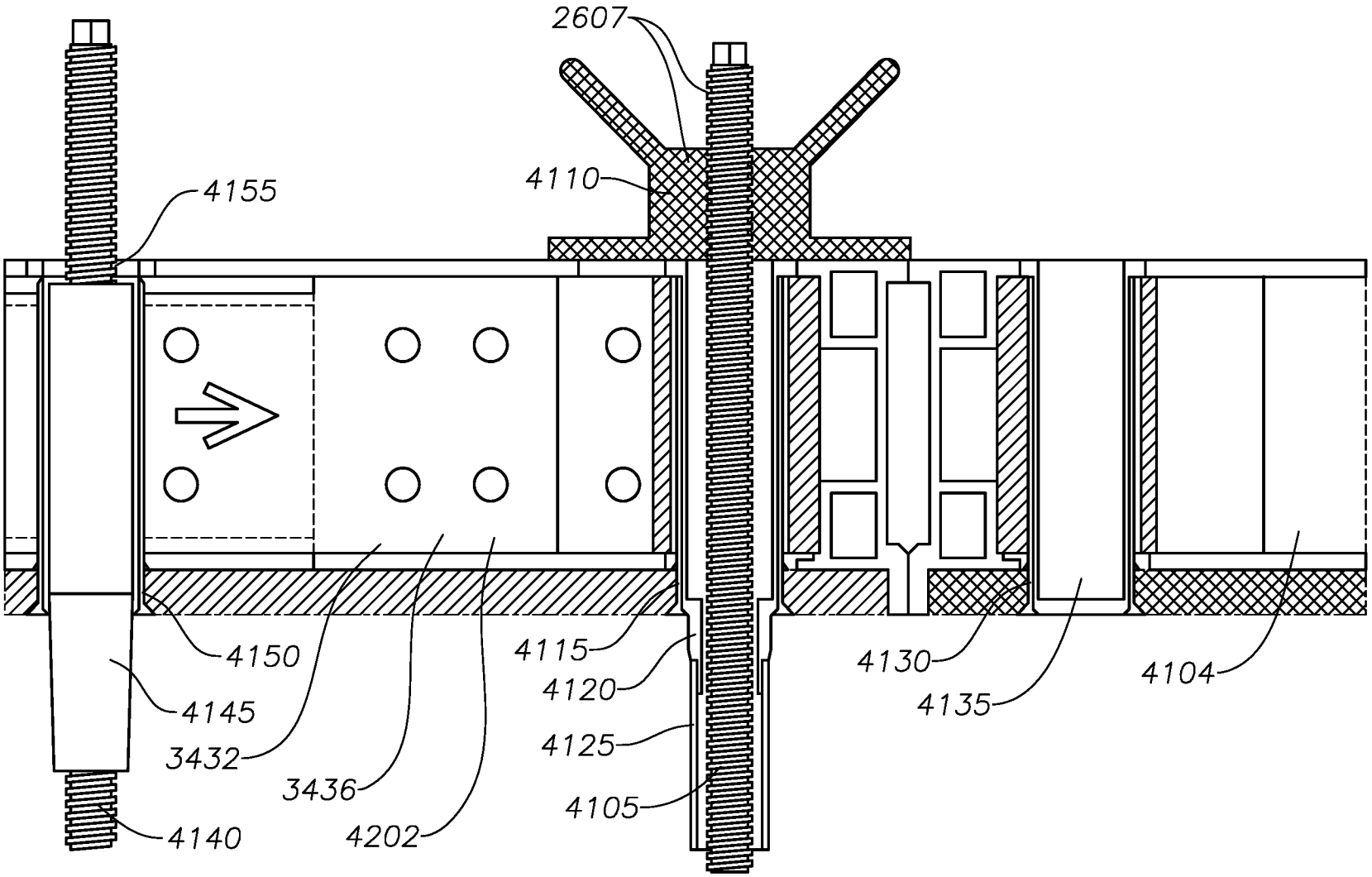
FIG. 41 illustrates a top cutaway view of a tie rod and PVC sleeve in accordance with implementations of various techniques described herein.

FIG. 41 illustrates a top cutaway view of a tie rod and PVC sleeve at adjustable filler panel 4102 (e.g., components 3432, 3436). On one side of the adjustable filler panel 4102, the tie assembly 2607 includes a tie rod 4105 and a wing nut 4110. The tie rod 4105 passes through a permanent insert 4115 and a cone tie insert 4120 inserted into the permanent insert 4115. The tie rod further passes through a PVC sleeve 4125 attached to the cone tie insert 4120. The tie rod is used to tie one panel to an opposing panel.

On another side of adjustable filler panel 4102, illustrates an optional tie assembly showing the tie rod 4140 passes through a permanent insert 4150 and a she-bolt 4145 inserted into the permanent insert 4150. The tie rod 4140 is secured to the panel using she bolt 4145 and a wing nut, not shown. The tie rod is used to tie one panel to an opposing panel. Also shown at panel 4104, which is serially attached to panel 4102, is a plug insert 4135 inserted into permanent insert 4130.

Figure 42:
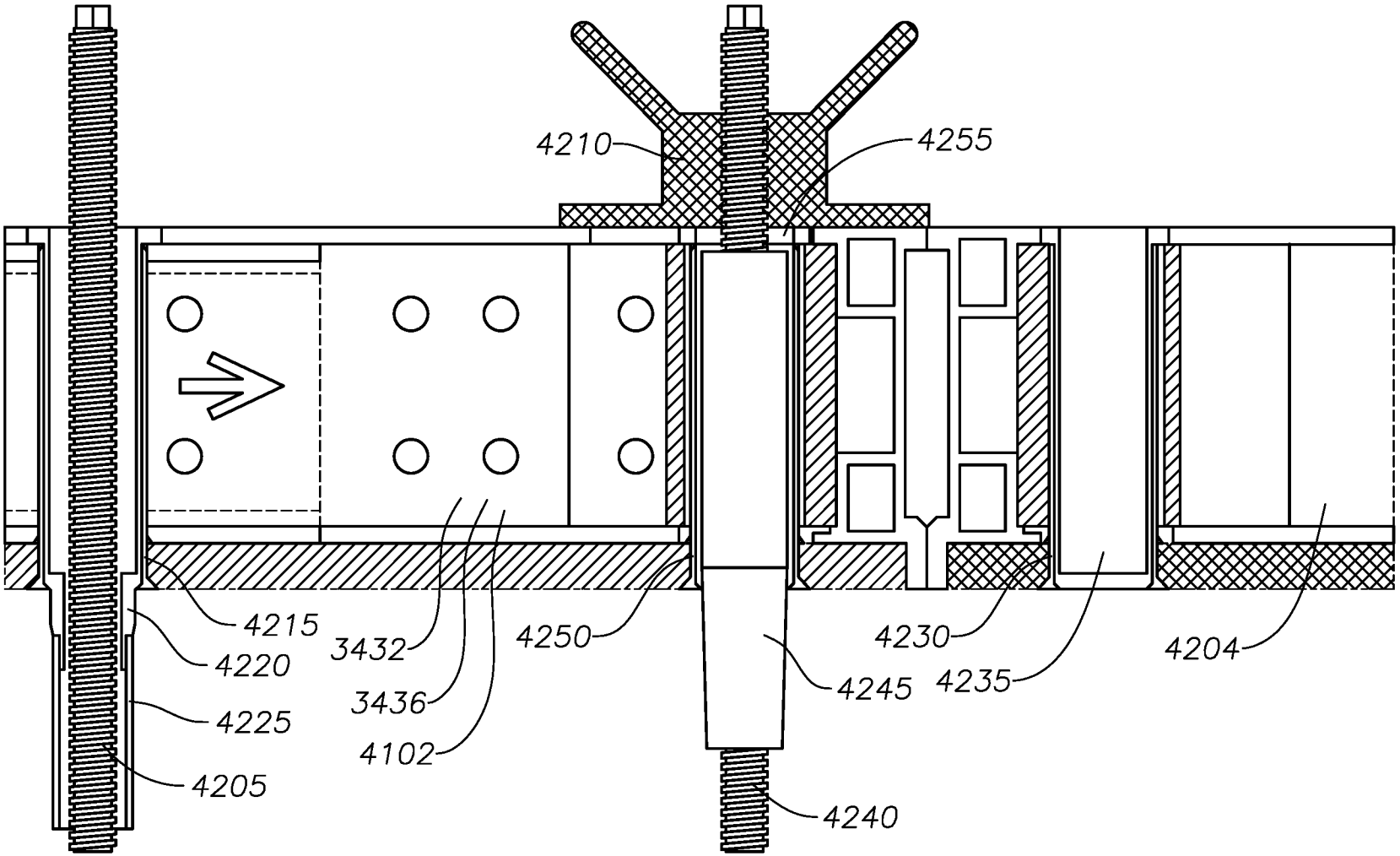
FIG. 42 illustrates a top cutaway view of a she bolt and tie rod assembly in accordance with implementations of various techniques described herein.

FIG. 42 illustrates a top cutaway view of a she bolt and tie rod assembly at adjustable filler panel 4102 (e.g., components 3432, 3436). On one side of the adjustable filler panel 4202, the tie rod 4140 and she-bolt 4245 passes through a permanent insert 4250. The tie rod 4240 is secured to the panel using she bolt 4245 and wing nut 4210. The tie rod 4240 is used to tie one panel to an opposing panel.

On another side of adjustable filler panel 4202, the optional tie assembly includes a tie rod 4205 and a wing nut (not shown). The tie rod 4205 passes through a permanent insert 4215 and a cone tie insert 4220 inserted into the permanent insert 4215. The tie rod 4205 further passes through a PVC sleeve 4225 attached to the cone tie insert 4220. The optional tie rod is used to tie one panel to an opposing panel. Also shown at panel 4204, which is serially attached to panel 4202, is a plug insert 4235 inserted into permanent insert 4230.

Once formwork is set, tie inserts and the tie rod are assembled and slide into position from a back side of the panel. On the opposite panel that receives the tie rod, the tie inserts are also assembled from the back side of this panel.

FIGS. 43A-43D illustrate various views of hinged inside corner 2504 and hinged outside corner 2506 extrusions. Hinged outside corner 2506 includes a first member 4310 and a second member 4315. In a 90 degree configuration, a 90 degree strap 4320 is used. The 90 degree strap 4320 may be attached to the first member 4310 and the second member 4315 using screw and nut 4322 or some other attachment means.

Hinged inside corner 2504 includes a first member 4330 and a second member 4335. In a 90 degree configuration, a 90 degree strap 4340 is used. The 90 degree strap 4340 may be attached to the first member 4330 and the second member 4335 using screw and nut 4342 or some other attachment means.

In one implementation, instead of using screw and nut 4342, an adaptor plate (not shown) can be permanently mounted to each extrusion using bolts, and the 90 degree strap can be attached to the adaptor plate using pull pins. In this implementation, the 90 degree strap is easier to remove when an angle that is greater or less than 90 degrees is needed.

Figure 43C:
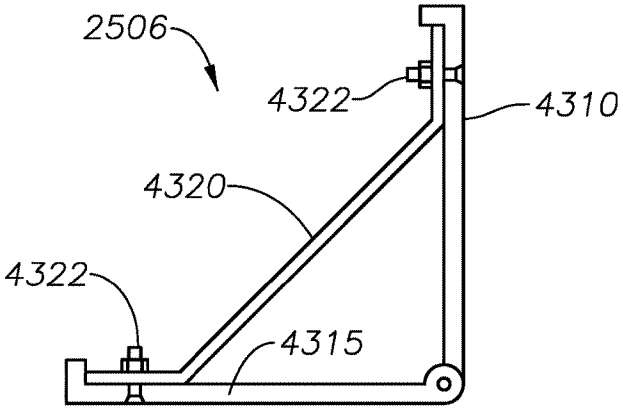
FIGS. 43A-43D illustrate various views of hinged inside corner and hinged outside corner extrusions in accordance with implementations of various techniques described herein.
Figure 43D:
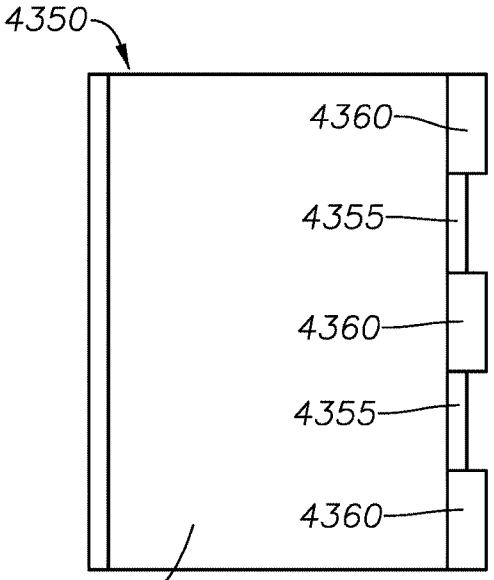
Figure 43B:
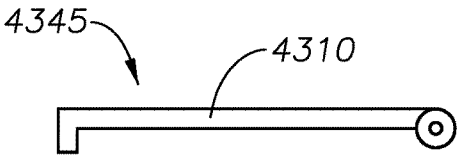
Figure 43A:
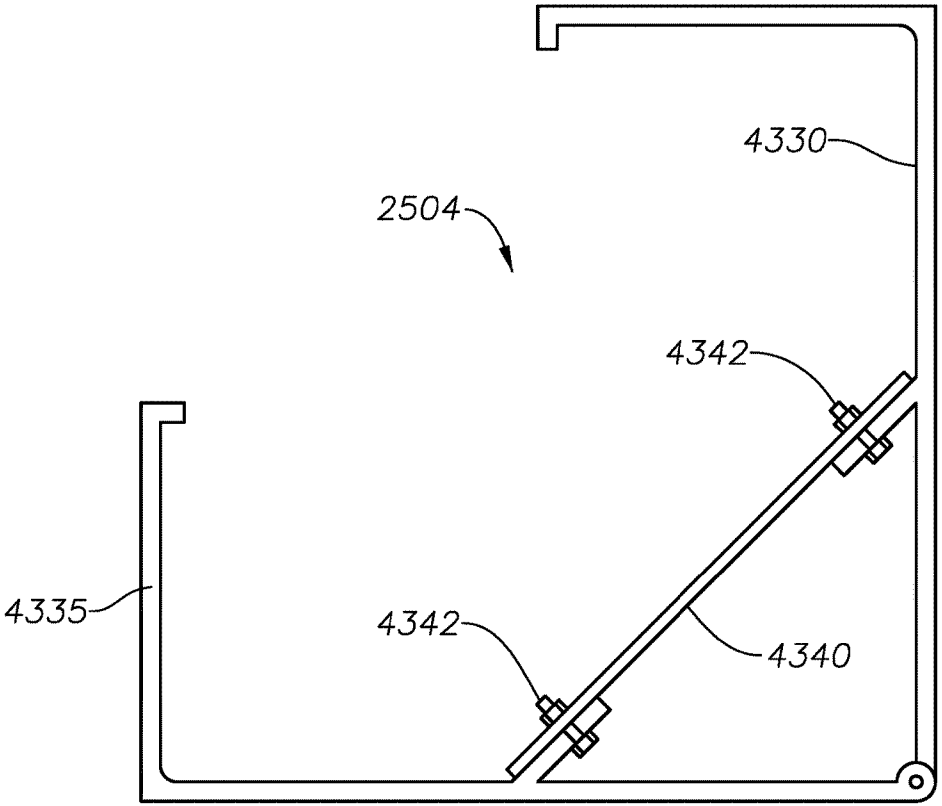

A top view of first member 4310 is shown in FIG. 43B as element 4345. A side view of first member 4310 is shown in FIG. 43D as element 4350. Side view 4350, illustrated in FIG. 43D shows two removal areas. The removal areas are the spaces between the hinge members. The two removal areas accommodate the hinge members of the second member (not shown in this view), which has one removal area. A hinge (not shown) is used to couple the first member to the second member.

FIGS. 44A-44F illustrate various connection configurations for inside corner extrusions 2504 and outside corner extrusions 2506 that are connected to formwork panels 4401, 4403 using the standard clamp 2508*a* or a bolt connection. The configuration in FIG. 44A as element 4405 shows a 90 degree inside corner connection. The configuration in FIG. 44B as element 4410 shows a less than 90 degree angle. The configuration in FIG. 44C as element 4415 shows a greater than 90 degree angle. In this configuration, a hinged corner connection is capable of achieving a maximum angle of 190 degrees.

Figure 44C:
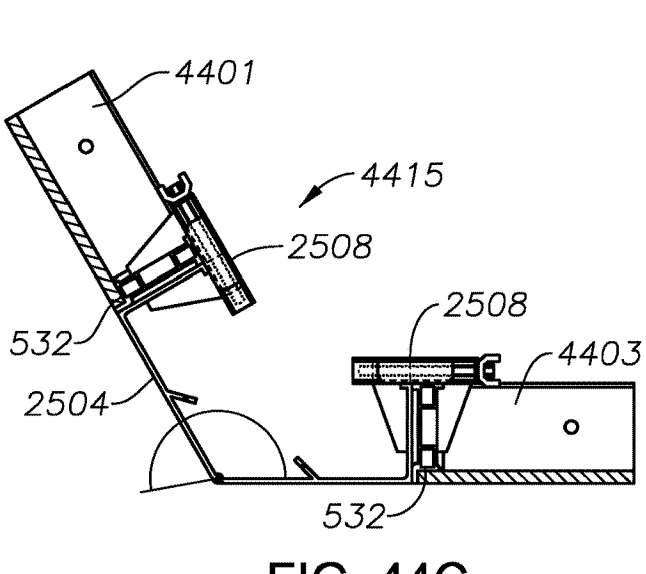
FIGS. 44A-44F illustrate various connection configurations for inside corner extrusions and outside corner extrusions in accordance with implementations of various techniques described herein.
Figure 44B:
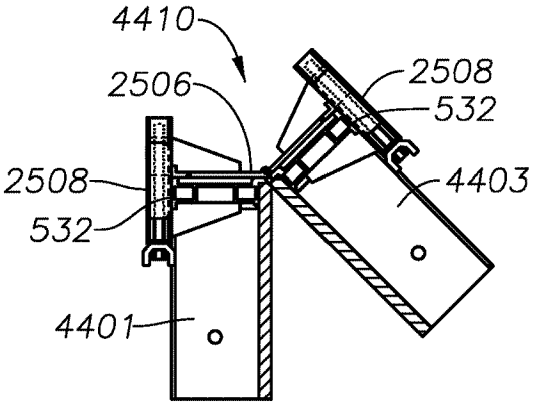
Figure 44A:
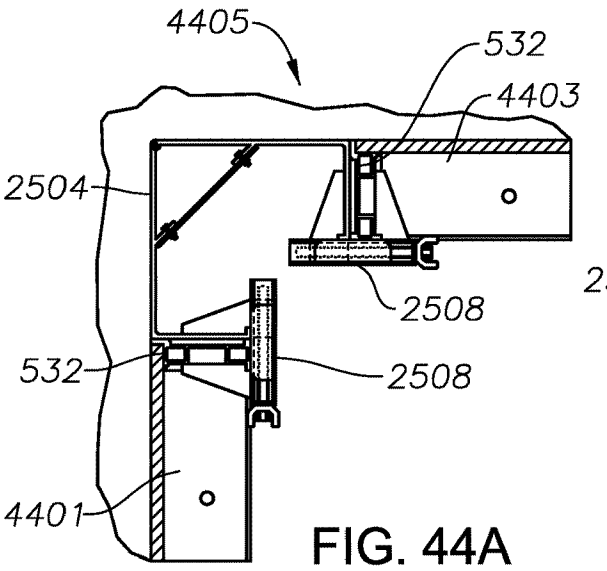
Figure 44F:
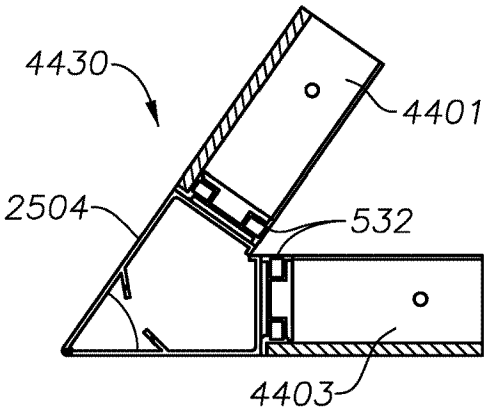
Figure 44E:
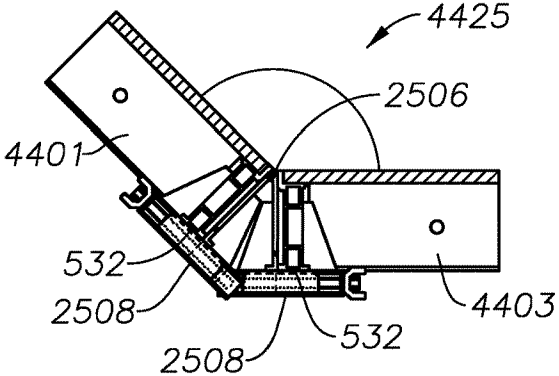
Figure 44D:
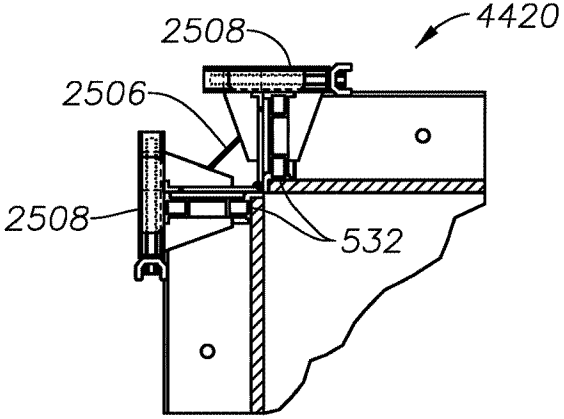
Figure 45C:
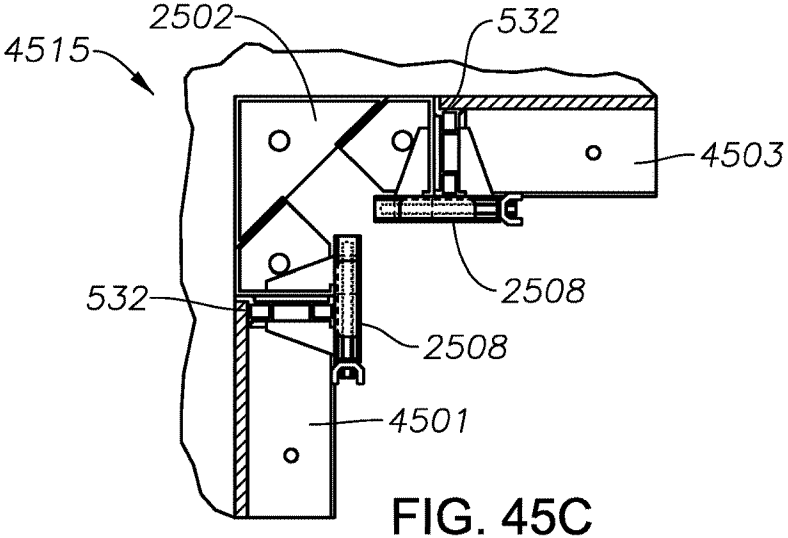
FIGS. 45A-45D illustrate a stripping inside corner in accordance with implementations of various techniques described herein.
Figure 45D:
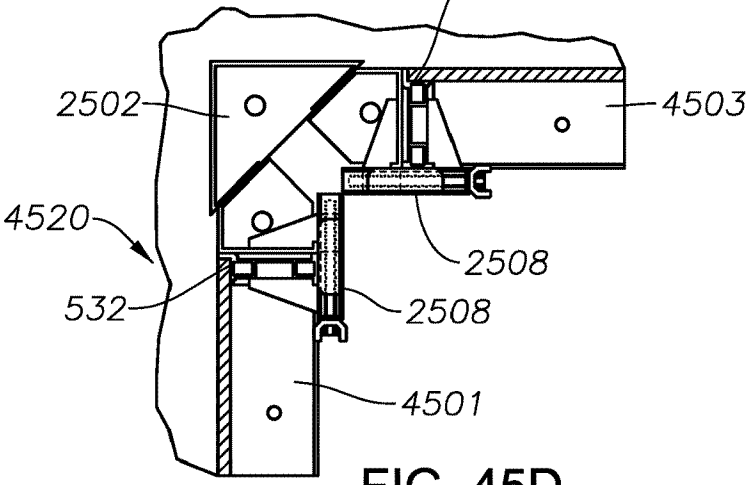
Figure 45B:
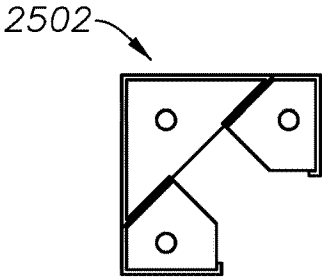
Figure 45A:
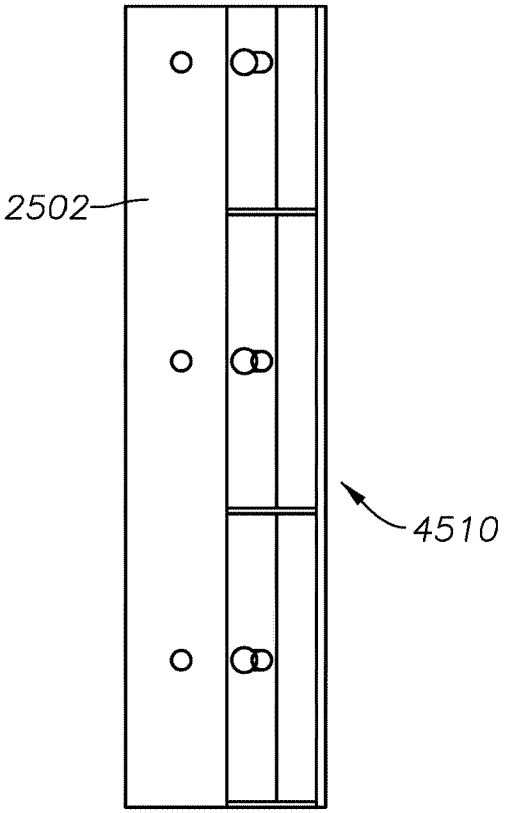

The configuration in FIG. 44D as element 4420 shows a 90 degree outside corner connection. The configuration in FIG. 44E as element 4425 shows a hinged corner connection capable of achieving a maximum angle of 135 degrees. The configuration in FIG. 44F as element 4430 shows a hinged inside corner capable of achieving a minimum angle of 55 degrees if bolts (not shown) are used instead of the standard clamp.

FIGS. 45A-45D illustrate a stripping inside corner 2502 according to an 8" implementation. A plan view and a partial elevational view of stripping inside corner 2502 are shown in as element 4510 in FIG. 44A. Also shown are a pour position 4515 and a stripping position 4520 for stripping inside corner 2502. Pour/stripping position, shown in FIGS. 45C and 45D as views 4515, 4520, respectively, include panels 4501, 4503 (including side rails 532) and clamps 2508*a*.

Figure 46D:
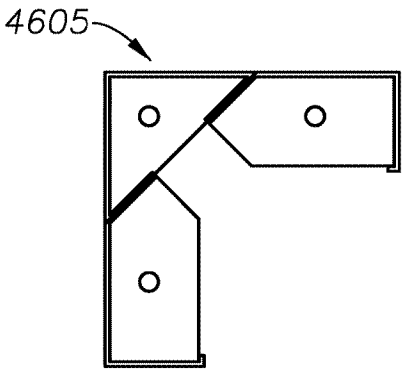
FIGS. 46A-46D illustrate a stripping inside corner in accordance with implementations of various techniques described herein.
Figure 46B:
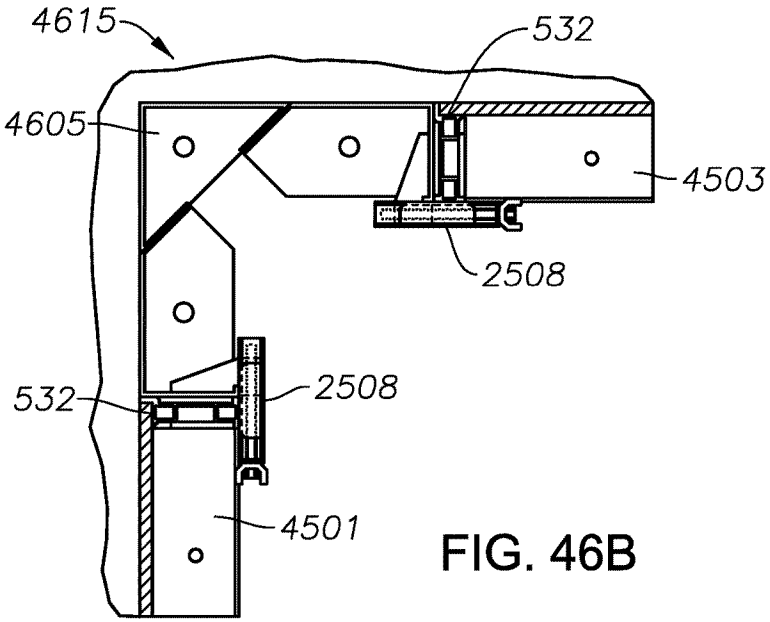
Figure 46C:
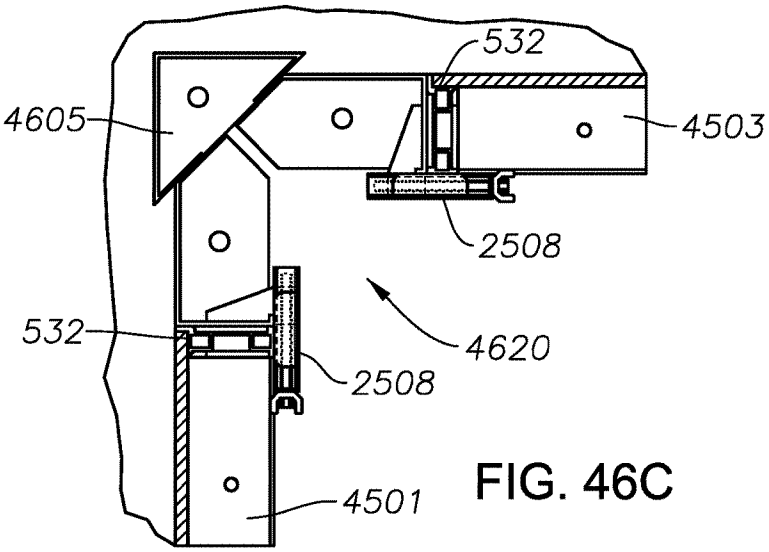
Figure 46A:
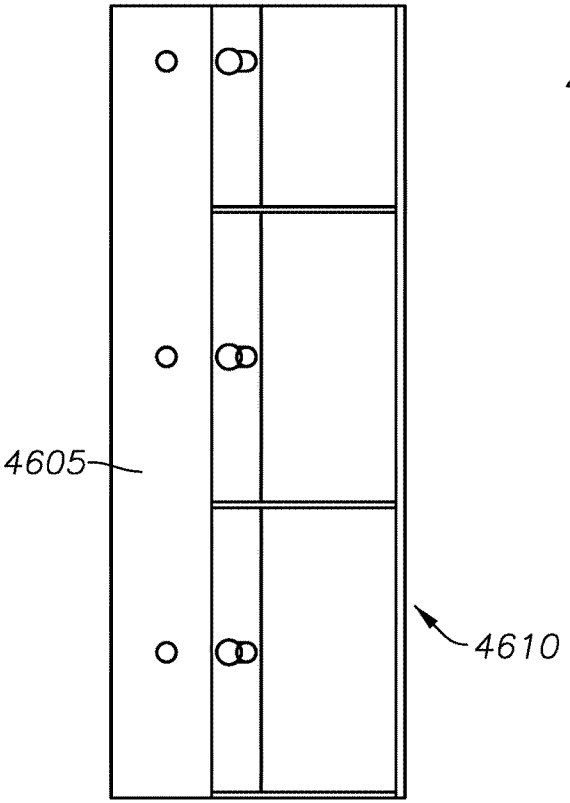

FIGS. 46A-46D illustrate a stripping inside corner 4605 according to a 12" implementation. A plan view and a partial elevational view of stripping inside corner 4605 are shown in FIG. 46A as element 4610. Also shown are a pour position 4615 and a stripping position 4620 for stripping inside corner 4605. Pour/stripping position views 4615, 4620 include panels 4501, 4503 (including side rails 532) and clamps 2508.

In one implementation, the stripping inside corner is adjusted from a pour position to a stripping position using either a screw mechanism (not shown) or a slotted slide plate (not shown) that draws the two sides of the inside stripping corner inward to strip and outward to re-set to the next pour position. In one implementation, the stripping inside corner can be made from aluminum and includes a slide plate configuration.

Figure 47B:
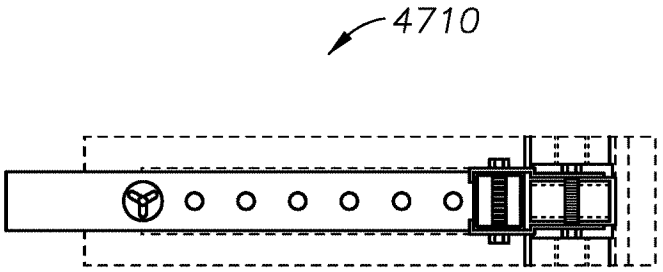
FIGS. 47A-47C illustrate an overlapping outside corner configuration in accordance with implementations of various techniques described herein.
Figure 47C:
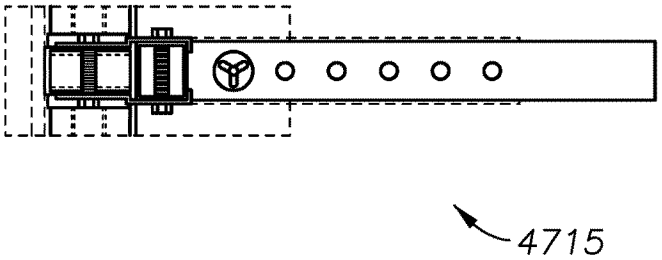
Figure 47A:
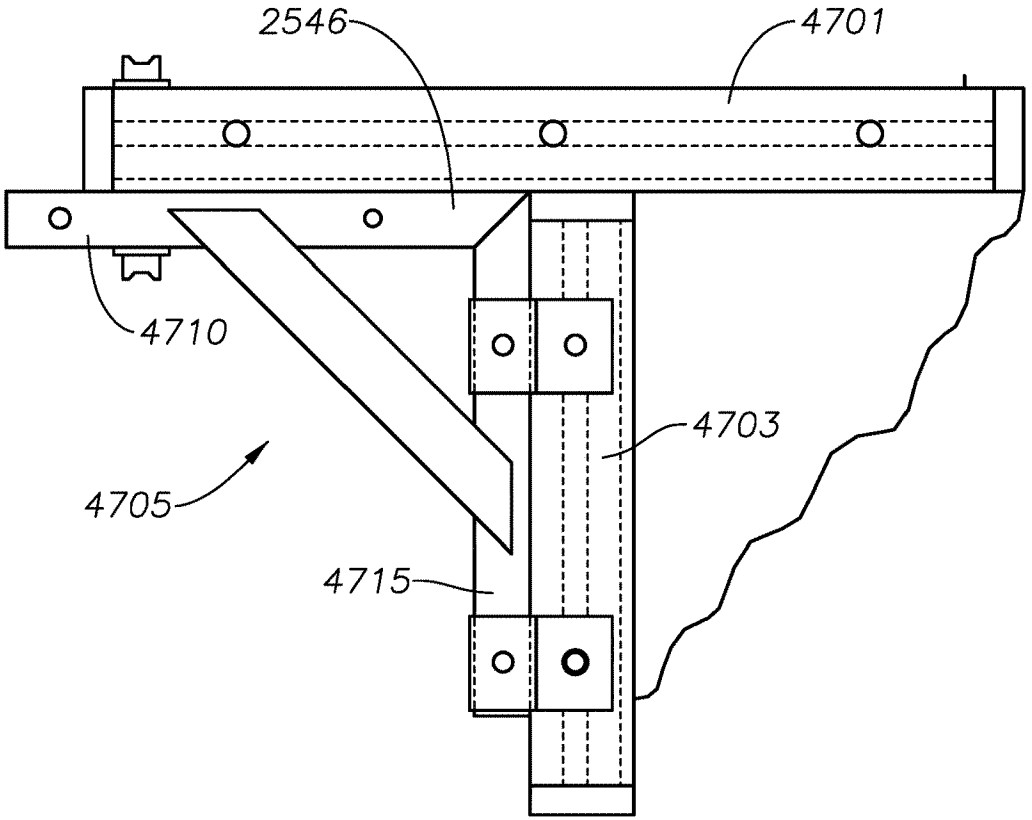

FIGS. 47A-47C illustrate an overlapping outside corner configuration using outside corner bracket 2546. In this implementation, the overlapping outside corner assembly 4705 includes outside corner bracket 2546 and standard panels 4701, 4703. The overlapping outside corner assembly 4705 can be implemented using an even increment configuration, e.g., corresponding to side 4710 or an odd increment configuration, e.g., corresponding to side 4715. Each side 4710, 4715 of the outside corner assembly is adjustable in 2" increments, however one side is offset from the other by one inch. Adjusting in 1" increments can be achieved by flipping the outside corner assembly over. Alternatively, this bracket can be fitted with holes every one inch to avoid having to flip the bracket over.

Figure 48B:
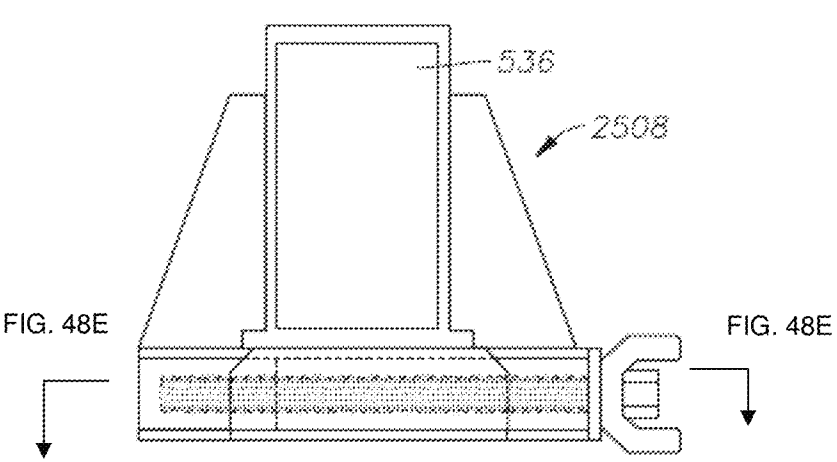
FIGS. 48A-48E illustrate different views of a standard clamp in accordance with implementations of various techniques described herein.
Figure 48E:
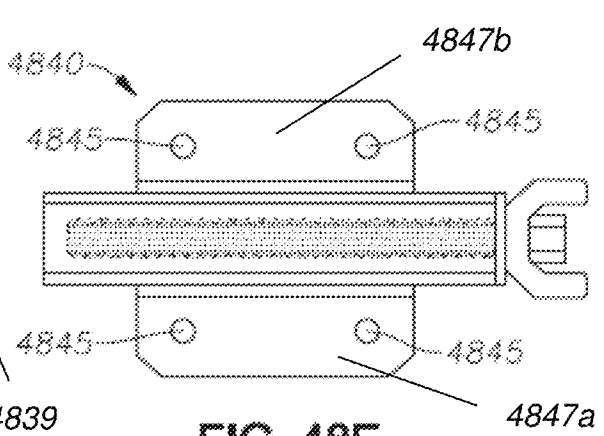
Figure 48D:
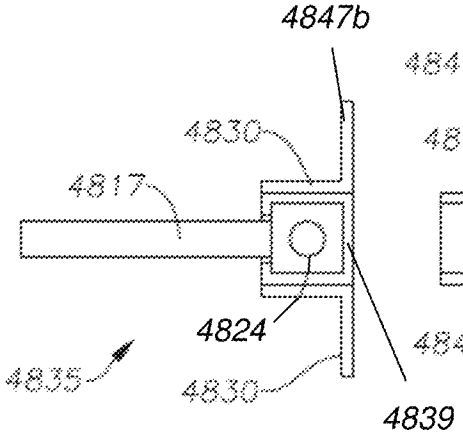
Figure 48A:
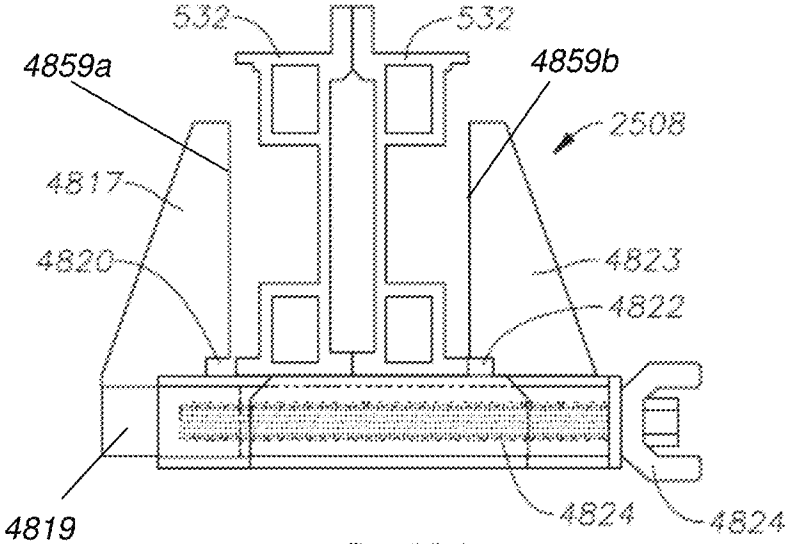
Figure 48C:
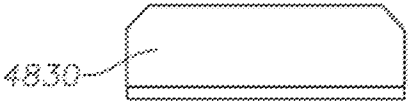

FIGS. 48A-48E illustrate different views of a standard clamp 2508. The clamp 2508 is shown clamping two side rails 532. The clamp 2508 is also shown clamping an inner rail 536. Clamp 2508 includes a first member 4817 having a first substantially planar side 4859*a* having a first opening 4820 configured to accommodate a first flange. Clamp 2508 also includes a second member 4823 having a second substantially planar side 4859*b* having a second opening 4822 configured to accommodate a second flange. A screw mechanism 4824 is used to loosen and tighten the first 4817 and second 4823 members of the clamp. In particular, the screw mechanism engages with a bottom threaded portion 4819 of the first member 4817 in order to tighten the clamp. The standard clamp 2508 is designed to tighten with a screw mechanism and generally can be tightened without using a tool. Using this type of standard clamp 2508 makes all accessory connections more efficient and easier for the end user. The screw mechanism is safer than other coupling mechanisms because the clamp will not loosen as easily if someone accidentally hits the clamp. In one implementation, a connector clip 4830 is permanently attached to the clamp and is configured to be coupled to other attachments used with the aluminum formwork system. The accessory clip that attaches to the connector clip of the standard clamp can serve as a standard connection for the alignment bar configuration, personal tie-off point, pipe brace attachment, and lifting bar configuration. FIG. 48D illustrates element 4835, which is a side view of clamp 2508 with connector clip 4830 permanently attached. Also shown is first member 4817 and a bottom portion of second member 4823. FIG. 48E illustrates element 4840, which is a front view of clamp 2508 with the connector clip 4830 permanently attached. The connector clip 4830 has openings 4845 in first and second lateral plate members 4847*a* and 4847*b* that are used to couple the clamp 2508 to an accessory clip. The lateral plate members 4847*a* and 4847*b* are coplanar with a base plate 4839.

Figure 49E:
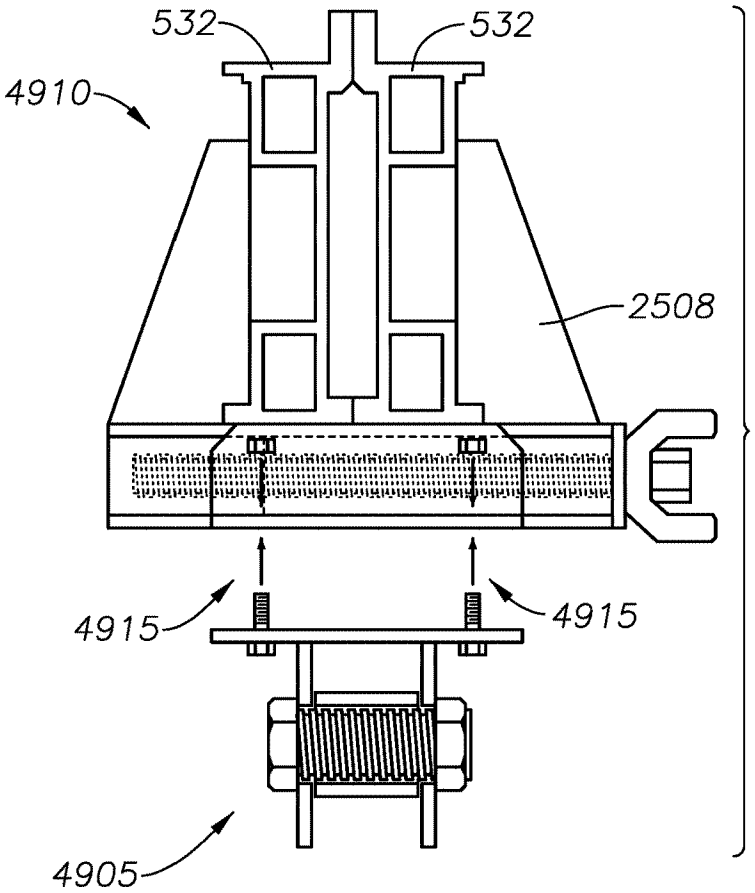
FIGS. 49A-49E illustrate various views of an accessory clip in accordance with implementations of various techniques described herein.
Figure 49D:
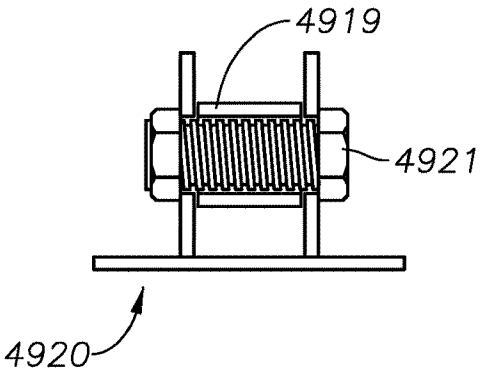
Figure 49A:
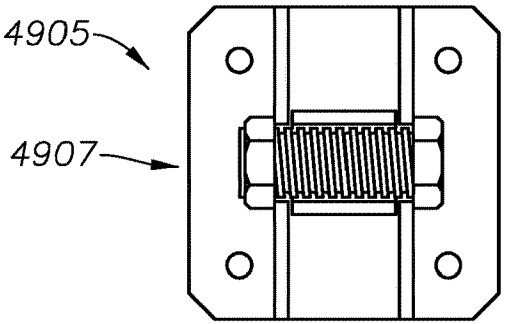
Figure 49B:
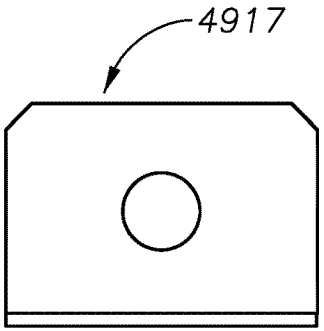
Figure 49C:
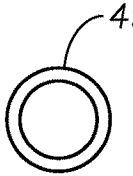
Figure 50D:
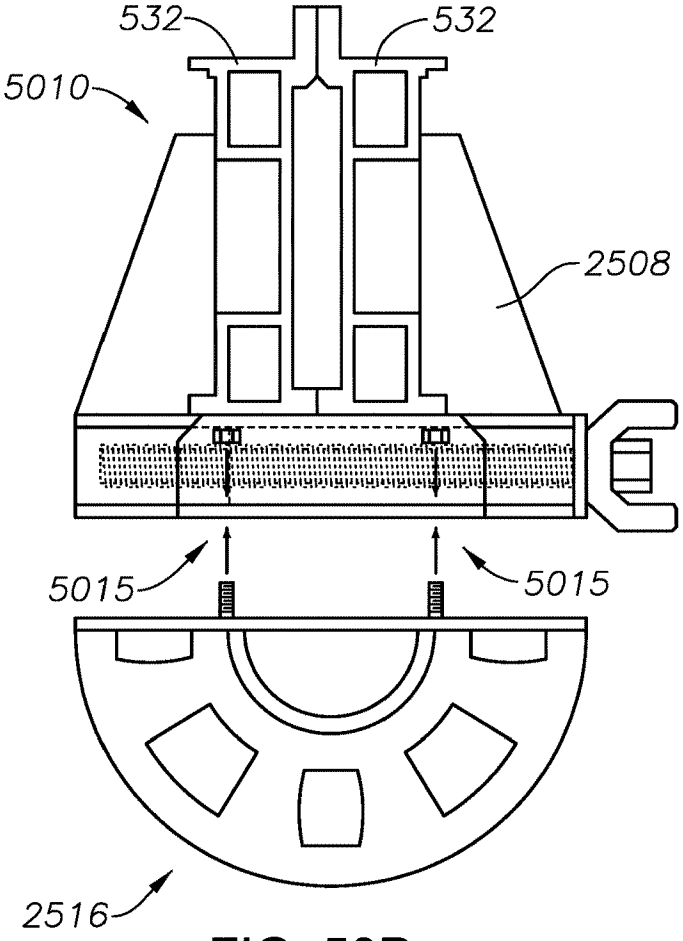
FIGS. 50A-50D illustrate various views of a scaffold bracket adaptor in accordance with implementations of various techniques described herein.
Figure 50A:
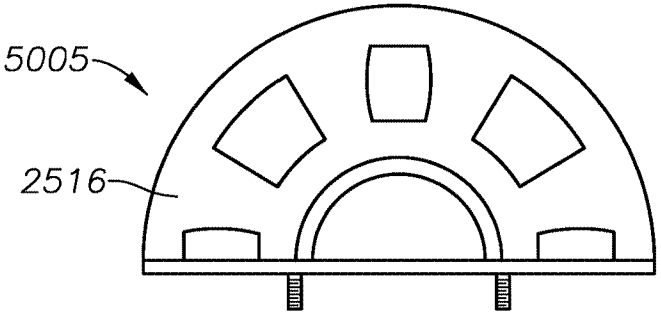
Figure 50C:
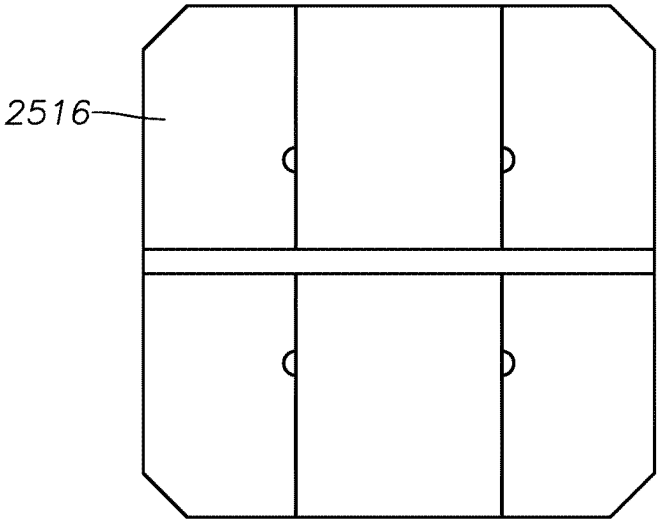
Figure 50B:
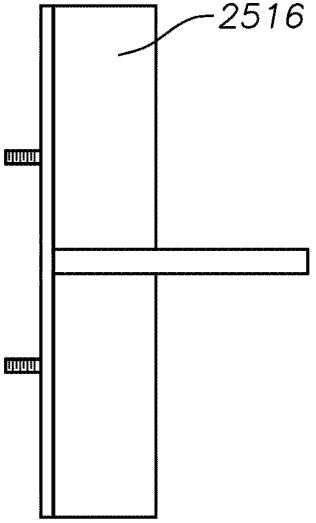

FIGS. 49A-49E illustrate various views 4907, 4917, 4920 of an accessory clip 4905. The accessory clip 4905 can be used with the standard clamp 2508*a* for various other applications, e.g., pipe brace clip, alignment bar, lifting bar and tie-off point. Accessory clip 4905 includes a screw assembly 4921 and sleeve 4919. As illustrated in FIG. 49E, accessory clip 4905 can be attached to clamp 2508*a* using screws and nuts 4915 as shown in view 4910.

FIGS. 50A-50D illustrate various views 5005 of a scaffold bracket or horizontal adaptor 2516*a*. The scaffold bracket or horizontal adaptor 2516 may be attached to the standard clamp 2508*a* using screws and nuts 5015. The scaffold bracket or horizontal adaptor 2516*a* may be used as a personal tie off point with a proper harness and lanyard. In one implementation, scaffold adaptor 2516 may be used to attach either a Ringlok scaffold bracket or a Ringlok horizontal member.

Figure 51B:
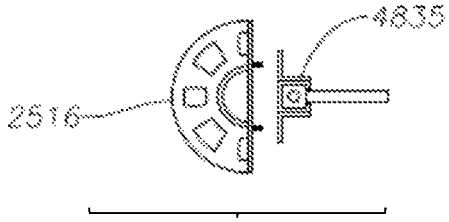
FIGS. 51A-51B illustrate a Ringlok side bracket adaptor in accordance with implementations of various techniques described herein.
Figure 51A:
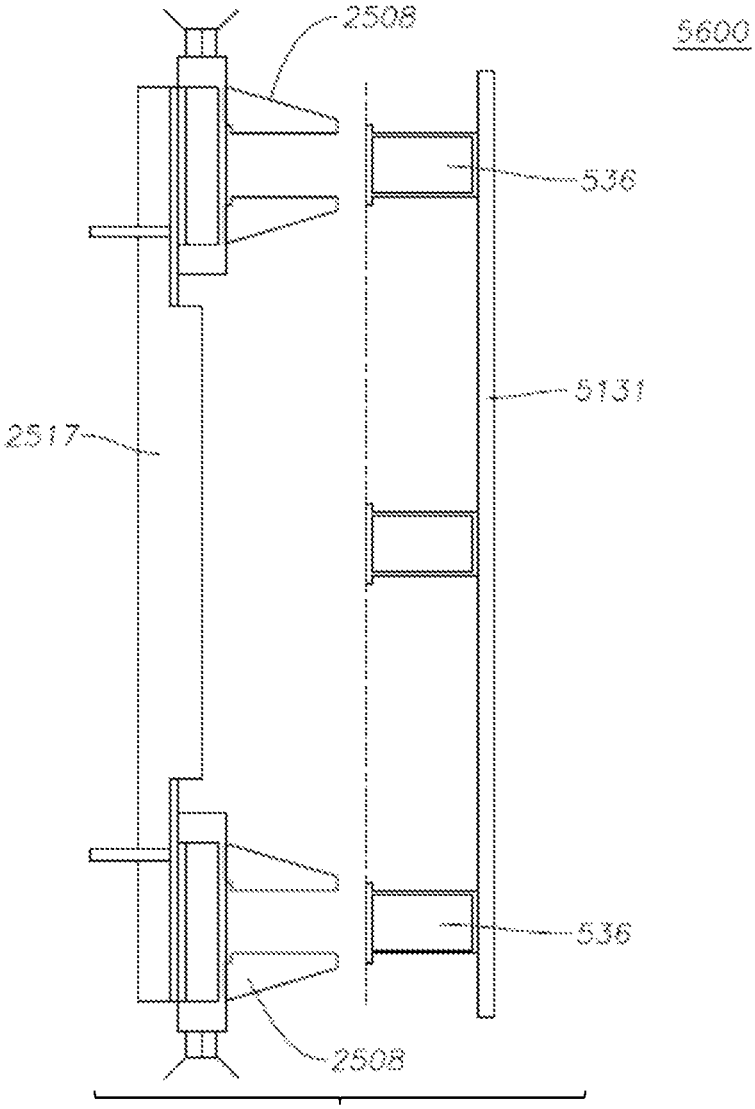
Figure 52B:
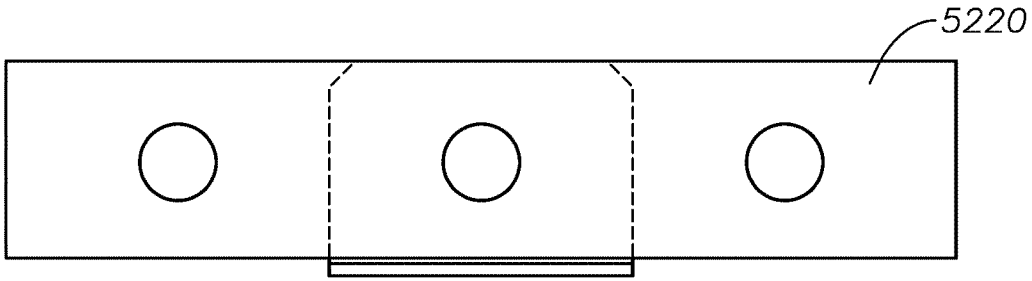
FIGS. 52A-52D illustrate various views of an alignment/lifting bar clamp attachment in accordance with implementations of various techniques described herein.
Figure 52C:
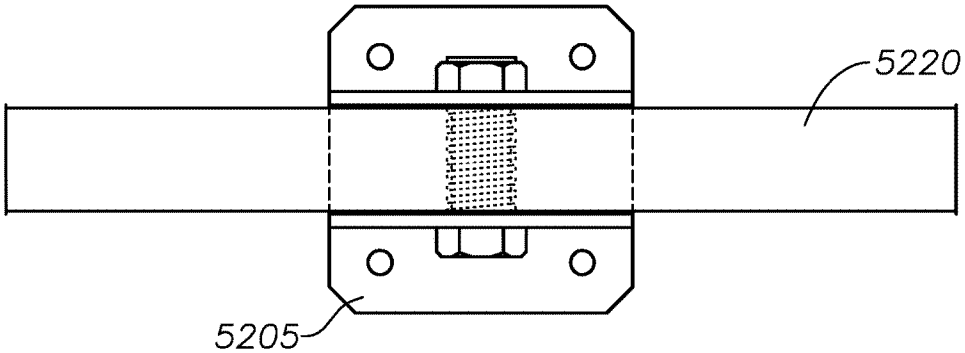
Figure 52D:
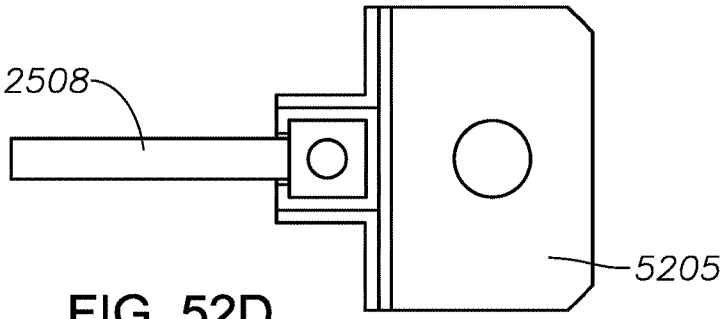
Figure 52A:
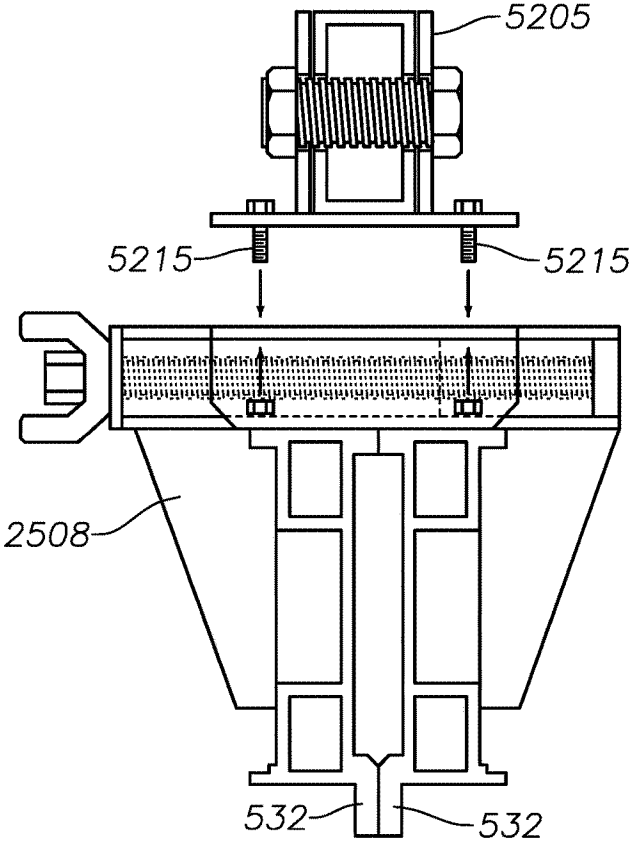

FIGS. 51A and 51B illustrate a Ringlok side bracket adaptor 2517. This configuration shows how a Ringlok leg material 2517 can be attached to inner rails 536 of a panel 5131 using the standard clamp 2508*a* according to one implementation.

FIGS. 52A-52D illustrate various views of an alignment/lifting bar attachment. The alignment/lifting bar 5220 can be coupled to the standard accessory clip 5205 using a bolt assembly (not numbered). The alignment/lifting bar 5220 and standard accessory clip 5205, may be attached a standard clamp 2508 using a screw assembly 5215.

Figure 53E:
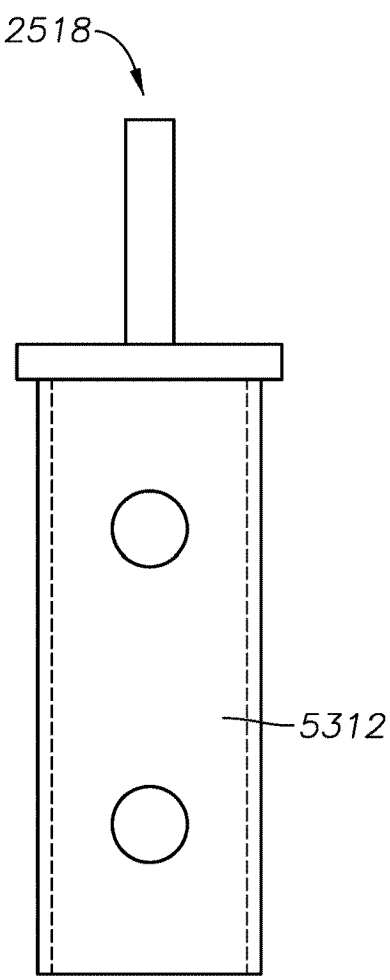
FIGS. 53A-53E illustrate additional alignment/lifting bar attachments in accordance with implementations of various techniques described herein
Figure 53D:
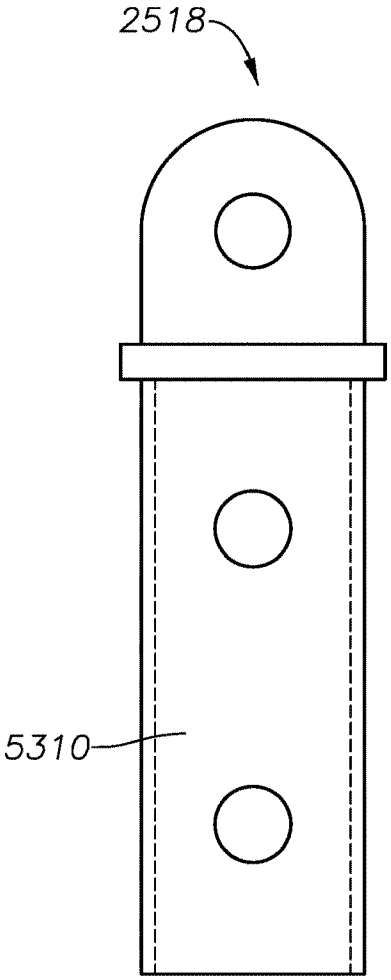
Figure 53C:
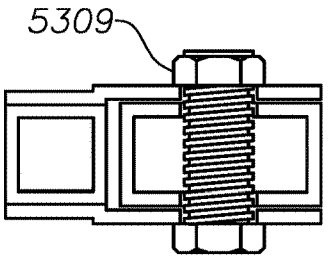
Figure 53B:
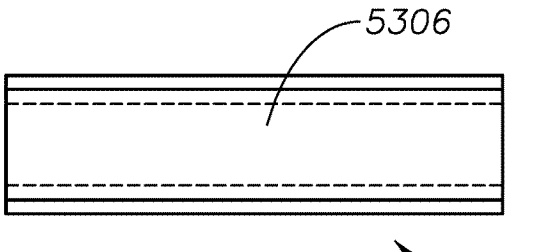
Figure 53A:
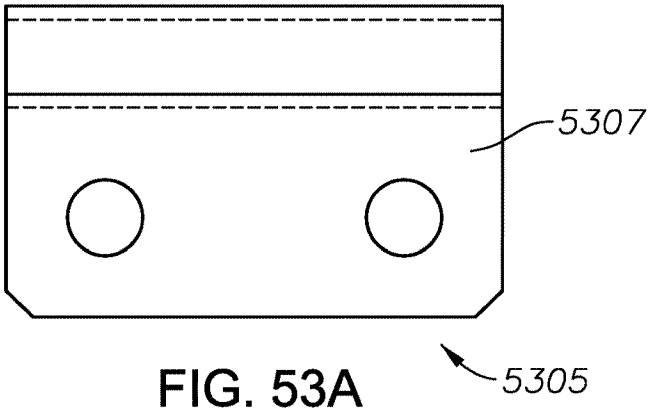

FIGS. 53A-53E illustrate additional alignment/lifting bar attachments. FIGS. 53B, FIG. 53A, and FIG. 53C includes respective views 5306, 5307, 5309 of an optional center support attachment 5305 and FIG. 53D and FIG. 53E includes respective views 5310, 5312 of a lifting bracket attachment 2518*a*. Also illustrated in FIGS. 53D-53E) is a side view 2518*b* of the lifting bracket 2518*a*.

Figure 54C:
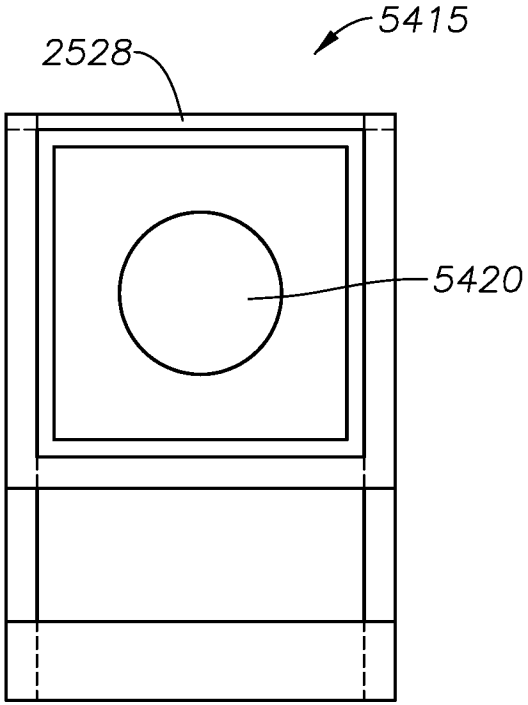
FIGS. 54A-54C illustrate various views of a dry tie/hold down bracket in accordance with implementations of various techniques described herein.
Figure 54B:
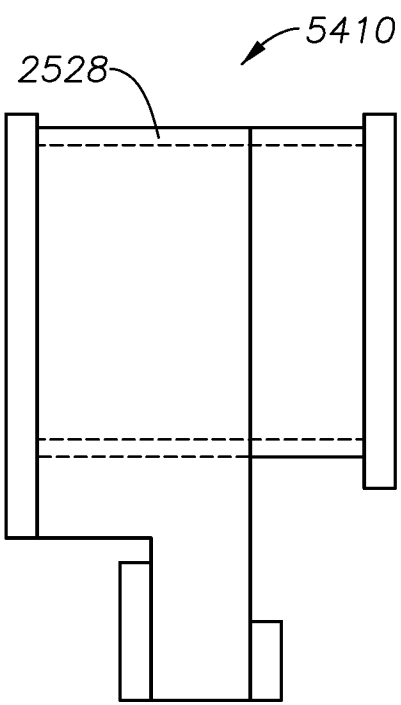
Figure 54A:
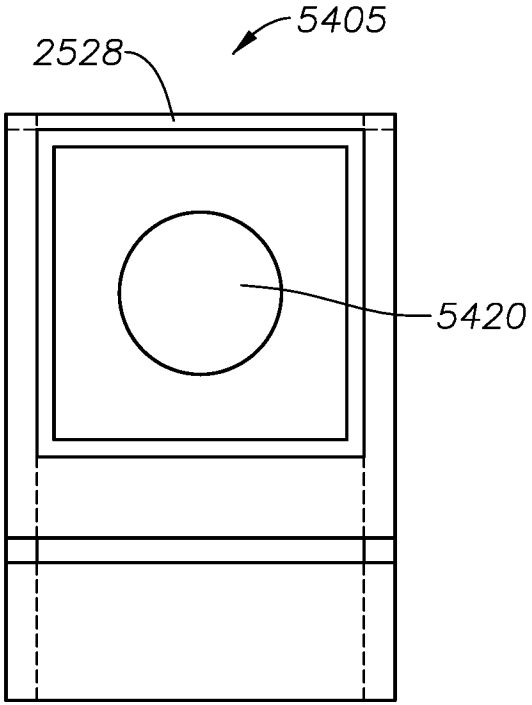

FIG. 54A-54C illustrate respective views 5405, 5410, 5415 of a dry tie/hold down bracket 2528. Opening 5420 is shaped to accommodate a tie rod or screw for dry tie and hold down applications.

Figure 55A:
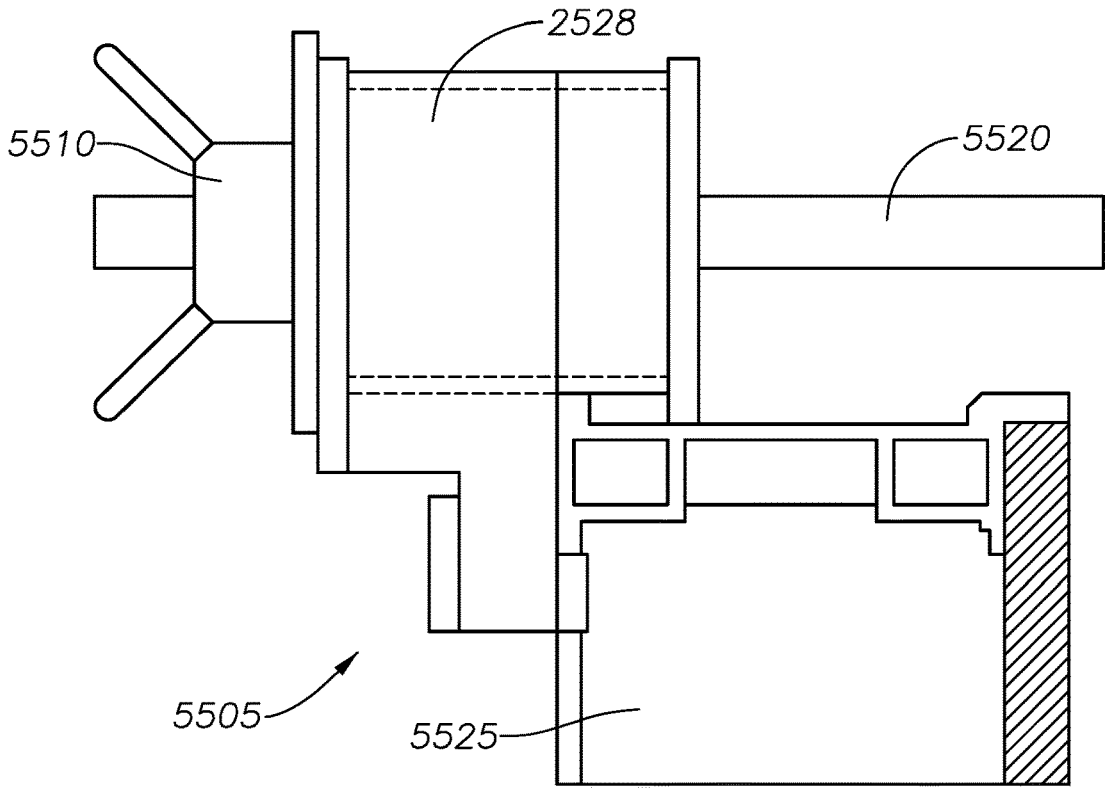
FIGS. 55A-55B illustrate implementations of a dry tie application and a hold down bracket application in accordance with implementations of various techniques described herein.
Figure 55B:
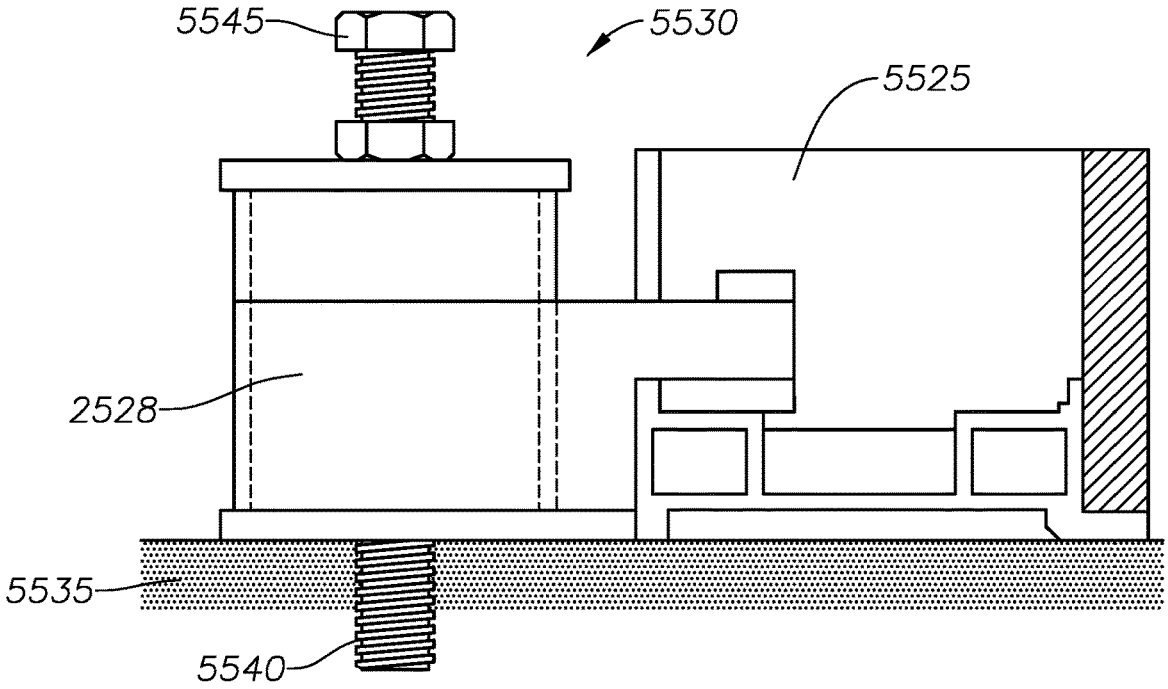

FIG. 55A-55B illustrates implementations of a dry tie application 5505 and a hold down bracket application 5530 using the bracket of FIG. 54A-54C. Dry tie application 5505 includes a tie rod assembly (tie rod 5520 and wing nut 5510), bracket 2528 and formwork panel 5525. The bracket 2528 is attached to a top portion of formwork panel 5525 and the tie rod assembly 5510, 5520 is used to couple bracket 2528 to an opposing bracket attached to a top portion of an opposing panel.

Hold down bracket application 5530 includes tie rod 5540, anchor bolt 5545, bracket 2528 and panel 5525. Bracket 2528 is attached to a bottom portion of formwork panel 5525 and is tied to surface 5535 using tie rod 5540 and anchor bolt 5545.

Figure 56:
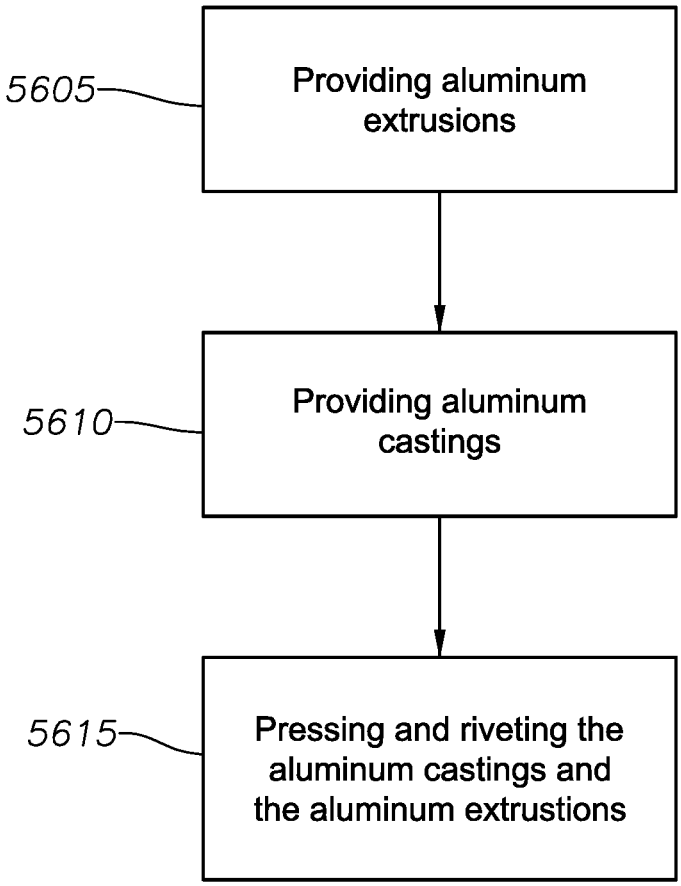
FIG. 56 illustrate a block diagram of a method of assembling a formwork system in accordance with implementations of various techniques described herein.

FIG. 56 illustrates a block diagram of a method of assembling a formwork system. At block 5605, aluminum extrusions are provided. At block 5610, aluminum castings are provided. At block 5615, the aluminum castings and aluminum extrusions are pressed and riveted.

The aluminum extrusions can be side rail extrusions and/or interior rail extrusions. The aluminum extrusions and the aluminum castings can be made of structural grade aluminum.

In one implementation, the formwork system can be configured such that the aluminum extrusions and aluminum castings are integrated into a shoring deck application.

In one implementation, the aluminum extrusions are adjustable and a width of the aluminum extrusions can be incrementally adjusted using different configurations.

The aluminum extrusions can be assembled to be part of a series or system of formwork panels that are coupled together using a standard clamp. The formwork panels are constructed of lightweight aluminum extrusions and fittings and are assembled with mechanical fasteners and have no welding. The standard clamp may also be used to couple attachments to the formwork panels. In one implementation, a connector clip can be attached to the standard clamp and configured to be coupled to one or more attachments for the formwork system. In one implementation, an accessory clip can be attached to the connector clip. The accessory clip can be coupled to the one or more attachments. The attachments may include, but are not limited to, a pipe brace clip, an alignment bar, a lifting bar, a tie-off point.

In one implementation, formwork panels can be coupled via an aluminum extruded hinged corner extrusion and configured to be positioned relative to each other at a plurality of angles.

In one implementation, the aluminum extruded hinged corner extrusion can be a hinged inside corner extrusion. In one implementation, the hinged corner extrusion can be a hinged outside corner extrusion.

In one implementation, tie inserts are used with a formwork panel. Tie inserts may include self-sealing ties, tie plugs and tie inserts that install from the outside (or backside) of ganged form panel assemblies. This increases labor efficiency and reduces risk of concrete leakage through the tie port assembly. A tie nut and rod assembly can be used to couple a formwork panel to an opposing formwork panel.

The design of the present formwork system includes several key unique features that are not found in prior art systems. Below are descriptions of these aspects:

Aluminum Extrusions & Castings vs. Welded Rolled Steel

All of the systems in use today are fabricated from rolled steel shapes, and are welded together to construct the formwork frame. While this approach may be cost effective to manufacture, it generally has its drawbacks with regard to inventory maintenance costs, as well as long term product performance. Light weight rolled steel components can wear over time, causing issues with components fitting together properly, which often creates assembly issues for contractors on the jobsite. In general, galvanized welded steel frames will eventually rust after continued exposure to chemicals present in concrete, as well as from the caustic environment on jobsites where these systems are used.

In one implementation, the formwork system of the present disclosure is constructed solely of aluminum extrusions and castings in a fashion that eliminates structural welding. This simplifies both the manufacturing, as well as the inventory maintenance aspects of a purchased inventory.

The structural capacity is generated from having the castings pressed into the extrusions. The corner castings are press fitted into the side rail extrusions and either riveted, or screwed together. The tie hole fitting, e.g., the tie extrusion, is bolted to the side rail and press fitted and bolted into the interior rail. The result of this type of assembly provides a more rigid and consistently truer frame with a higher level of durability. Since the extrusions, i.e., side rails and inner rails, tie hole fittings and castings of the formwork system are aluminum, these elements will not rust and will maintain their structural rigidity for longer periods of time, as compared to traditional welded steel types.

In one implementation, the corner casting provides added durability to help prevent damage during normal construction activities. In another implementation, the side rail extrusions are shaped to help prevent typical handling damage patterns by having specific areas thicker than those in protected areas (e.g., outer edges or walls are thicker). The thicker areas may provide protection against weather and/or damage due to construction workers or other mishaps that may occur on a construction site. There is no prior art system that is constructed in this manner.

Wall Tie Pattern and Frequency

All formwork systems require a tie system of some sort, to hold the panels on one side of a concrete wall to those on the opposite side. The liquid concrete causes pressure on the form face that push the forms apart. Form ties are used to hold the forms together to prevent movement and to allow the casting to maintain the intended shape.

Most prior art systems have a pre-defined pattern that provides limited amounts of flexibility. Additionally, prior art systems do not allow a form of two different heights to be connected on opposite sides of the wall in a fashion that allows staggering. For example, in prior art systems, the spacing of the tie holes on a shorter form are different from those on a taller height forms. This forces builders to use the same height forms on both sides of the wall, which limits the amount of configurations that a system can achieve.

There are frequent situations that require a user to have higher forms on one side of the wall vs. the other. The tie pattern of the present system allows ties to be placed in predefined increments, e.g., 12" increments. This symmetrical tie spacing feature allows panels to be stacked and staggered in a variety of patterns from one side of the wall to the other. This exponentially increases the versatility of the product and reduces the amount of components needed.

Standard Panel Widths with an Adjustable Filler Assembly and a Variable Width Lumber Filler Assembly vs. Prior Art Multiple Sized Panel Widths Generally, most prior art systems offer a variety of pre-manufactured panel and filler sizes so the system will have enough dimensional flexibility to handle the wide range of field conditions. Given that most formwork applications generally use a small percentage of filler components in relation to standard panels, the formwork owner is forced to maintain a large inventory of various size filler panels in the event one particular size may be needed over another. This causes the owner to invest in seldom used assets in order to maintain dimensional flexibility.

This new system takes a very different approach, and has only two distinct panel widths. Secondly, this system has a pre-fabricated filler side rail accessory that allows users to custom build fillers to meet the size requirements for each specific application. One additional component that allows the user to have fillers of variable widths significantly reduces the amount of items to inventory. Variable fillers can be pre-assembled prior to shipment to meet the design specifications, or easily custom made in the field to handle dimensional changes from one pour to the next.

The design of the present side rail, e.g., an aluminum filler side rail, allows making custom filler sizes feasible. This component allows the user, or form provider, to easily insert standard sized wood members to create custom sized filler panel that perform in the same manner as standard panels. The filler panels attach to the primary components in the same way as the rest of the standard system, and also have the same tie hole configurations. This gives builders the same dimensional flexibility as other systems, while significantly reducing inventory components. One set of filler side rails eliminate the need for the form owner to carry large amounts of pre-fabricated and seldom used small filler panels. In addition, the filler side rails may be made or fabricated on a per order basis.

In one implementation, the filler side rail assembly will also be used for circular construction, and for walls that intersect at other than right angles. These conditions are two more examples of infrequent applications that create inventory inefficiencies as well.

This system also includes an adjustable filler assembly. This adjustable filler assembly is capable of handling a majority of straight wall filler applications. Using the adjustable filler assembly (and the lumber assembly) eliminates the necessity in the prior art of having fabricated fillers of various sizes. The adjustable filler reduces the amount of custom wood expense and time needed to fill a customer order. Using the adjustable filler assembly reduces the need for all wood inner members with a new aluminum adjustable inner member, so that the most common filler sizes can be achieved with the same frame assembly. This adjustable filler assembly is unique to the present system.

In this system, filler side rails are designed to accept lumber inner rails, however, a much smaller quantity will be needed in practice. The lumber configurations will be used primarily for odd fillers that aren't achievable using the other standard adjustable components and to make curved formwork. The lumber filler side rail uses the same side rail design as the adjustable filler, with the addition of a lumber clip, and removal of the adjustable inner rail.

Ability to Form Circular Walls without Having a Secondary Curved Inventory

Another infrequent use of formwork is on circular concrete walls or columns. In addition to the uses for the filler side rail noted above, this component also allows the form owner to custom build curved wall forms or circular column forms by inserting radius shaped dimensional lumber, similar to assembling variable sized fillers.

Given the advancements of computer numerical control (CNC) cutting technology, custom shaping of large quantities of wood members make this approach very practical. Through the use of CNC technology, variable radiuses similar to filler shown in FIGS. 3 and 11 can be made quickly and cheaply to order. This additional function of the aluminum filler side rail allows an owner of a formwork inventory to eliminate an entire separate inventory of prefabricated circular form panels. Given the fact that circular construction occurs on a very small percentage of concrete construction activities, and that each application has different radius specifications, not having a secondary curved form inventory eliminates a large investment that generally produces minimal returns.

Standard Clamp Connector with Attachments vs. Multiple Clamp Types

All modern modular formwork systems use a clamping device to connect one form panel to the next. However, most, if not all, prior art systems use various configurations of clamps for specific purposes. Most have a standard clamp for the majority of connections, a second alignment clamp to maintain in line straightness for a series of panels connected end to end, and an adjustable clamp that is used when wood shims are required to make small dimensional adjustments.

The design of the clamp for the present system eliminates the need for multiple clamps because the clamp of the present system has attachment ports. The ports allow various items to be connected to the clamp, such as a simple piece of angle or wood, which can be used as an alignment bar, in straight wall applications. This aspect significantly reduces the inventory costs for clamps. Secondly, given that the present system uses side rails, e.g., aluminum filler side rails, to make variable sized filler, the need for the small wood shims of the prior art system is eliminated. Therefore, the adjustable style of clamp of the prior art is also eliminated.

The present system uses one style of clamp for connecting forms in a straight line. In contrast, prior art systems on the market today require three or more clamp varieties.

Windmill Outside Corner Connectors vs. Modified Panels to Allow Overlapped Connections When forming walls or columns, one item that is constantly needed is a right angle panel overlap corner. Most, if not all, prior art systems use full height special fabricated form panels, made in the same heights as the other form panels, with additional tie holes spaced to connect the overlapping panels at various increments. Formwork users who require right angle outside corners using prior art systems must carry an inventory of variable height special overlap forms to meet this requirement.

The present formwork system eliminates the special overlap form panels with the addition of the windmill outside corner connector, see FIGS. 25, 26 (item 2615), and 47. This allows two standard panels to be connected at a right angle and allows one panel to by-pass the other in a windmill fashion with the connection being at the standard tie ports. The windmill bracket allows for odd dimensional take-up based on the dimensions required for the application. The windmill outside corner bracket can be used on an outside face of two walls that intersect at a right angle, or for forming individual column structures.

Using the windmill outside corner bracket eliminates the need for an inventory of specialty panels with additional tie holes that are used to make windmill outside corner assemblies.

Variable Angled Inside and Outside Aluminum Extruded Corners with a 90 Degree Strap vs Fabricated Steel Corners of Both 90 Degree and Hinged Types Most prior art systems use both a fabricated steel hinged design and a separate 90 degree angle design for both inside and outside corners components. Fabricated steel is very heavy and having both a different hinged and 90 degree fabrication for both the inside and outside corners increases the amount of components required for the system.

The present formwork system utilizes an aluminum extruded hinged corner, with a standard 90 degree strap to make up variable angled corners, as well as right angles for both the inside and outside corner designs of various heights. Both the hinged and 90 degree corners configurations can be manufactured separately out of aluminum extrusions for this system. However, it is not necessary, given the design of much lighter hinged aluminum extruded corners and the addition of a 90-degree strap, shown in FIGS. 43-44 mentioned above. Combining the use of a hinged design and right angle design into one assembly eliminates redundant inventory.

Integrated Standard Scaffolding Components vs. Specific Components for Access

Most prior art formwork systems have components, such as scaffold brackets, that are used for workers to access the formwork during assembly, as well as to perform the placement of the concrete inside the formwork. These prior art scaffold brackets have specifically designed components that only work for that particular formwork system.

The present formwork system does not have those specially designed components. Instead, the present formwork system has simple attachment accessories that allow existing types of standard scaffolding components to be utilized. Standard scaffolding systems are readily available in the market place, and are generally made in a standard configuration that integrates with the present formwork system.

Most companies that will own this formwork, more than likely will own some sort of system scaffolding. Whether this is the case or not, this approach allows these companies to separately purchase those scaffolding components that match with the fabricated attachments on the present formwork system. The attachment accessories of the present formwork system eliminate components that would only service one construction system, and reduce the amount of equipment investment for seldom used items.

Synthetic Form Face vs. Plywood Form Face

As mentioned above, most prior art formwork systems use a plywood based form face. The form face is the key feature that holds the liquid concrete in the shape desired. In general, a wood form face wears down frequently and has to be replaced during periodic maintenance activities. In one implementation, the formwork system described in this document may utilize a synthetic face product solely for the standard panels.

Given that the standard panels will form the bulk of the formwork inventory, using synthetic facing will significantly reduce formwork maintenance costs and virtually eliminate the need to periodically replace form faces on the standard panels.

This aspect adds to the overall robust nature of the present formwork system design and helps to reduce the overall cost to own and maintain this formwork system versus prior art systems.

In addition to the details highlighted above, the following additional improvements are discussed below:

Self-Sealing Form Tie System with Color Coded Inserts: This enhancement allows all of the ties and inserts to be assembled from the outside of the form panel. Once in place, the tie cavity is sealed so concrete will not leak into the opening. This is a significant labor savings and product maintenance improvement. There are two tie options 1) She-Bolt with Inner Rod; and 2) Yellow Insert w/PVC Sleeve & re-usable through rod. Both options use the same size threaded rod & Wing Nut washer.

Aluminum Design on Corners: All of the inside and outside standard right angle & hinged corners can be made of an aluminum extrusion with a bolt-on 90 degree strap, instead of fabricated steel. Using aluminum eliminates the need for welding and makes these parts much lighter and capable of handling various corner angles. Note: the stripping corner can still be steel, however, this stripping corner can be reduced in size from 12"×12" to 8"×8". In one implementation, an aluminum stripping corner with a center slide plate mechanism that can pull the sides of the stripping corner inward so that the complete form system can be stripped and moved as an entire unit.

Enhanced design on the adjustable fillers: A changed rail configuration is provided. The adjustable filler elements have interlocking grooves on the inner & outer overlapping splice members to limit deflection and increase capacity.

The scaffold attachments for the standard Ringlok system were enhanced. The attachments can also be configured as a personnel tie-off point.

Removable high pressure strut: a removable high pressure strut (not shown) for the standard panels can be included. This removable high pressure strut can be made using the adjustable rail extrusions and allows for an increase in the allowable design pressure by reducing deflection on the form face. Most prior art systems upgrade their core design to handle extreme pressures, but the downside is an overdesign for day to day common uses. The approach of the present disclosure minimizes component weights and allows for adding the strut in locations where pressures become high, as opposed to the entire system. This is similar in concept to having a moveable personal tie-off point for optimal placement based on the need. This component can be used with the standard panels when the construction application dictates.

The discussion above is directed to certain specific implementations. It is to be understood that the discussion above is only for the purpose of enabling a person with ordinary skill in the art to make and use any subject matter defined now or later by the patent "claims" found in any issued patent herein.

It is specifically intended that the claimed invention not be limited to the implementations and illustrations contained herein, but include modified forms of those implementations including portions of the implementations and combinations of elements of different implementations as come within the scope of the following claims. It should be appreciated that in the development of any such actual implementation, as in any engineering or design project, numerous implementation-specific decisions may be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical or essential to the claimed invention unless explicitly indicated as being "critical" or "essential."

In the above detailed description, numerous specific details were set forth in order to provide a thorough understanding of the present disclosure. However, it will be apparent to one of ordinary skill in the art that the present disclosure may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The terminology used in the description of the present disclosure herein is for the purpose of describing particular implementations only and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. As used herein, the terms "up" and "down"; "upper" and "lower"; "upwardly" and downwardly"; "below" and "above"; and other similar terms indicating relative positions above or below a given point or element may be used in connection with some implementations of various technologies described herein.

While the foregoing is directed to implementations of various techniques described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A clamp assembly for a formwork system, comprising:

a clamp, comprising:

a first member having a first substantially planar side having a first surface and defining a first opening configured to accommodate a first flange;

a second member having a second substantially planar side having a second surface and defining a second opening configured to accommodate a second flange; and a connector clip having a base plate between, connected to, and substantially coplanar with a first lateral plate member and a second lateral plate member, the connector clip being configured to be coupled to an alignment bar, a personal tie-off point, a pipe brace attachment, or a lifting bar;

wherein the first opening and the second opening are at an end of the surfaces closest to the base plate and are both configured to restrict motion of the first or second flange in at least two directional axes, and wherein the first surface and the second surface are both configured to restrict motion of an object via direct contact.

2. The clamp assembly of claim 1, further comprising:

an accessory clip configured to be a connection in one of multiple system configurations.

3. The clamp assembly of claim 2, wherein the multiple system configurations include a system having the alignment bar, the personal tie-off point, the pipe brace attachment, and the lifting bar.

4. The clamp assembly of claim 1, further comprising:

an accessory clip attached to the connector clip.

5. The clamp assembly of claim 4, wherein the accessory clip is coupled to an alignment bar.

6. The clamp assembly of claim 1, further comprising:

a pipe brace clip.

7. The clamp assembly of claim 5, wherein the accessory clip is attached to the alignment bar.

8. The clamp assembly of claim 1, further comprising:

a lifting bar.

9. The clamp assembly of claim 1, further comprising:

a tie-off point.

10. The clamp assembly of claim 1, wherein the first flange and the second flange are part of an inner rail.

11. The clamp assembly of claim 1, wherein the first flange is part of a first side rail and the second flange is part of a second side rail.

12. The clamp assembly of claim 11, wherein the first side rail and the second side rail are connected by tightening the clamp.

13. The clamp assembly of claim 1, wherein the clamp comprises a clamp that couples formwork panels and couples attachments to the formwork panels.

14. The clamp assembly of claim 1 further comprising:

a screw mechanism configured to tighten and loosen the first member and the second member.

15. The clamp assembly of claim 14, wherein the screw mechanism engages with a threaded portion of the first member to tighten the clamp.

16. The clamp assembly of claim 1, wherein the connector clip is configured to be coupled to one or more attachments for the formwork system.

17. The clamp assembly of claim 16, further comprising:

a scaffold bracket.

18. The clamp assembly of claim 1, wherein the clamp ties formwork panels having different heights.

19. The clamp assembly of claim 1, wherein the clamp comprises a lifting device for a series of ganged formwork panels.

20. The clamp assembly of claim 1, wherein the formwork system comprises an aluminum formwork system.

* * * * *